US007883193B2

(12) United States Patent
Okito et al.

(10) Patent No.: US 7,883,193 B2
(45) Date of Patent: Feb. 8, 2011

(54) LIQUID CONTAINER, HEAD CARTRIDGE, INK JET PRINTING APPARATUS, AND STIRRING METHOD FOR LIQUID CONTAINER

(75) Inventors: Kazuhiko Okito, Hiratsuka (JP); Yasushi Nakano, Tokyo (JP); Takayuki Ishii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/725,038

(22) Filed: Mar. 16, 2010

(65) Prior Publication Data

US 2010/0172204 A1 Jul. 8, 2010

Related U.S. Application Data

(62) Division of application No. 11/797,381, filed on May 3, 2007, now Pat. No. 7,775,647.

(30) Foreign Application Priority Data

May 9, 2006 (JP) ..... 2006-130792
Apr. 27, 2007 (JP) ..... 2007-119912

(51) Int. Cl.
*B41J 2/175* (2006.01)

(52) U.S. Cl. ..... 347/86

(58) Field of Classification Search ..... 347/85, 347/86, 7

See application file for complete search history.

(56) References Cited

U.S. PATENT DOCUMENTS

| | | | | |
|---|---|---|---|---|
| 4,419,677 | A | 12/1983 | Kasugayama et al. | 347/87 |
| 5,640,186 | A | 6/1997 | Swanson et al. | 347/86 |
| 6,012,794 | A | 1/2000 | Nakano et al. | 347/7 |
| 6,086,178 | A | 7/2000 | Kawashima et al. | 347/7 |
| 6,367,906 | B1 | 4/2002 | Hiramatsu et al. | 347/34 |
| 6,464,328 | B1 | 10/2002 | Hiramatsu et al. | 347/34 |
| 6,749,293 | B1 | 6/2004 | Jones | 347/86 |
| 2001/0035897 | A1 | 11/2001 | Hayashi et al. | 347/65 |
| 2003/0067520 | A1 | 4/2003 | Inoue et al. | 347/86 |
| 2004/0022122 | A1 | 2/2004 | Kozyuk | 366/262 |
| 2004/0160496 | A1 | 8/2004 | Tsurui et al. | 347/86 |
| 2005/0117002 | A1 | 6/2005 | Tsukuda et al. | 347/86 |
| 2005/0270341 | A1 | 12/2005 | Yamamoto et al. | 347/85 |

(Continued)

FOREIGN PATENT DOCUMENTS

| | | |
|---|---|---|
| BE | 487188 | 2/1949 |

(Continued)

OTHER PUBLICATIONS

European Search Report dated Sep. 18, 2008, from corresponding European Application No. 07107717.6.

(Continued)

*Primary Examiner*—Julian D Huffman
(74) *Attorney, Agent, or Firm*—Fitzpatrick, Cella, Harper & Scinto

(57) ABSTRACT

A swing member that is provided in an ink containing chamber is swung according to movement of a carriage of a printing apparatus. Accordingly, an ink flow occurs in a hollow portion of the swing member from one of openings to the other opening, such that ink in an ink tank is stirred.

14 Claims, 49 Drawing Sheets

U.S. PATENT DOCUMENTS

| | | | | |
|---|---|---|---|---|
| 2007/0263025 | A1 | 11/2007 | Ohashi et al. | 347/19 |
| 2007/0263052 | A1 | 11/2007 | Iijima et al. | 347/92 |
| 2007/0291076 | A1 | 12/2007 | Seki et al. | 347/37 |
| 2007/0291077 | A1 | 12/2007 | Seki et al. | 347/37 |

FOREIGN PATENT DOCUMENTS

| | | |
|---|---|---|
| CH | 660984 | 6/1987 |
| CN | 1303773 | 7/2001 |
| CN | 1410269 | 4/2003 |
| EP | 583153 | 2/1994 |
| JP | 2004-216761 | 8/2004 |
| JP | 2005-066520 | 3/2005 |
| JP | 2006-044153 | 2/2006 |

OTHER PUBLICATIONS

Chinese Office action dated Jan. 8, 2010, from corresponding Chinese Application No. 200710102261.4, and English language translation thereof.

LIQUID CONTAINER, HEAD CARTRIDGE, INK JET PRINTING APPARATUS, AND STIRRING METHOD FOR LIQUID CONTAINER

This application is a division of application Ser. No. 11,797,381, filed May 3, 2007, the contents of which are incorporated herein by reference.

BACKGROUND OF THE INVENTION

1. Field of the Invention

The present invention relates to a liquid container that contains a liquid, such as ink or the like, to a head cartridge having the liquid container, to an ink jet printing apparatus that can print an image using the liquid container, and to a stirring method for the liquid container.

2. Description of the Related Art

In a serial type ink jet printing apparatus, a printing head that can eject ink, and an ink tank that contains ink to be supplied to the printing head are mounted on a carriage that can move in a main scanning direction. During image printing, an operation to eject ink from an ejection port of the printing head toward a printing medium while moving the carriage in the main scanning direction and an operation to transport the printing medium in a sub scanning direction crossing the main scanning direction are repeatedly performed. Then, ink droplets ejected from the printing head land on the printing medium, thereby printing a predetermined image.

As ink that is used in such an ink jet printing apparatus, there is known ink that contains a dye as a colorant. However, dye ink generally has slightly low light resistance and gas resistance. Accordingly, in case of a special use, such an outdoor notice, a printed matter with the dye ink rarely provides sufficient durability, that is, sufficient image solidity.

In recent years, a printing apparatus that uses ink containing a pigment as a colorant has been provided. The pigment ink has excellent light resistance and gas resistance, and thus a printed matter with the pigment ink can provide sufficient image solidity. However, unlike the dye ink, the pigment ink needs to be handled in consideration with colorant dispersibility. In order to obtain a uniformly printed image, it is necessary to disperse the colorant in a solvent.

Pigment particles in the pigment ink are floating in a dispersed state without being dissolved in an ink solution, unlike dye particles of the dye ink. If an ink tank containing the pigment ink stands still for a while, the pigment particles in the ink tank gradually settle by gravity, and a gradient of pigment particle concentration may occur in a height direction of the ink tank. That is, a high concentration layer of the colorant is located at the bottom of the ink tank, and a low concentration layer of the colorant is located at the top thereof. In this state, when ink is supplied from the ink tank to the printing head so as to start an image printing operation and then the printing operation is continued, a difference in density between images at the initial stage and the subsequent stage of the printing operation may occur.

For detailed explanation, it is assumed that an ink jet printing apparatus supplies ink from the bottom of the ink tank to the printing head. If an ink tank having a gradient of pigment particle concentration is mounted on the printing apparatus and a printing operation starts, since ink having high concentration layer of a colorant at the bottom of the ink tank is supplied at the initial stage of the printing operation, an unnecessarily high density image is printed. Thereafter, if the printing operation is continued, an image printing density is gradually lowered as ink in the ink tank is consumed. Then, in a state where the amount of ink in the ink tank becomes small, only ink having lower concentration of the colorant than an original concentration remains. For this reason, even if the images are printed on the basis of the same image data as that at the initial stage of the printing operation, the printing density is lowered. In particular, when the size or specific gravity of the pigment particle is large, the pigment particles markedly tend to settle. Accordingly, even if the ink tank is kept unused for a few days, a concentration gradient may occur to such a degree to affect an image.

As such, when the ink tank is used and then the concentration of the colorant of the ink to be ejected from the printing head is changed, a difference in density between the printed images at the initial use stage and the subsequent use stage of the ink tank occurs. In addition, for example, in a color ink jet printing system that uses a plurality of color inks and represents a color on the basis of a predetermined color balance, a color balance may deteriorate. In this case, a considerable difference in image density is recognized.

In order to maintain color density of ink droplets to be ejected from the printing head in a predetermined density range, regardless of the amount of ink remaining in the ink tank, it is preferable that the pigment particles in the ink tank can be uniformly dispersed during at least the printing operation.

In order to realize uniform dispersion of the pigment particles, there is suggested an ink tank that has a stirring member for stirring the pigment particles therein.

Japanese Patent Laid-Open No. 2005-066520 discloses an ink pack that includes a manually operable stirring body. The stirring body has a shape to be inserted into the ink pack from the outside. A part of the stirring body that protrudes outward serves as an operation portion for operating a stirring portion of the stirring body, which extends in the ink pack. That is, when a user swings the stirring portion regularly or if necessary, ink in the ink pack is stirred, such that the pigment particles can be dispersed.

Japanese Patent Laid-Open No. 2005-066520 also discloses an ink cartridge that includes a stirring member for stirring ink in the ink tank using an inertial force when a carriage moves during the printing operation. In Japanese Patent Laid-Open No. 2005-066520, as an example, a stirring body that is formed integrally with an ink cartridge case is shown. In this example, the stirring body extends to suspend from the top of the ink cartridge case to the bottom thereof, and a cylindrical weight portion is formed at a lower end of the stirring body. The stirring body is swung in the movement direction of the carriage with a basic portion at the top as a fulcrum by an inertial force according to an acceleration/stop/reverse operation of the carriage, thereby stirring ink in the ink cartridge.

Japanese Patent Laid-Open No. 2005-066520 also discloses a stirring bogy that can freely move at the bottom of the ink cartridge without being fixed to the ink cartridge case. The stirring body moves at the bottom of the ink cartridge by an inertial force according to the acceleration/stop/reverse operation of the carriage, thereby stirring ink.

Japanese Patent Laid-Open No. 2004-216761 discloses a stirring mechanism that includes a shaft-like weight and a plurality of fins. The shaft-like weight swings horizontally around a center axis of swing by an inertial force according to a movement of the carriage, and the fins are formed integrally with the shaft-like weight and swung horizontally. According to this configuration, since the plurality of fins are arranged in parallel in a height direction of the ink cartridge, ink is uniformly stirred from an upper layer to a lower layer in the ink cartridge.

However, in the configuration described in Patent Documents described above, since a stirring region is limited, there is a difficulty in stirring the settled pigment particles over the entire inside of the container, and thus efficiency is degraded.

For example, in the ink cartridge, which includes the manual stirring member, described in Japanese Patent Laid-Open No. 2005-066520, since a degree of freedom of movement of the stirring member is low, only ink in a limited region of the ink cartridge can be stirred. In particular, in the vicinity of a connection portion of the stirring body and the ink cartridge serving as the fulcrum of the stirring portion, a movement range of the stirring portion is narrow, and thus a sufficient stirring effect is not obtained.

In the stirring body, which is provided with the cylindrical weight portion, disclosed in Japanese Patent Laid-Open No. 2005-066520, the inertial force is efficiently used, but a stirrable range is insufficient. In addition, when the stirring body that can freely move at the bottom of the ink cartridge is used, ink in the vicinity of the bottom of the ink cartridge can be expected to be sufficiently stirred, but an upper region of the cartridge distant from the stirring body cannot be expected to be sufficiently stirred.

Meanwhile, in the stirring mechanism disclosed in Japanese Patent Laid-Open No. 2004-216761, since the plurality of fins are arranged in the height direction of the ink cartridge, stirring uniformity in the height direction can be expected to some extent. However, since the swing amount of the fins in the vicinity of the central axis in the ink cartridge is small, a stirring effect is small. Further, since the stirring member including the plurality of fins or a rotation shaft has a complex configuration, the ink cartridge itself becomes expensive.

As described above, since the pigment particles of the pigment ink in the ink cartridge gradually settle due to gravity, a gradient of pigment particle concentration occurs in the height direction of the ink cartridge. In order to eliminate the difference in concentration in the ink cartridge, it is effective to stir ink such that the high concentration ink settling at the lower layer of the ink cartridge is raised or the low concentration ink in the upper layer thereof flows into the lower layer.

SUMMARY OF THE INVENTION

The present invention has been finalized in consideration of the above problems.

The present invention provides a liquid container that efficiently stirs a liquid, such as ink or the like, contained therein, thereby reducing a concentration gradient of the liquid in the container, a head cartridge, an ink jet printing apparatus, and a method of stirring a liquid in the liquid container.

In the first aspect of the present invention, there is provided a liquid container comprising: a liquid containing portion; a stirring member that stirs a liquid contained in the liquid containing portion; and a support portion that supports the stirring member, wherein the stirring member includes a supported portion that is supported by the support portion, and a hollow portion that forms a liquid flow passage.

In the second aspect of the present invention, there is provided a head cartridge comprising: a liquid container that includes a liquid containing portion, a stirring member for stirring a liquid contained in the liquid containing portion, and a support portion for supporting the stirring member; and a printing head that performs printing using the liquid, wherein the stirring member includes a supported portion that is supported by the support portion, a first opening through which the liquid is introduced, a second opening through which the liquid is derived, and a hollow portion that forms a liquid flow passage communicating the first opening and the second opening with each other.

In the third aspect of the present invention, there is provided an ink jet printing apparatus comprising: a carriage on which an ink tank capable of containing ink therein and an ink jet printing head ejecting ink in the ink tank are mounted, wherein the ink tank includes an ink containing portion, a stirring member that stirs ink contained in the ink containing portion, and a support portion that supports the stirring member, the stirring member includes a supported portion that is supported by the support portion, a first opening through which ink is introduced, a second opening through which ink is derived, and a hollow portion that forms an ink flow passage communicating the first opening and the second opening with each other, and the stirring member of the ink tank is moved according to reciprocation of the carriage.

In the fourth aspect of the present invention, there is provided a stirring method for a liquid container, wherein the liquid container includes a liquid containing portion, a stirring member for stirring a liquid contained in the liquid containing portion, and a support portion for supporting the stirring member, the stirring member includes a supported portion that is supported by the support portion, a first opening through which the liquid is introduced, a second opening through which the liquid is derived, and a hollow portion that forms a liquid flow passage communicating the first opening and the second opening with each other, and the stirring member is swung with the supported portion as a fulcrum such that the liquid is introduced from the first opening and the liquid is derived from the second opening.

According to the present invention, an effective liquid flow for stirring the liquid in the liquid container can be actively generated in the container. With the liquid flow generated in the container, for example, pigment particles that are apt to settle at the lower layer of the ink containing chamber can be easily and reliably raised to the upper layer. Further, the low concentration liquid at the upper layer of the ink containing chamber can flow toward the lower layer.

As a result, the entire liquid, such as ink or the like, contained in the liquid container is efficiently stirred, and a concentration gradient of the liquid can be reduced. Further, a liquid container that has a low gradient of concentration after leaving for a long time and a head cartridge can be provided. In addition, an ink jet printing apparatus according to the present invention can reduce an ink stirring time before the image printing operation.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

First Embodiment

A liquid container of this embodiment is an ink tank that is mountable on a so-called serial scan type ink jet printing apparatus.

Figure 1:
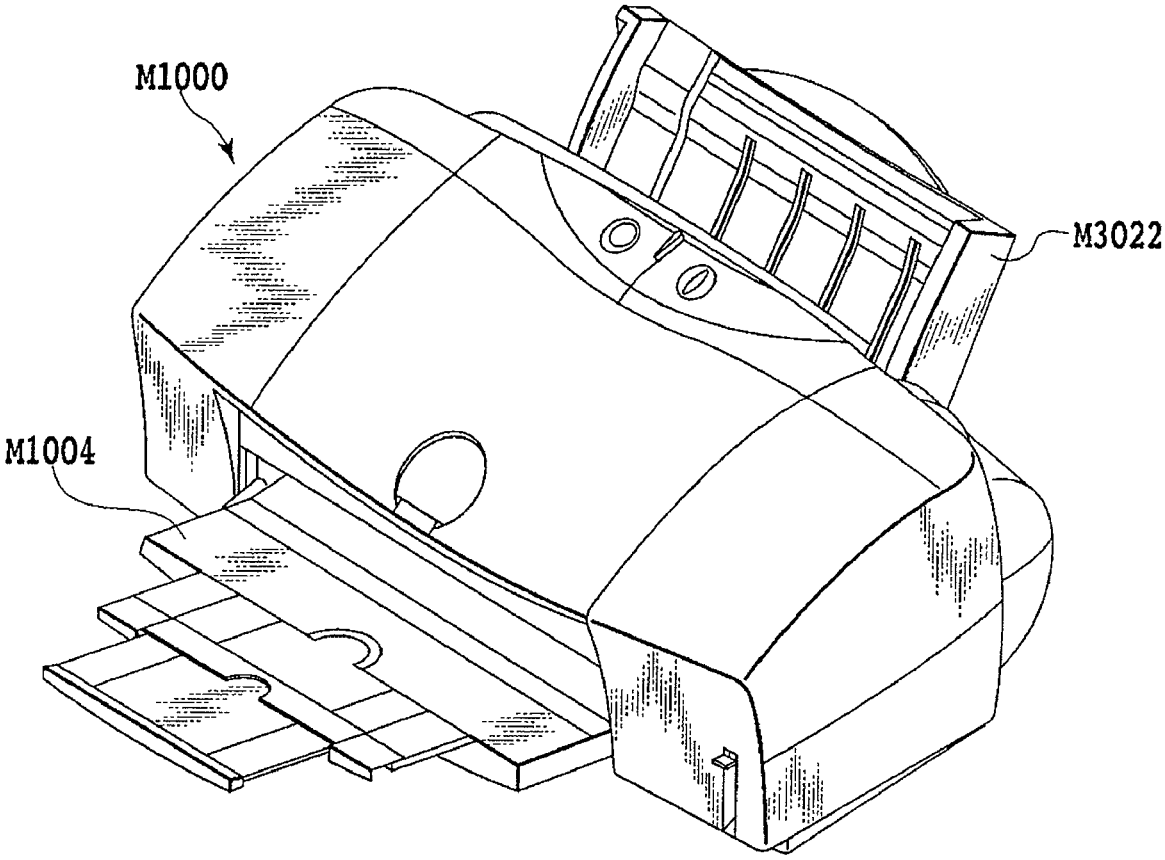
FIG. 1 is an exterior perspective view of a printing apparatus according to a first embodiment of the present invention.

FIG. 1 is an exterior perspective view of an ink jet printing apparatus in this embodiment. The printing apparatus primarily includes an apparatus main body M1000 that performs printing on a printing medium, a feed unit M3022 that supplies the printing medium into the apparatus, and a discharge tray M1004 that receives the printing medium after printing.

Figure 2:
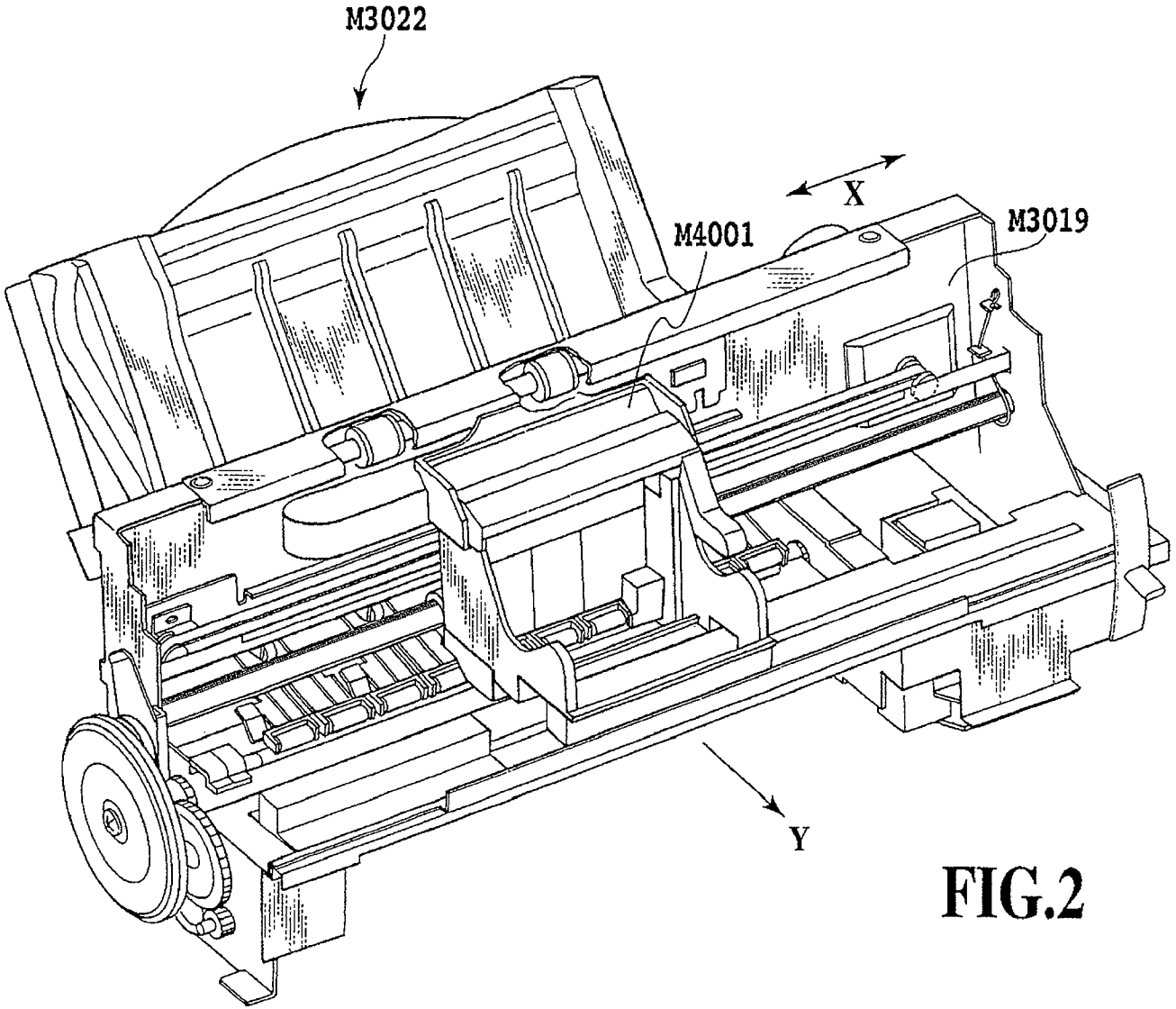
FIG. 2 is a perspective view illustrating the internal structure of the printing apparatus.

FIG. 2 is a perspective view illustrating the internal configuration of the apparatus main body M1000. Main internal mechanisms of the apparatus main body M1000 are installed and protected in a chassis M3019. Reference numeral M4001 denotes a carriage that can reciprocate in a main scanning direction of an arrow X while a printing head cartridge (not shown) is mounted thereon. The printing head cartridge has an ink jet printing head, as described below. If a printing operation command is input, one of printing mediums stacked on the feed unit M3022 is fed and then transported to a position where an image can be printed thereon by the printing head on the carriage M4001. Thereafter, while the carriage M4001 is moving in the main scanning direction, the printing head of the printing head cartridge repeatedly performs a printing scan operation to eject ink on the basis of image data and an operation to transport the printing medium in a sub scanning direction of an arrow Y by a transport unit. Accordingly, images are sequentially formed on the printing medium.

Figure 3:
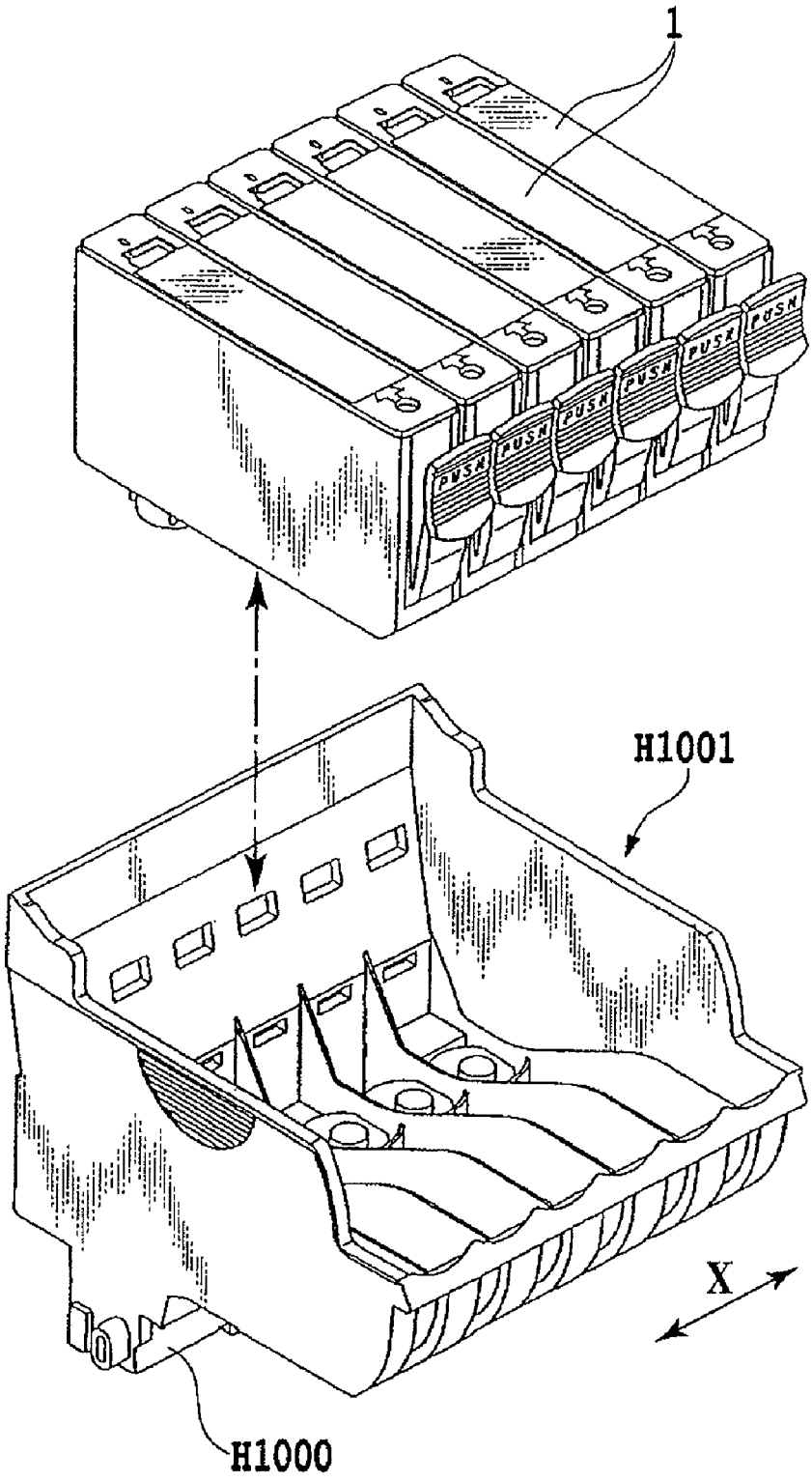
FIG. 3 is a perspective view of a printing head cartridge and an ink tank that are mountable on a carriage of the printing apparatus.

FIG. 3 is a perspective view of a printing head cartridge H1001 and ink tanks (liquid containers) 1 that can contain ink therein. An ink jet printing head H1000 is provided on one side of the printing head cartridge H1001 to eject ink droplets from an ejection port. On the opposite side of the printing head cartridge H1001, the ink tanks 1 are detachably mounted to supply ink to the printing head H1000. In the printing head cartridge H1001 of this embodiment, the ink tanks 1 for six colors can be separately mounted.

If each of the ink tanks 1 is mounted on the printing head cartridge (ink tank mounting portion) H1001, an ink supply port 30 (see FIG. 4) of the ink tank 1 is connected to the printing head H1000. Then, ink in an ink containing portion (liquid containing portion) of the ink tank 1 passes through the ink supply port 30 and is ejected from the printing head H1000 toward the printing medium downward in a gravity direction. As such, in a state where the ink tank is mounted on the printing apparatus, the ink supply port 30 is located downward in the gravity direction. In the present invention, a posture of the ink tank when the ink supply port is located downward in the gravity direction and ink is supplied to the printing head from the ink supply port is defined as a posture when the ink tank is used. In a head cartridge, in which the ink tank and the printing head are integrally formed, a posture of the head cartridge when the printing head ejects ink toward the printing medium downward in the gravity direction is defined as a posture when the head cartridge is used.

In the printing head H1000, a plurality of minute printing elements are arranged. Each of the printing elements is provided with a mechanism for ejecting ink. For example, when an electrothermal conversion element having a heating resistor (heater) is provided, a voltage pulse is applied to the individual electrothermal conversion elements according to an ink ejection signal. Accordingly, ink in the vicinity of the heating resistor is rapidly heated, and ink droplets are ejected from an ejection port by film boiling at that time.

(Overall Configuration of Ink Tank)

Figure 4:
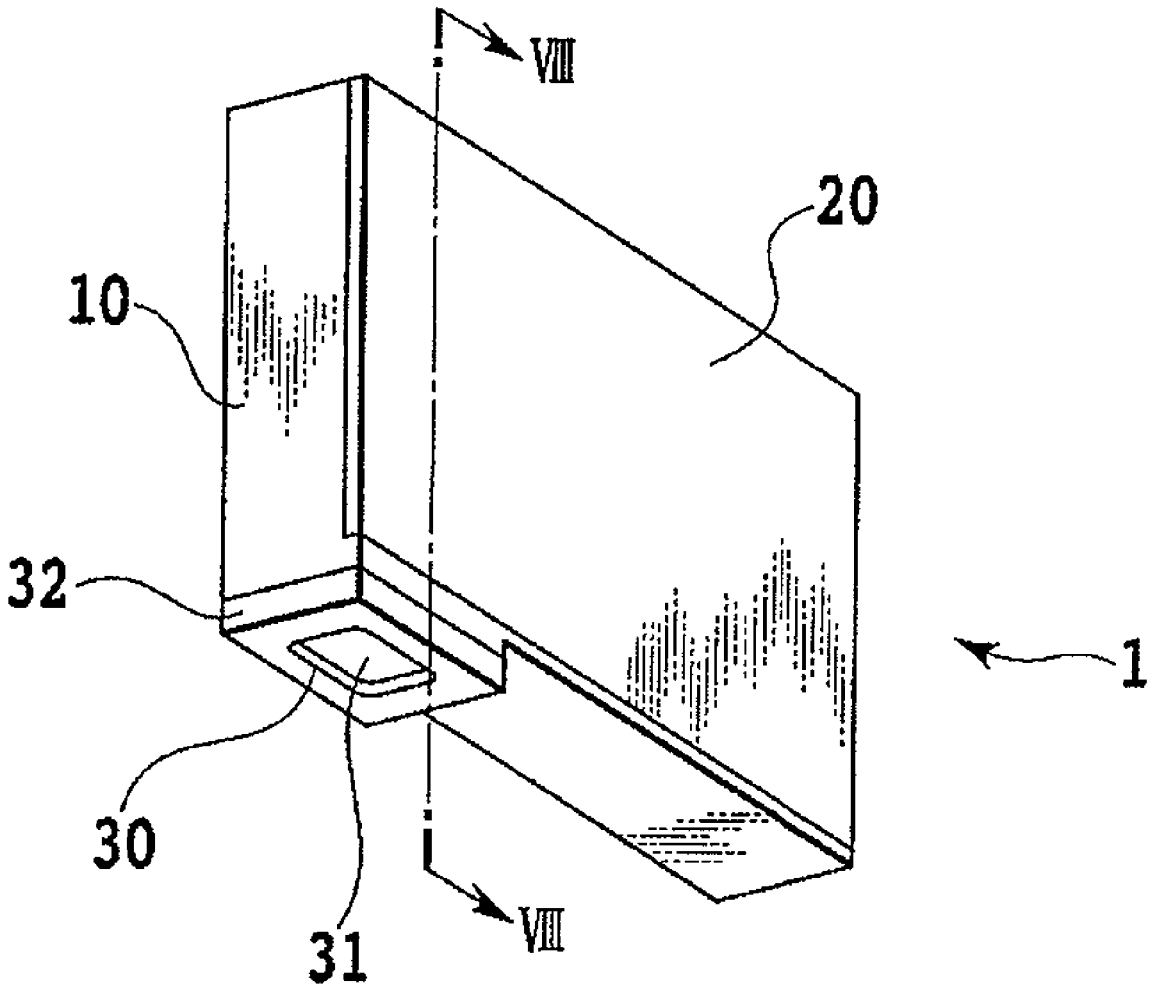
FIG. 4 is a perspective view of an ink tank in the first embodiment of the present invention.

FIG. 4 is an exterior perspective view of the ink tank 1. The ink tank 1 is a container that has an ink containing chamber therein. The ink tank 1 primarily includes an ink container case body 10 and a cover member 20. An ink supply port 30 is provided at the bottom of the ink tank 1 to supply ink to the printing head H1000.

Figure 5:
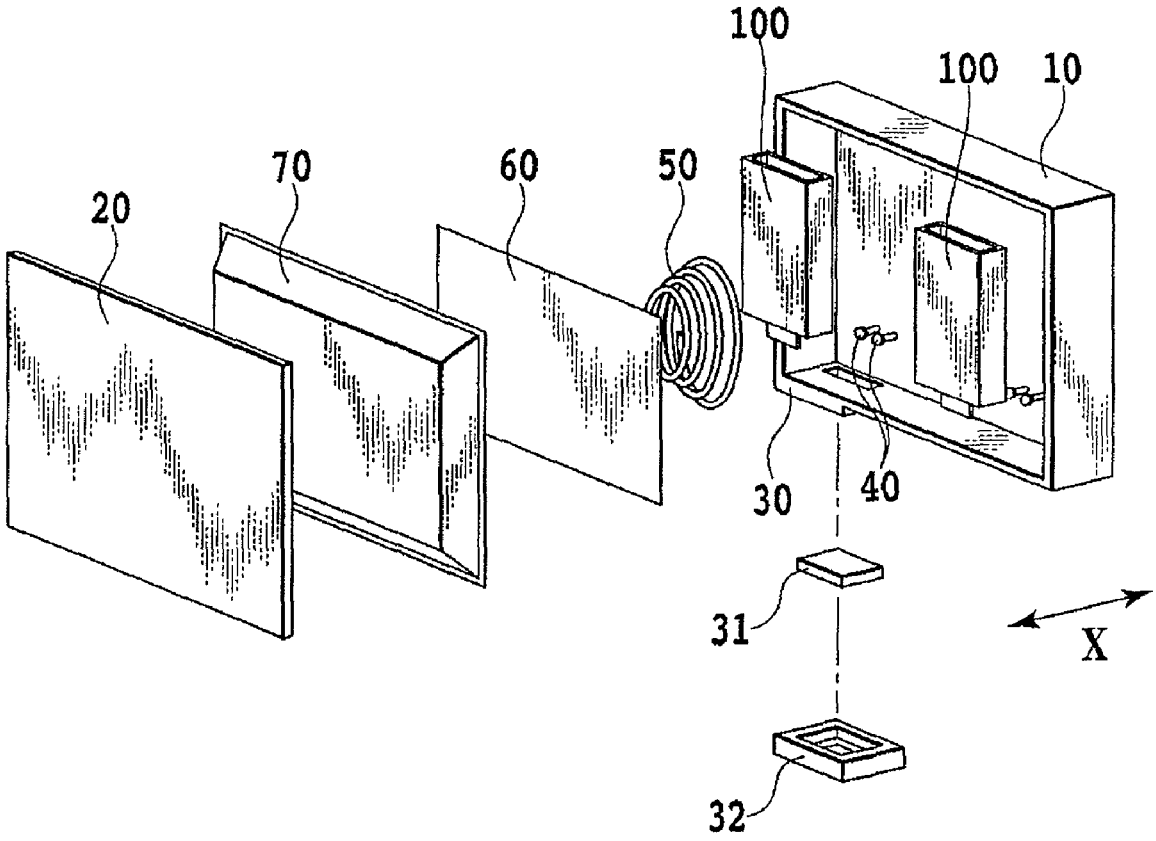
FIG. 5 is an exploded perspective view of the ink tank.
Figure 6:
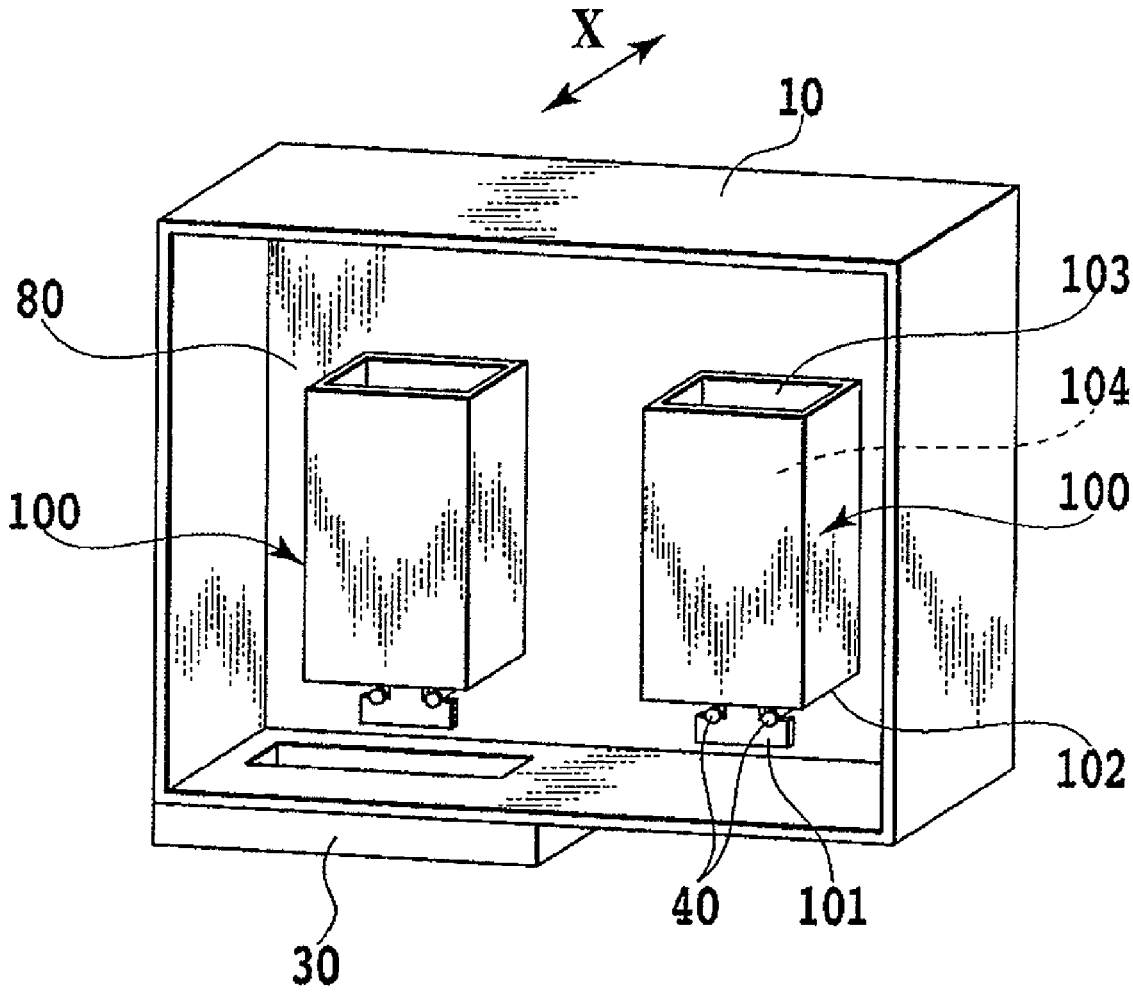
FIG. 6 is an explanatory perspective view showing an installment state of a swing member in the ink tank.

FIG. 5 is an exploded perspective view of the ink tank 1. The ink container case body 10 of the ink tank 1 is formed of, for example, polypropylene. In the ink container case body 10, swing members 100 serving as stirring members for stirring ink, a spring member 50, a plate member 60, and a flexible film 70 are accommodated. An opening of the ink container case body 10 is sealed by the cover member 20. At the inner wall of the ink container case body 10, protrusions (support portions) 40 are formed to support the swing members 100, as shown in FIG. 6. Further, a meniscus forming member 31 is provided in a portion of the ink container case body 10 forming the ink supply port 30.

The meniscus forming member 31 is a capillary member formed of a textile material, such as polypropylene, to exert a capillary force or an absorbent as a combination of the capillary member and a filter member (a permeation size of approximately 15 to 30 μm and a material, such as a stainless material or polypropylene). The meniscus forming member 31 communicates with the inside of the case body 10 by an ink flow passage, such that ink can be supplied from an ink containing chamber 80 in the case body 10 to the printing head H1000. Further, a meniscus is formed in the meniscus forming member 31 to prevent air bubbles from entering the ink containing chamber 80 from the outside. The meniscus forming member 31 is pressed from the outside by a pressing member 32 and held.

Figure 8C:
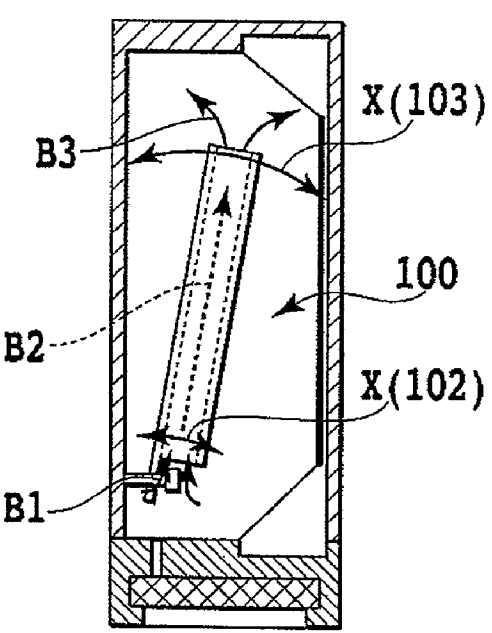
FIG. 8C is an explanatory view of the operation of the swing member.
Figure 8C:
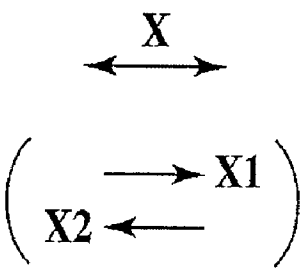

The flexible film 70 is welded to an opening peripheral portion of the ink container case body 10, and thus the ink containing chamber 80 (see FIG. 8A) as an ink containing portion is formed in the container case body 10. Ink is contained in the ink containing chamber 80 that is defined by the flexible film 70 and the case body 10. The flexible film 70 may be, for example, a film member (a thickness of approximately 20 to 100 μm), such as a thin film formed of polypropylene. The flexible film 70 is urged outward by the spring member 50 through the plate member 60. As shown in FIG. 8A, the flexible film 70 that is urged outward is a convex portion that protrudes outside the ink containing chamber 80. The flexible film 70 is protected by the cover member 20, such that the amount of protrusion of the convex portion is limited. With such an urging force of the spring member 50, a negative pressure is generated inside the ink containing chamber 80.

An atmosphere communicating portion (not shown) is provided in the cover member 20, and an atmospheric pressure is kept outside the ink containing chamber 80. The spring member 50 and the plate member 60 are formed of, for example, a stainless material.

As ink in the ink containing chamber 80 is supplied to the printing head and consumed, the flexible film 70 is bent with contraction of the spring member 50, and the volume of the ink containing chamber 80 is decreased. In the ink tank 1 of this embodiment, ink in the ink containing chamber 80 can be consumed until the plate member 60 comes into contact with the inner wall of the case body 10.

(Composition of Ink to be Filled)

Ink that is used in this embodiment is, for example, ink containing a pigment (pigment ink). The pigment of the pigment ink may be a resin dispersion type pigment or an activator dispersion type pigment using a dispersing agent or an activator. The pigment may be a microcapsule type pigment that is dispersible by increasing dispersibility of a water-insoluble coloring agent itself without using a dispersing agent or the like, or may be a self-dispersion type pigment that introduces hydrophilic radicals to the surfaces of the pigment particles. Further, a pigment (polymer-coupled type self-dispersion pigment) that is reformed by chemically coupling organic radicals including a polymer to the surfaces of the pigment particles may be used. Of course, the pigments that are obtained by different dispersion methods may be used in combination. The pigment that can be used in the present invention is not particularly limited.

Table 1 shows two kinds of pigment inks (pigment ink 1 and 2) that are used in this embodiment. However, the present invention is not limited to the composition shown in Table 1.

The pigment ink used in this embodiment has an ink composition ratio shown in Table 1. A self-dispersion type pigment is used in a pigment dispersion element 1, and a resin dispersion type pigment is used in a pigment dispersion element 2. Further, in each of the pigment dispersion element 1 and the pigment dispersion element 2, dispersion liquid is obtained by adding water to a pigment and dispersing the pigment such that the pigment concentration becomes 10% by mass. The composition of the solvents is shown in Table 1.

TABLE 1

Ink Composition in the Embodiment

| | Ink Composition (% by mass) | |
|---|---|---|
| | 1 | 2 |
| pigment Dispersion Element 1 | 50 | |
| pigment Dispersion Element 2 | | 50 |
| glycerin | 5 | 5 |
| polyethylene glycol 600 | 15 | 15 |
| 2-pyrolidone | 5 | 5 |
| acetylene glycol EO additive | 0.1 | 0.1 |
| pure water | 24.9 | 24.9 |

The specific gravity of the pigment ink to be filled in the ink tank is preferably smaller than the specific gravity of each of the swing members. In this embodiment, the specific gravity of the swing member formed of, for example, a stainless material is 8.0 g/cm$^3$, and the specific gravity of the pigment ink is 1.0 to 1.1 g/cm$^3$. That is, the specific gravity of the pigment ink is smaller than the specific gravity of the swing member.

(Configuration of Stirring Mechanism)

Figure 7:
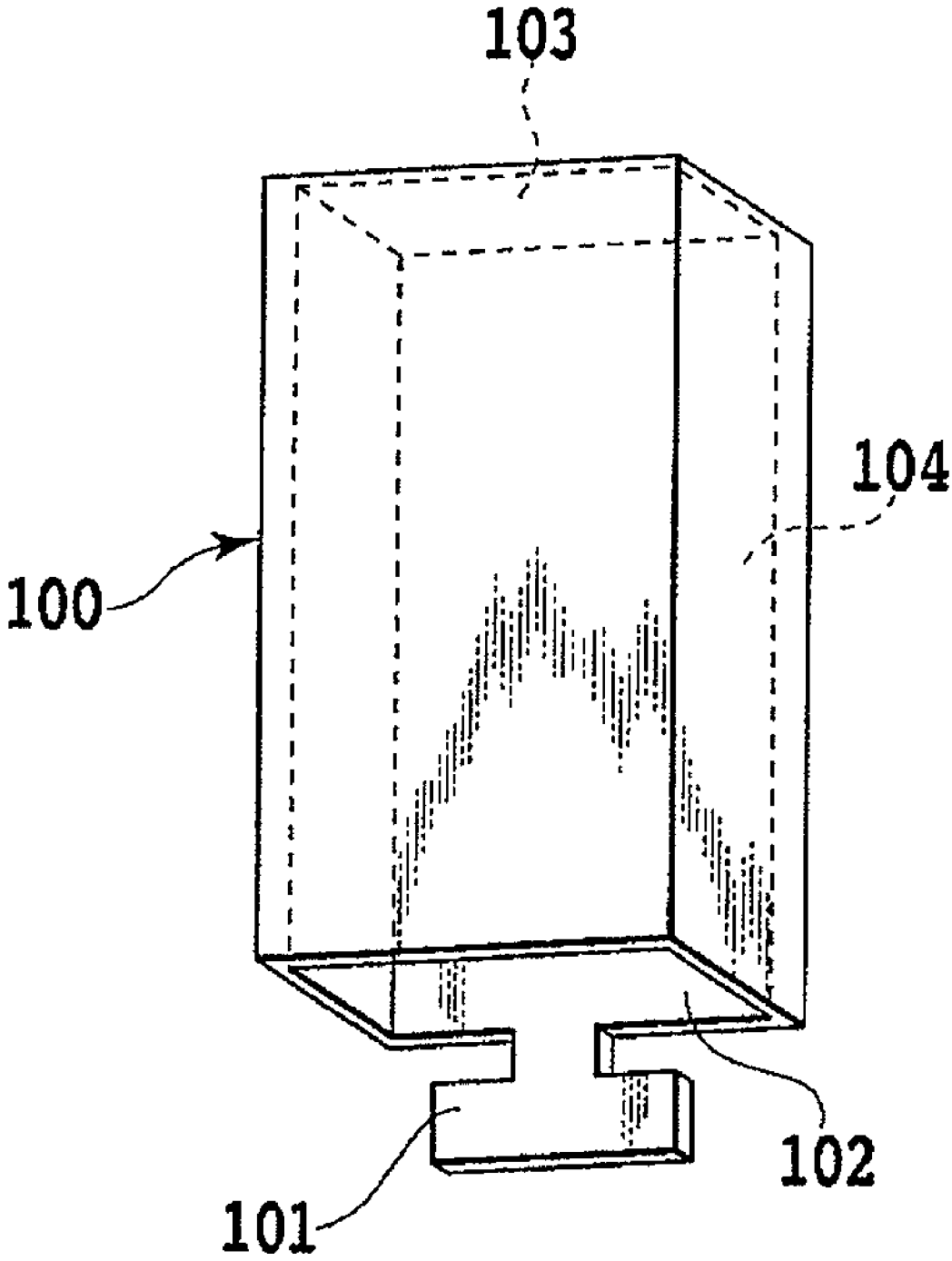
FIG. 7 is an enlarged perspective view of the swing member.

FIG. 6 is a perspective view illustrating an installment state of the swing members 100. FIG. 7 is an enlarged perspective view of the swing member 100.

Both sides of a support portion 101 that is located below the swing member 100 are caught by the protrusions 40 that are formed at the inner wall of the case body 10, such that the swing member 100 is supported so as not to come into contact with the spring member 50. The protrusions 40 serve as a fulcrum when the swing member 100 swings. When the protrusions 40 serve as support portions, the support portion 101 becomes a supported portion that is supported by the protrusions 40. A head portion of each of the protrusions 40 is formed to have a diameter larger than the width of a cutout portion of the support portion 101 by which the protrusions 40 are caught. The protrusions 40 serve as a fulcrum of swing of the swing members 100 and allow sliding of the swing members 100 in an axial direction of the protrusions 40. The swing member 100 is provided with a lower opening 102 that is located on a lower side of the ink container case body 10 in a gravity direction, and an upper opening 103 that is located above the lower opening 102. That is, the swing member 100 is provided with the lower opening 102 that is located on a lower side in the vertical direction, and the upper opening 103 that is located on a lower side in the vertical direction. Then, the swing member 100 is three-dimensionally molded such that the inside between the openings 102 and 103 forms a hollow portion 104. In the hollow portion 104, an ink flow passage (liquid flow passage) that communicates the openings 102 and 103 with each other is formed. As described below, ink in the ink containing chamber 80 (liquid containing portion) is introduced from one of the openings 102 and 103 and then derived from the other opening through the ink flow passage. In addition, the swing member 100 is configured such that, if ink is filled in the ink containing chamber 80, the openings 102 and 103 and the hollow portion 104 of the swing member 100 are submerged in ink.

In the swing member 100 of this embodiment, the support portion 101 provided in the vicinity of the lower opening 102 is supported by the protrusions 40. For this reason, as shown in FIG. 8C, when the swing member 100 swings, the displacement of the upper opening 103 becomes larger than that of the lower opening 102.

Further, when the hollow portion 104 of the swing member 100 has an excessively small inner diameter, the pigment in ink may be aggregated to a size larger than the inner diameter of the hollow portion 104, and ink may not move in the hollow portion 104. Accordingly, the inner diameter of the hollow portion 104 is set to such an extent that, even if the pigment in ink to be used is aggregated, ink can move in the hollow portion 104.

In addition, the swing member 100 of this embodiment is formed of a stainless material. In the present invention, however, the material of the swing member is not limited thereto. It is preferable that the swing member 100 be formed of a material having a specific gravity larger than that of ink contained in the ink containing chamber 80. Further, the movement speed of the swing member 100 may be changed due to the specific gravity and viscosity of ink to be used, the movement speed of the carriage described below, and the like, and the stirring efficiency may be changed. Accordingly, it is preferable that the specific gravity of the swing member 100 be appropriately selected according to various conditions.

(Operation and Action of Stirring Mechanism)

Figure 8B:
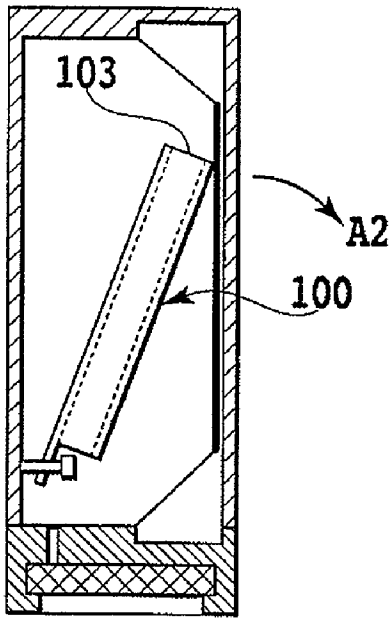
FIG. 8B is an explanatory view of the operation of the swing member when a carriage is reversed from an X1 direction to an X2 direction.
Figure 8B:
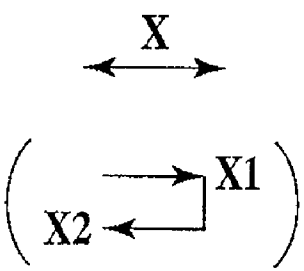
Figure 8A:
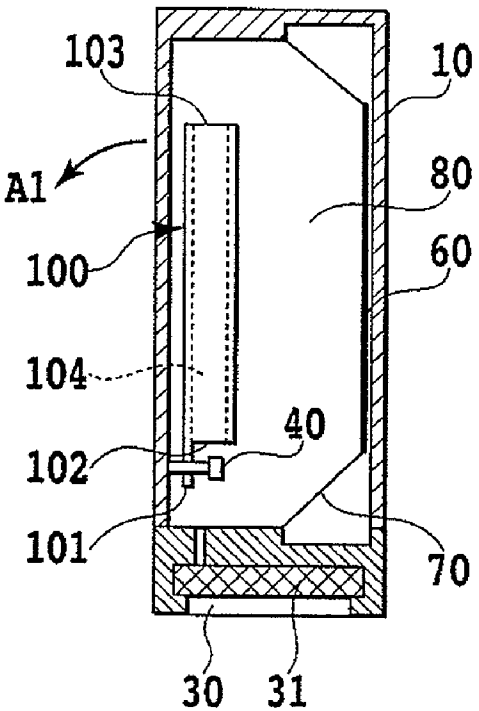
FIG. 8A is an explanatory view of the operation of the swing member when a carriage is reversed from an X2 direction to an X1 direction.
Figure 8A:
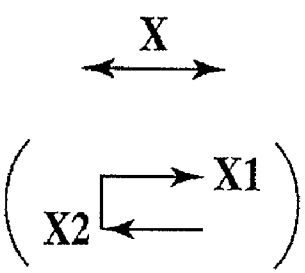

FIGS. 8A to 8C are side cross-sectional views of the ink tank 1 for illustrating the operation of the swing member 100 in this embodiment, which correspond to a cross-sectional view taken along the line VIII-VIII of FIG. 4.

FIG. 8A shows a first state of the swing member 100. The carriage M4001 reciprocates in the main scanning direction (a direction of an arrow X) within a range corresponding to a printing width of the printing medium. When the movement direction is reversed, deceleration, stop, and acceleration in an opposite direction are performed. At that time, the inertial force is applied to the ink tank. When the inertial force is applied in a direction of an arrow X2 (hereinafter, simply referred to as 'X2 direction'), that is, when the movement direction of the carriage M4001 is reversed from the direction of the arrow X2 to a direction of an arrow X1 (hereinafter, simply referred to as 'X1 direction'), as shown in FIG. 8A, the swing member 100 rotates in a direction of an arrow A1 (hereinafter, simply referred to as 'A1 direction') with the support portion 101 as a fulcrum. At this time, the upper opening side of the swing member 100 is displaced in a direction to come into contact with the inner wall of the ink container case body 10 at which the protrusions 40 are provided. Here, the state where the inertial force is applied in the X2 direction in the above-described manner is referred to as the first state. After the movement direction of the carriage M4001 is reversed from the X2 direction to the X1 direction, when the carriage M4001 uniformly moves in the X1 direction, the inertial force is not applied, and the swing member 100 is kept in the first state.

FIG. 8B shows a second state of the swing member 100. The second state is a state where the inertial force is applied in the X1 direction, that is, the movement direction of the carriage M4001 is reversed from the X1 direction to the X2 direction. In this state, as shown in FIG. 8B, the swing member 100 rotates in a direction of an arrow A2 (hereinafter, simply referred to as 'A2 direction') with the support portion 101 as a fulcrum. At this time, the upper opening side of the swing member 100 is displaced in a direction to approach the plate member 60 in the ink containing chamber 80. Here, the state where the inertial force is applied in the X1 direction in the above-described manner is referred to as the second state. After the movement direction of the carriage M4001 is reversed from the X1 direction to the X2 direction, when the carriage M4001 uniformly moves in the X2 direction, the inertial force is not applied, and the swing member 100 is kept in the second state.

The carriage M4001 repeats reciprocation during the printing operation, and thus the swing member 100 repeatedly becomes the first and second states of FIGS. 8A and 8B to stir the ink in the ink containing chamber 80.

FIG. 8C shows the displacement directions and displacements of the openings 102 and 103 and the ink flow when the swing member 100 swings.

As described above, the displacement X (103) of the upper opening 103 according to swing (rotation) of the swing member 100 is larger than the displacement X (102) of the lower opening 102. For this reason, a relative movement speed of the upper opening 103 and ink in the vicinity thereof becomes higher than a relative movement speed of the lower opening 102 and ink in the vicinity thereof. When the upper opening 103, the lower opening 102, and the hollow portion 104 are submerged in ink, a difference in pressure occurs between ink in the vicinity of the lower opening 102 and ink in the vicinity of the upper opening 103 due to a difference in speed of the two openings 102 and 103.

In this embodiment, the relative movement speed of the upper opening 103 and ink in the vicinity thereof is higher than the relative movement speed of the lower opening 102 and ink in the vicinity thereof. Accordingly, a pressure of ink in the vicinity of the upper opening 103 is lower than that of ink in the vicinity of the lower opening 102. Therefore, ink flows B1, B2, and B3 occur from the lower opening 102 toward the upper opening 103 through the hollow portion 104. With the ink flows, the pigment particles that are apt to settle at the lower layer of the ink containing chamber 80 can be raised to the upper layer. As a result, the pigment particles in the ink containing chamber 80 can be efficiently stirred.

In order to verify an ink stirring effect, the inventors have injected the pigment ink into the ink tank to a position where the hollow portion of the swing member is submerged in ink. Then, in order to verify a phenomenon that the pigment ink settles in short time, the ink tank was warmed and preserved. The warming and preservation was performed at 60° C. for 90 days. After the ink tank that had been warmed and preserved in such a manner was placed under a normal temperature environment and cooled, the pigment ink located on the lower side of the ink tank in the gravity direction was extracted without swing of the swing member. Further, in a separate ink tank that had been warmed and preserved in the same manner, the pigment ink located on the lower side of the ink tank in the gravity direction was extracted after swing of the swing member. Then, the pigment concentrations of the pigment inks extracted from both the ink tanks were compared.

Table 2 shows the pigment concentration of the pigment ink extracted after the warming and preservation without stirring and the pigment concentration of the pigment ink extracted after the warming and preservation after stirring by the above-described method. The pigment concentrations shown in Table 2 are relative values when the pigment concentration before the warming and preservation is 100. As shown in Table 2, the pigment concentration of the former when stirring was not performed is 170, and the pigment concentration of the latter when stirring was performed is 120 or less. Accordingly, it could be confirmed that, by performing the above-described stirring method, the pigment concentration of ink has approached the pigment concentration before the warming and preservation.

TABLE 2

| Stirring Verification Result of Swing member | |
|---|---|
| | Pigment Concentration |
| No Stirring | 170 |
| Stirring | 120 or less |

Warming and preservation 60° C. and 90 days

Pigment concentration before warming and preservation is 100

As described above, in the first embodiment, it is configured that when the swing member swings, the movement speed of the opening on the lower side becomes lower than that of the upper opening on the upper side. Accordingly, an ink flow from the lower layer toward the upper layer in the ink container occurs. With the ink flow, high concentration ink and low concentration ink are circulated in the ink container, and thus stirring can be efficiently performed. As a result, a difference in density between printed images can be prevented from occurring in the initial use stage and the subsequent use stage of the ink tank. Further, deterioration of a color balance when a plurality of color inks are used can be prevented.

In order to increase the difference in the movement speed of the upper opening and the lower opening of the swing member, it is advantageous that the fulcrum of swing of the swing member 100 is close to the lower opening but distant from the upper opening. When the swing member is a rigid body, it is necessary to make at least the distances from the fulcrum of swing of the swing member to the upper opening and the lower opening different from each other.

Immediately before the swing member 100 is reversed in an opposite direction after it swings in one direction, the inertial force is applied to ink in the hollow portion 104, and an ink flow in the hollow portion 104 toward the upper opening 103 can be generated. When the direction of swing is reversed, ink in the hollow portion 104 is applied with a propulsive force from the lower opening 102 toward the upper opening 103 by the inertial force. Then, as shown in FIG. 8C, ink flows B1, B2, and B3 occur through the hollow portion 104. With the ink flows, the pigment particles that are apt to settle at the lower layer of the ink containing chamber 80 can be raised to the upper layer. As a result, the pigment particles in the ink containing chamber 80 can be efficiently stirred. The swing direction of the swing member 100 is not necessarily reversed. What is necessary is that a propulsive force enough to raise the pigment particles at the bottom of the ink containing chamber to the upper side of the container through the hollow portion of the swing member is applied by the inertial force. The swing member may be stopped after swing in one direction.

In addition, if a centrifugal force is applied to ink in the hollow portion 104 by swinging of the swing member 100, a flow of ink in the hollow portion 104 toward the upper opening 103 can be generated. Further, an ink flow can be mechanically generated by relative proximity and separation displacement of an outer wall of the swing member 100 and an inner wall of the ink containing chamber 80.

In any cases, what is necessary is that the swing member having the hollow portion is provided in the liquid container and, when the swing member is swung, the liquid can be guided into the hollow portion such that the liquid flows into the hollow portion from one end of the hollow portion and flows out from the other end of the hollow portion. Accordingly, it is possible to generate the liquid flow that is effective to stir the liquid in the liquid container.

Like this embodiment, when the swing fulcrum is provided in the vicinity of the opening on the lower side of the swing member in the vertical direction, the pigment particles that are apt to settle at the lower layer of the ink containing chamber can be easily and reliably raised to the upper layer. That is, if the swing fulcrum is located below a central portion of the swing member in the vertical direction, ink that is introduced through the opening on the lower side in the gravity direction can be derived from the opening on the upper side in the gravity direction. That is, ink can be guided from the lower side in the gravity direction toward the upper side through the hollow portion and then stirred. As a result, the entire liquid, such as ink, contained in the liquid container can be efficiently stirred and the concentration gradient of the liquid can be reduced. The stirring effect varies according to parameters, such as the size of the ink containing chamber, the inner diameter, the peripheral length, the surface area, the length, the specific gravity, the movement speed, and the movement distance of the swing member, the viscosity of ink, a contact angle, and the specific gravity of ink. However, such parameters can be arbitrarily set insofar as ink in the ink tank is applied with a propulsive force enough to move in the container through the hollow portion of the swing member. What is necessary is that the swing member 100 is swung such that such a propulsive force is generated by the centrifugal force and the inertial force applied to the ink in the tank. With the swing of the swing member, ink in the ink tank can be stirred.

Further, in this embodiment, a method that swings the swing member by reciprocation of the carriage is exemplified. However, in the liquid container of the present invention, when the swing member swings by vibration, such as movement during distribution, the same stirring effect can be obtained.

(Modifications of Configuration of Stirring Mechanism)

A configuration for realizing the advantages of this embodiment is not limited to the configuration of the above-described stirring mechanism.

Figure 9:
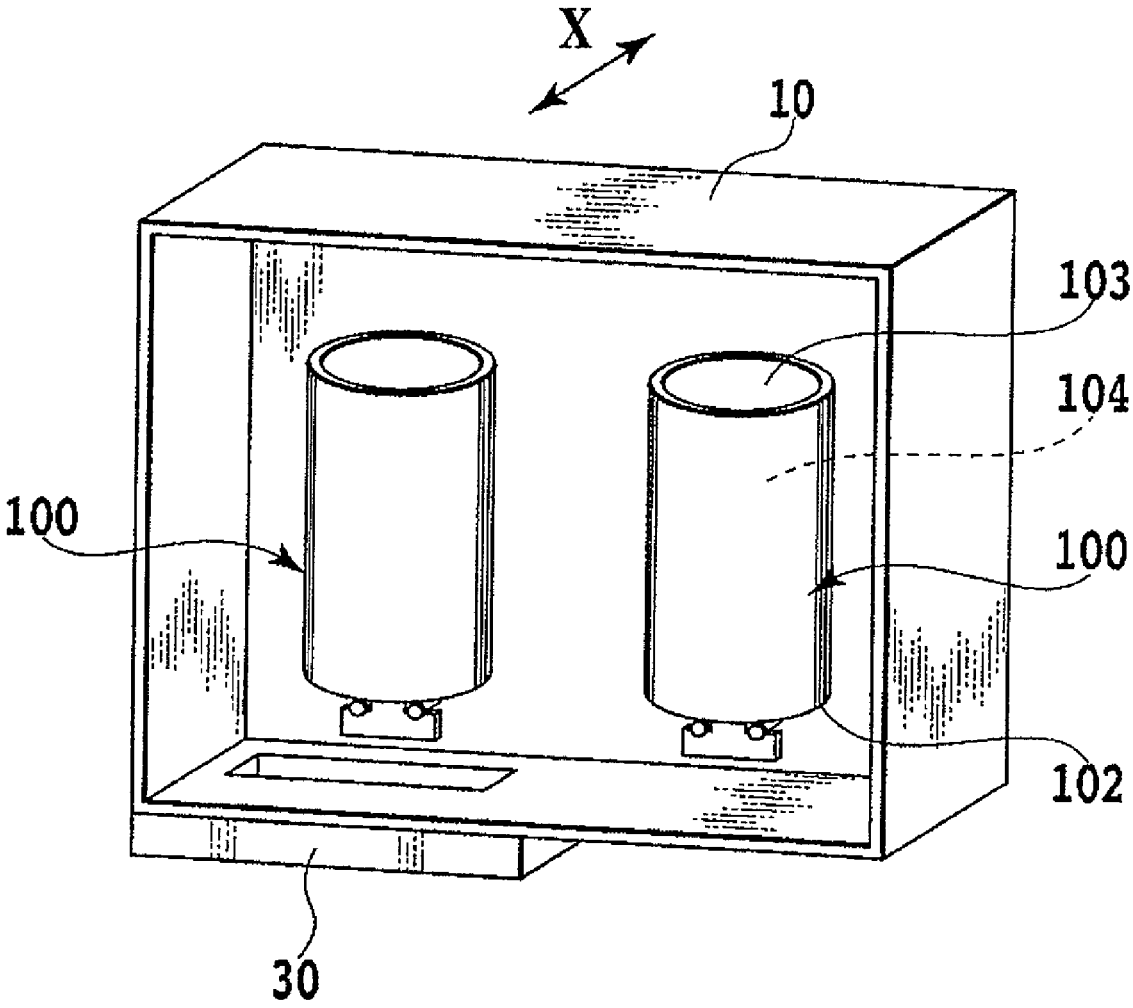
FIG. 9 is a perspective view of a swing member having a circular opening and a circular hollow portion according to a modification of the swing member in the first embodiment of the present invention.

FIG. 9 is an explanatory view of an ink tank, in which a swing member 100 having a different shape is disposed, as a modification of the configuration of the stirring mechanism. In the swing member 100 of this modification, openings 102 and 103 have elliptical shapes and a hollow portion 104 has a cylindrical shape. If the hollow portion 104 substantially becomes an airtight space, excluding the openings 102 and 103, the same effects as the configuration shown in FIGS. 1 to 8C can be obtained.

Figure 10:
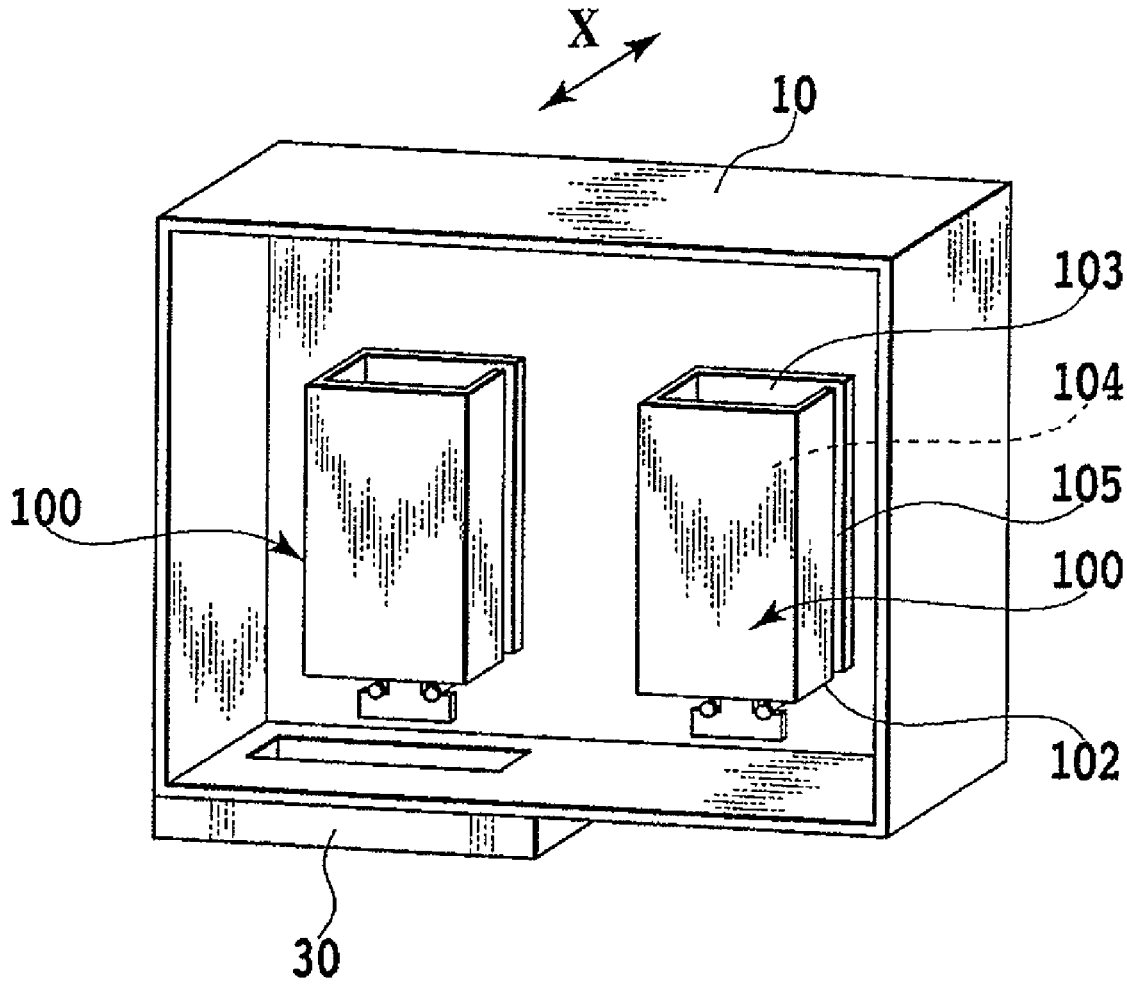
FIG. 10 is a perspective view of a swing member provided with a third opening according to another modification of the swing member in the first embodiment of the present invention.

In another modification of the stirring mechanism of FIG. 10, in order to easily manufacture the swing member 100 at low cost, for example, openings 102 and 103 and a hollow portion 104 of the swing member 100 are formed by bending a stainless plate member. In the stirring mechanism of this modification, the upper opening 103, the lower opening 102, and a third opening (a gap portion) 105 connected to the two openings are provided. With a space defined the three openings, the hollow portion 104, in which an ink flow occurs, is formed. That is, the hollow portion 104 communicates with the ink containing chamber 80 (liquid containing portion) through the third opening 105 in a portion other than the upper and lower openings.

If an ink flow B2 (see FIG. 8C) occurs in the hollow portion 104, the same effects as the above-described configuration can be obtained. Further, the third opening 105 is not limited to the opening of this modification that is continuous between the upper opening 103 and the lower opening 102. For example, a plurality of discontinuous gaps may be formed between the openings 103 and 102.

Figure 11:
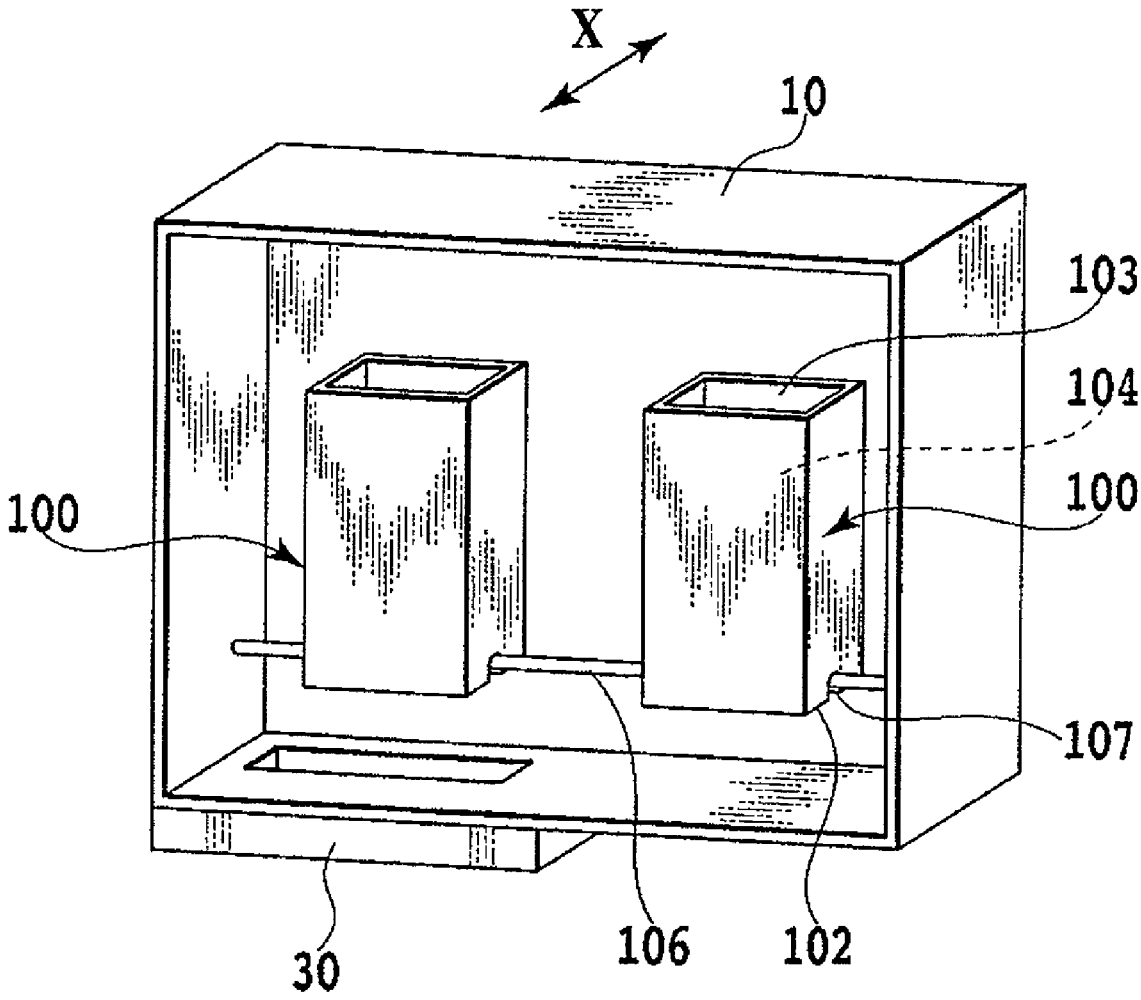
FIG. 11 is a perspective view of a swing member provided with a common support shaft according to still another modification of the swing member in the first embodiment of the present invention.

In another modification of the stirring mechanism of FIG. 11, a shaft 106 is provided between opposing inner walls of the ink container case body 10 so as to support the swing member 100. Cutout or holed supported portions 107 are provided in a portion of the swing member 100, and the shaft 106 is formed to pass through the supported portions 107 in a horizontal direction. Two swing members 100 in the ink containing chamber 80 are swingably supported by one shaft 106. With this configuration, the swing members 100 swing with the shaft 106 as a fulcrum, and thus the same effects as the above-described configuration can be obtained. In this modification, the swing fulcrum of a plurality of swing members can be shared. As such, the configuration that the common fulcrum of swing is provided is not specified to this modification but can be arbitrarily selected.

Figure 12:
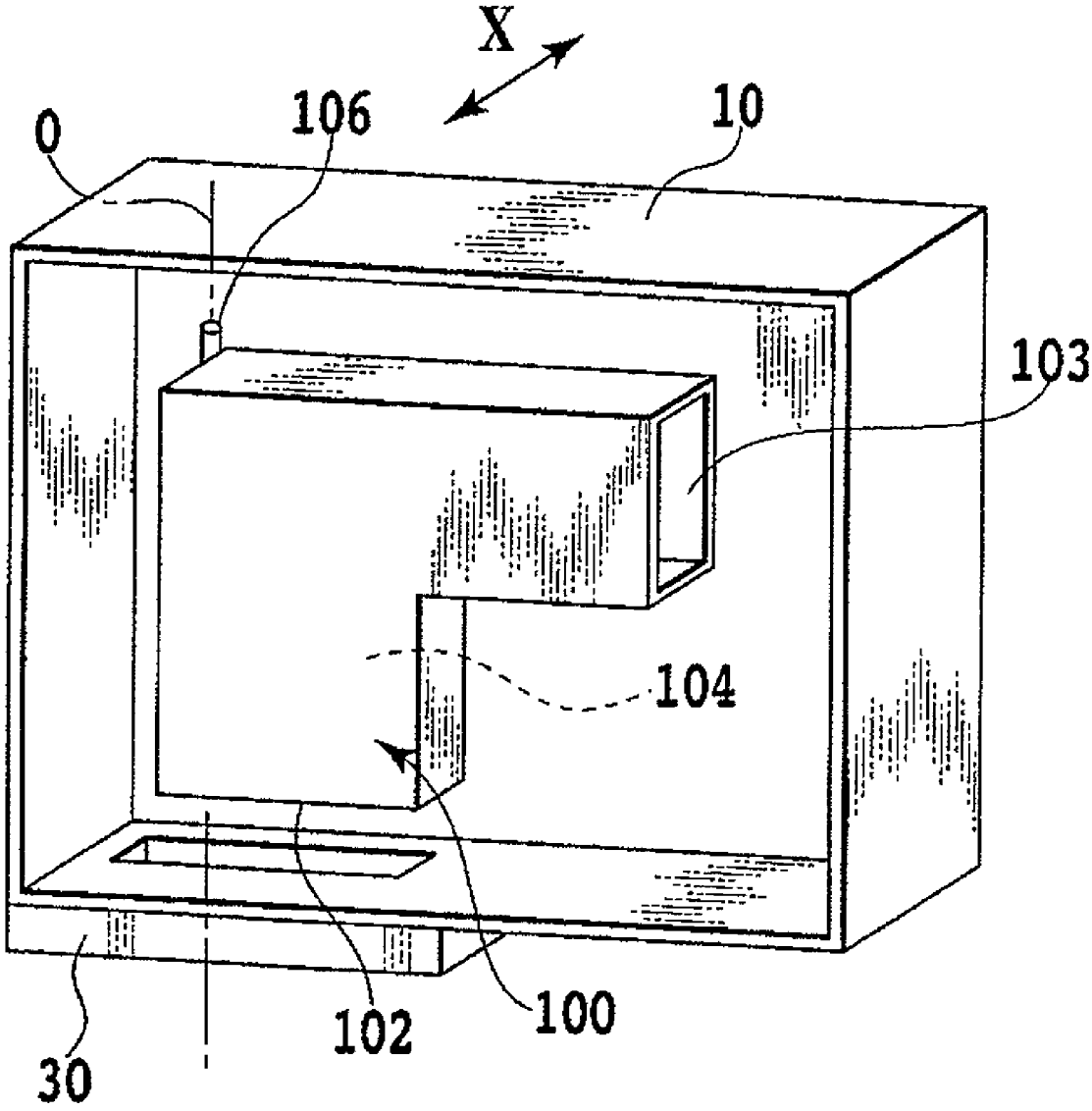
FIG. 12 is a perspective view of a swing member having a bent hollow portion according to yet still another modification of the swing member in the first embodiment of the present invention.

In a swing member 100 of FIG. 12, a hollow portion 104 is bent. The swing member 100 is swingably supported by a shaft 106 provided in the vertical direction with an axial line O as a center. A lower opening 102 is located close to the lower portion of the ink container case body 10 and the shaft 106. An upper opening 103 is located in a direction distant from the shaft 106 in the horizontal direction farther than the lower opening 102. The hollow portion 104 is formed to be bent between the lower opening 102 formed on the lower side and the upper opening 103 formed in the direction distant from the shaft 106. With this configuration, the swing member 100 swings with the shaft 106 as a fulcrum, and the same effects as the above-described configuration can be obtained. Similarly to the configuration shown in FIG. 8A, all the lower opening, the hollow portion, and the upper opening of the swing member are submerged in ink.

Figure 13:
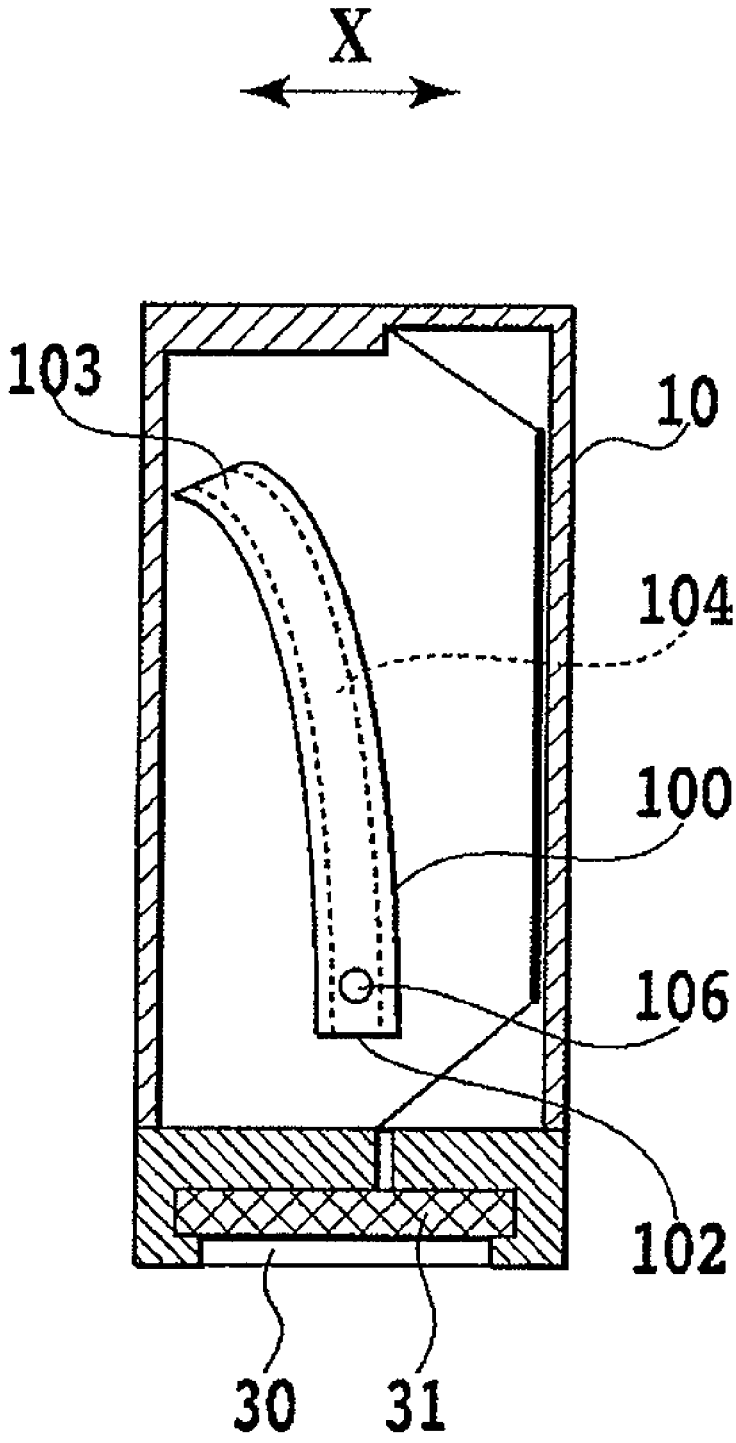
FIG. 13 is a cross-sectional view of an ink tank for illustrating a pliable swing member according to yet still another modification of the swing member in the first embodiment of the present invention.

A swing member 100 of FIG. 13 is formed of, for example, a pliable material (flexible member), such as silicon rubber. A vicinity portion of a lower opening 102 of the swing member 100 is fixed to a shaft 106 that extends in a horizontal direction, and an upper opening 103 is formed to freely move. If the carriage M4001, on which the ink cartridge 1 is mounted, reciprocates in a main scanning direction of an arrow X during the printing operation, the swing member 100 repeatedly moves in the main scanning direction involving a bend of a vicinity portion of the upper opening 103. Similarly to the above-described configuration, ink in the ink containing chamber 80 can be stirred.

In the first embodiment described above, an example where the two swing members 100 are provided in the ink containing chamber 80 has been described. The two swing members 100 are provided so as not to come into contact with the spring member 50, which is provided in the ink containing chamber 80, while the areas of the openings are formed as large as possible in order to perform efficient stirring in short time. What is necessary is that the spring member 50 does not interfere with swinging of the swing members 100.

Figure 14:
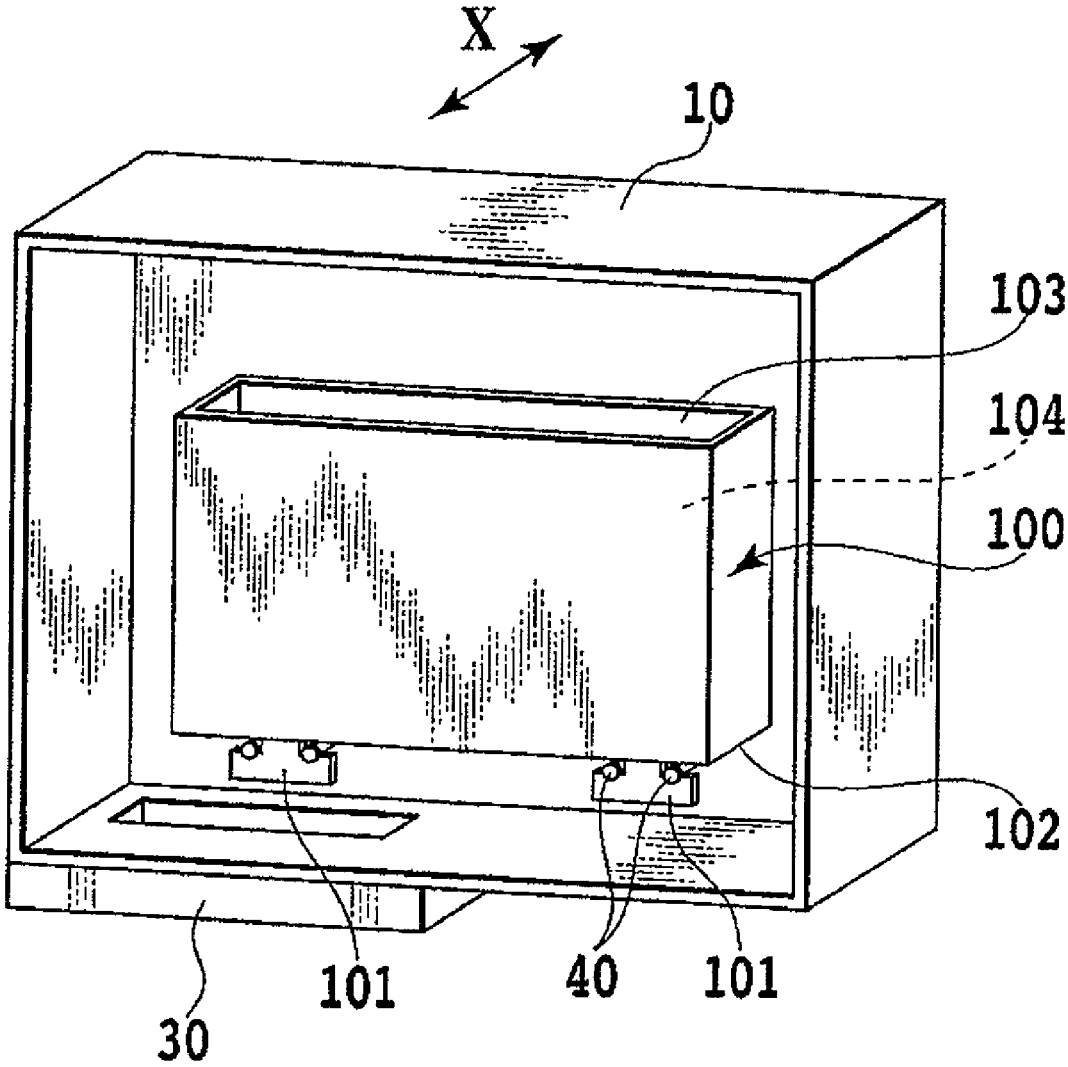
FIG. 14 is a perspective view of a swing member as a single body according to yet still another modification of the swing member in the first embodiment of the present invention.

As shown in FIG. 14, one swing member 100 may be provided. In this modification, two support portions 101 are symmetrically provided on left and right sides of FIG. 14 with respect to one swing member 100.

Figure 15:
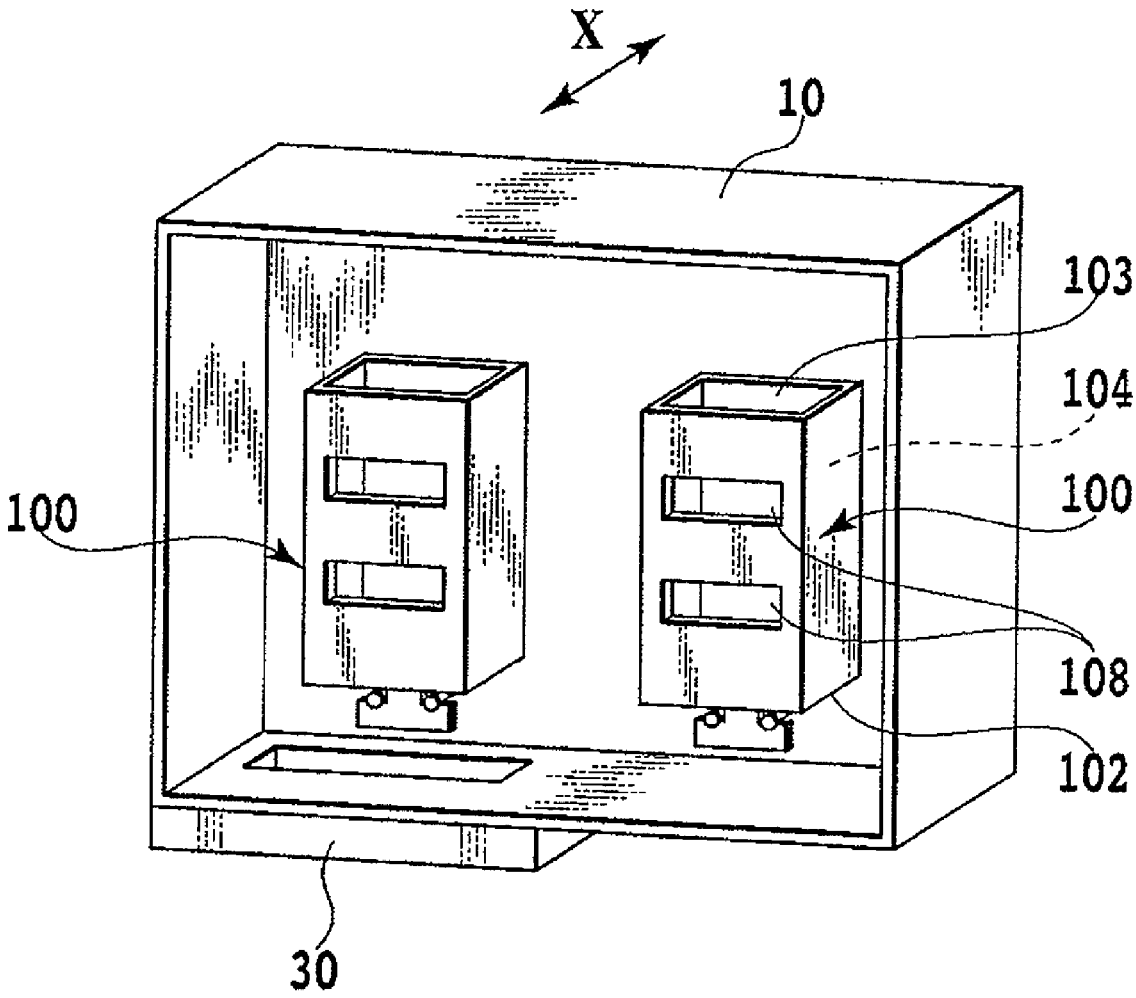
FIG. 15 is a perspective view of a swing member having a hollow portion, in which a plurality of openings are provided, according to yet still another modification of the swing member in the first embodiment of the present invention.

Further, as shown in FIG. 15, a swing member 100 may have one or a plurality of intermediate openings 108 that are provided between a lower opening 102 and an upper opening 103 to communicate with a hollow portion 104. In this modification, two intermediate openings 108 are provided to be vertically shifted in continuous portions where the openings 102 and 103 communicate with each other. Further, the intermediate openings 108 can function as the upper opening 103 when an ink residual quantity in the ink containing chamber 80 is decreased. In addition, the number of intermediate openings 108 and the shapes and positions of the intermediate openings 108 may be arbitrarily selected insofar as they communicate with the hollow portion 104. The intermediate openings can be optically set in consideration of the ink stirring effect in the ink containing chamber 80.

Figure 16A:
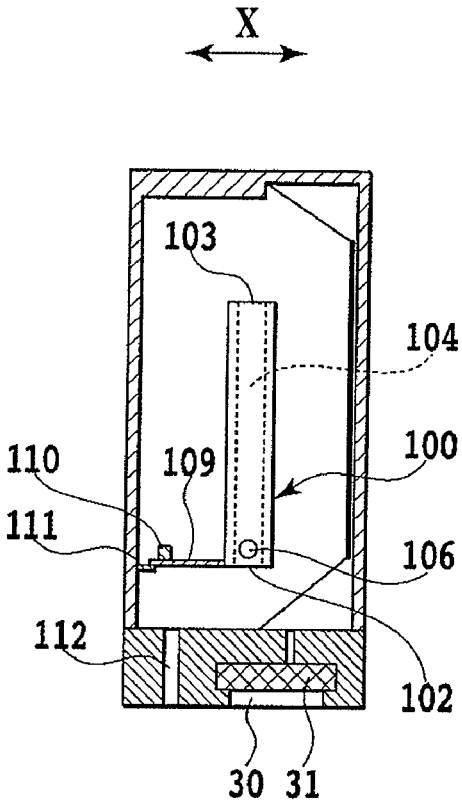
FIG. 16A is a cross-sectional view of an ink tank for illustrating an ink receiving portion-equipped swing member according to yet still another modification of the swing member in the first embodiment of the present invention.

A swing member 100 shown in FIG. 16A is swingably supported by a shaft 106 that extends in a horizontal direction. Further, a receiving member 109 that undergoes an ink flow Z is provided in the vicinity of a lower opening 102. In addition, a weight 110 is provided at a front end of the receiving member 109. The weight 110 and the lower opening 102 are disposed to face each other with the receiving member 109 interposed therebetween. In addition, a flow passage 112 is provided at the lower portion of the ink tank 1 to introduce the ink flow Z as a driving force of the swing member 100. A stopper 111 is fixed to an inner wall of the ink container case body 10. The flow passage 112 forms a liquid introduction port that can introduce ink from the outside toward the swing member 100.

Figure 16B:
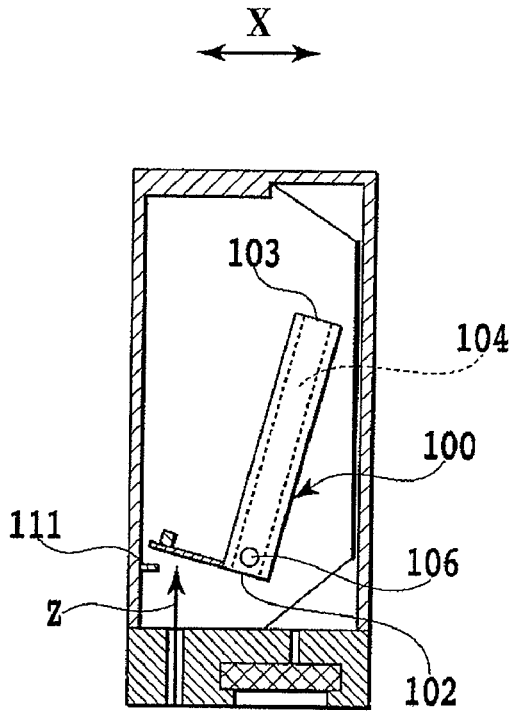
FIG. 16B is an explanatory view showing a state where an ink flow collides against the swing member.

FIG. 16A shows a state where the ink flow Z from the flow passage 112 is not generated and the swing member 100 is stopped. At this time, a force is applied to the swing member 100 downward in the gravity direction with the shaft 106 as a fulcrum due to the weight of the weight 110, and the receiving member 109 comes into contact with the stopper 111. FIG. 16B shows a state where the ink flow Z is generated from the ink flow passage 112 using a pump (not shown) and the swing member 100 swings. The receiving member 109 undergoes the ink flow Z and swings with the shaft 106 as a fulcrum, together with the swing member 100. Then, the upper opening 103 of the swing member 100 is displaced in a direction to come into contact with the plate member 60 in the ink containing chamber 80. Thereafter, if the ink flow Z stops, the state shown in FIG. 16A is returned by the weight of the weight 110.

As described above, in this modification, the swing member 100 is swung using the ink flow Z, and ink in the ink containing chamber 80 is stirred. Accordingly, the same effects as the above-described configuration can be obtained. High concentration ink and low concentration ink can be circulated in the ink tank by the ink flow generated in the hollow portion 104 of the swing member.

Further, in the ink tank 1 of the first embodiment that has the stirring mechanism of the modification, the volume of the ink containing chamber 80 is decreased as ink therein is consumed. However, the ink tank 1 is not limited to such a configuration. For example, an atmosphere communication hole may be provided in the ink tank 1, such that air flows into the ink containing chamber 80 as ink is consumed.

Second Embodiment

Next, a second embodiment of the present invention will be described. In this embodiment, the liquid container is an ink cartridge that is mountable on the above-described printing apparatus shown in FIGS. 1 to 3. In the ink tank of this embodiment, the volume of the ink containing chamber is not decreased even though ink is consumed. That is, the volume of the ink containing chamber is not decreased, but only the amount of ink in the ink containing chamber is decreased.

(Overall Configuration of Ink Tank)

Figure 17:
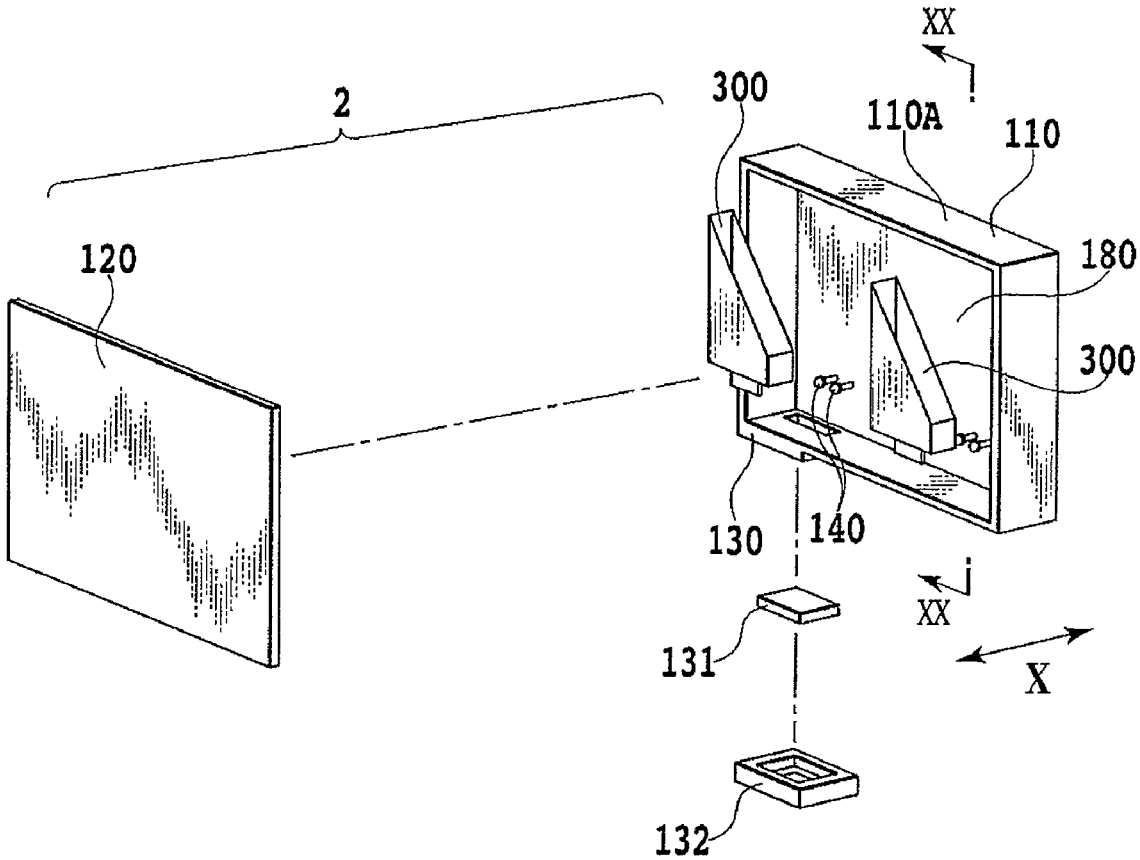
FIG. 17 is an exploded perspective view of an ink tank according to a second embodiment of the present invention.

FIG. 17 is an exploded perspective view of an ink tank 2 of this embodiment. The ink tank 2 is a container that has an ink containing chamber 180 therein. The ink tank 2 primarily includes an ink container case body 110 and a cover member 120. An ink supply port 130 is formed at the bottom of the ink tank 2 to supply ink to the printing head. Further, an atmosphere communicating port 110A is formed at the top of the ink tank 2. In the ink tank 2, when the ink containing chamber 180 needs to be kept at a negative pressure, a negative pressure generating mechanism (not shown) may be provided.

The ink container case body 110 is formed of, for example, polypropylene, and accommodates therein swing members 300 serving as stirring members for stirring ink. An opening of the ink container case body 110 is sealed by the cover member 120. Support portions 140 are provided at the inner wall of the ink container case body 110 to support the swing members 300. A meniscus forming member 131 is provided in the ink supply port 130. The meniscus forming member 131 is a capillary member formed of a textile material, such as polypropylene, to exert a capillary force or an absorbent as a combination of the capillary member and a filter member. The permeation size of the filter member is approximately 15 to 30 μm and the material thereof is a stainless material or polypropylene. The meniscus forming member 131 communicates with the inside of the ink container case body 110 by an ink flow passage, such that ink can be supplied from the ink containing chamber 180 in the ink container case body 110 to the printing head. Further, a meniscus is formed in the meniscus forming member 131 by ink to prevent air bubbles from entering the ink containing chamber 180 from the outside. The meniscus forming member 131 is pressed from the outside by a pressing member 32 and held. The atmosphere communicating port 110A is provided at the top of the ink containing chamber 180. As ink in the ink containing chamber 180 is consumed according to the supply to the printing head, the liquid level of ink in the ink containing chamber 180 is lowered.

(Configuration of Stirring Mechanism)

Figure 18:
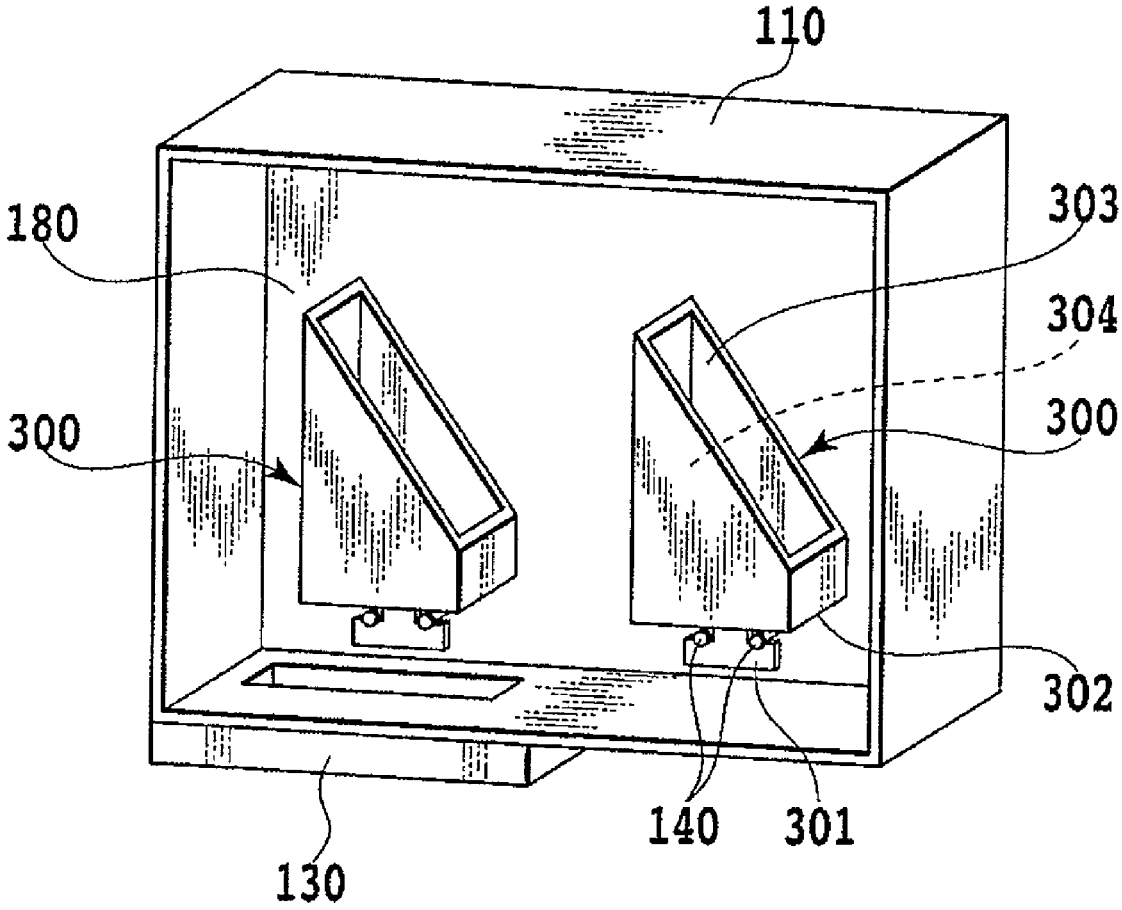
FIG. 18 is a perspective view of essential parts for illustrating an installment state of the swing member.
Figure 19:
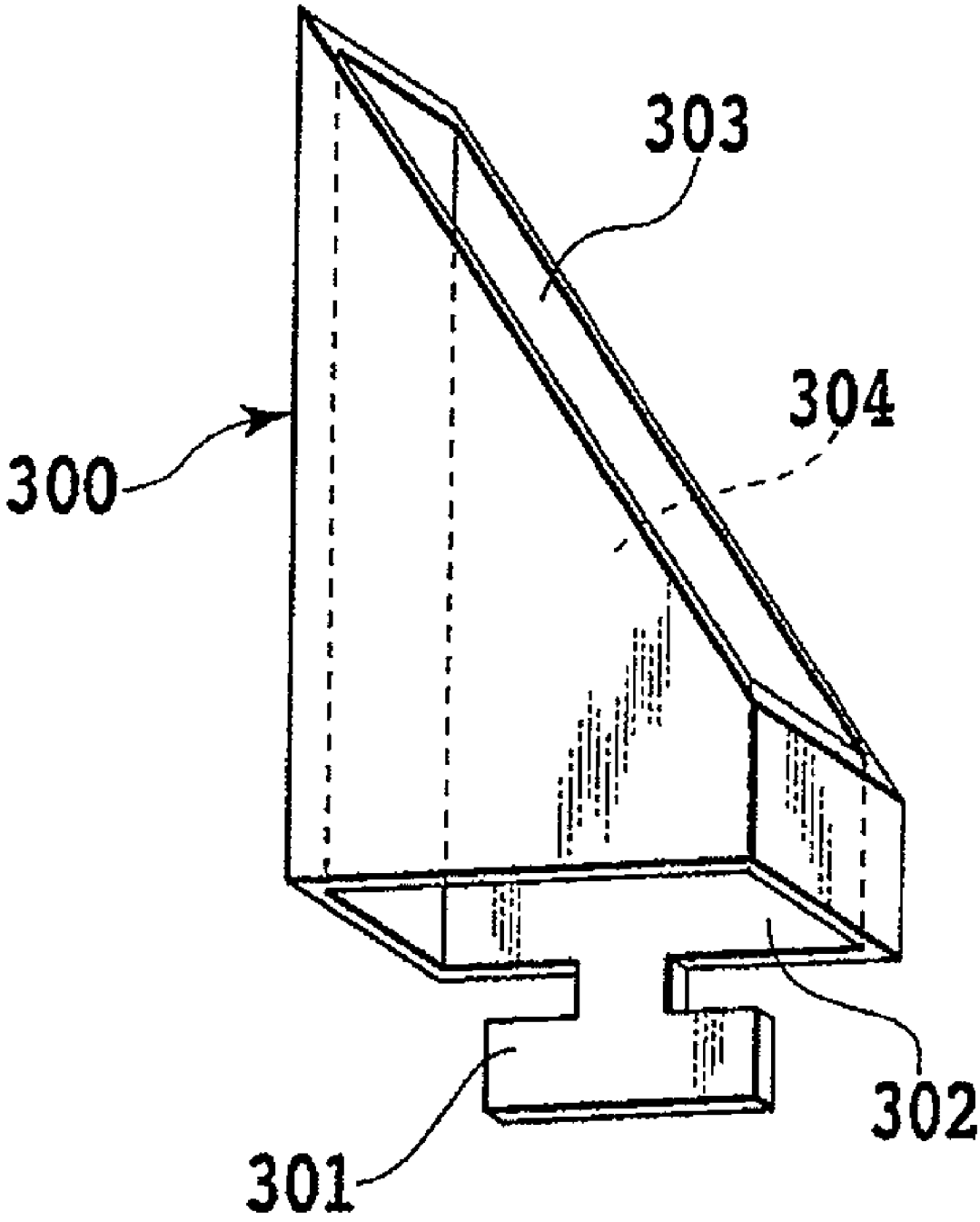
FIG. 19 is an enlarged perspective view of the swing member.

FIG. 18 is a perspective view illustrating an installment state of the swing members 300. FIG. 19 is an enlarge perspective view of the swing member 300.

Both sides of the support portion 301 of the swing member 300 are caught by the protrusions 140 that are formed at the inner wall of the ink container case body 110, such that the swing member 300 is supported. The protrusions 140 serve as a fulcrum when the swing member 300 swings. The swing member 300 is provided with a lower opening 302 that is located on a lower side of the ink container case body 110 in a gravity direction, and an upper opening 303 that is located above the lower opening 302. A hollow portion 304 is formed between the openings 302 and 303. The upper opening 303 is formed obliquely in the vertical direction with respect to the hollow portion 304 extending the up and down direction. As such, the swing member 300 is three-dimensionally molded to have the hollow portion 304 therein.

Figure 20C:
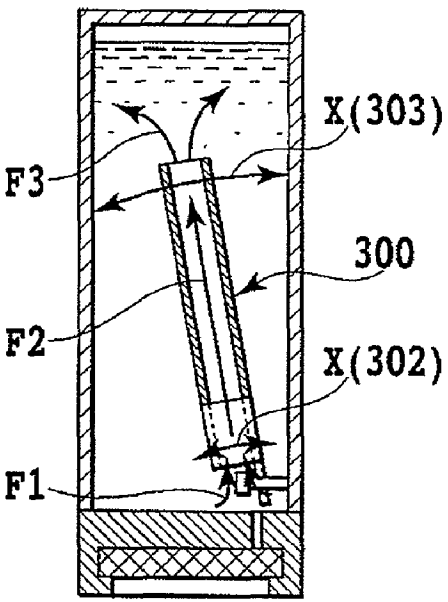
FIG. 20C is an explanatory view of the operation of the swing member.
Figure 20C:
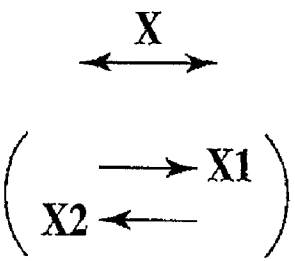

The swing member 300 of this embodiment is supported by the protrusions 140 through the support portion 301 that is provided in the vicinity of the lower opening 302. For this reason, as shown in FIG. 20C, when the swing member 300 swings, the displacement of the upper opening 303 becomes larger than that of the lower opening 302. Further, the swing member 300 is formed of a stainless material. However, the material for the swing member 300 is not limited thereto. Any material that has a specific gravity larger than ink contained in the ink containing chamber 180 may be used. The swing member 300 is configured such that, when ink is filled in the ink containing chamber 180, the openings 302 and 303 and the hollow portion 304 are submerged in ink.

(Operation and Action of Stirring Mechanism)

Figure 20B:
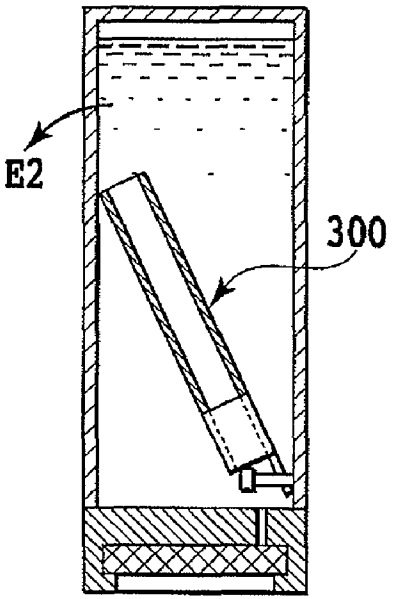
FIG. 20B is an explanatory view of the operation of the swing member when a carriage is reversed from an X1 direction to an X2 direction.
Figure 20B:
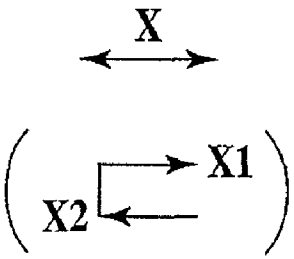
Figure 20A:
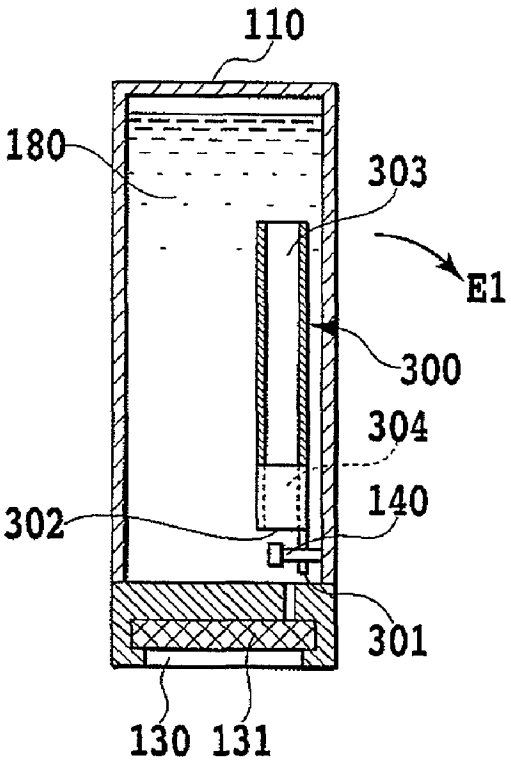
FIG. 20A is an explanatory view of the operation of the swing member when a carriage is reversed from an X2 direction to an X1 direction.
Figure 20A:
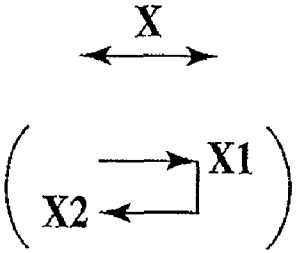

FIGS. 20A to 20C are side cross-sectional views of the ink cartridge 2 for illustrating the operation of the swing member 300 according to the second embodiment, which correspond to a cross-sectional view taken along the line XX-XX of FIG. 17.

FIG. 20A shows a first state of the swing member 300. The carriage M4001 reciprocates in the main scanning direction (the direction of the arrow X) within a range corresponding to the printing width of the printing medium. Accordingly, when the movement direction of the carriage M4001 is reversed, deceleration, stop, and acceleration in an opposite direction are performed. At that time, an inertial force is applied to the ink cartridge 2. When the inertial force is applied in a direction of an arrow X1 (hereinafter, simply referred to as 'X1 direction'), that is, when the movement direction of the carriage M4001 is reversed from the X1 direction to a direction of an arrow X2 (hereinafter, referred to as 'X2 direction), as shown in FIG. 20A, the swing member 300 rotates in a direction of an arrow E1 (hereinafter, simply referred to as 'E1 direction') with the support portion 301 as a fulcrum. At this time, the upper opening side of the swing member 300 is displaced to come into contact with the inner wall of the ink container case body 110, at which the protrusions 140 are provided. Here, the state where the inertial force is applied in the X1 direction in the above-described manner is referred to as the first state. After the movement direction of the carriage M4001 is reversed from the X1 direction to the X2 direction, when the carriage M4001 uniformly moves in the X2 direction, the inertial force is not applied, and the swing member 300 is kept in the first state.

FIG. 20B shows a second state of the swing member 300. Contrary to the first state, the second state is a state where the inertial force is applied in the X2 direction, that is, where the movement direction of the carriage M4001 is reversed from the X2 direction to the X1 direction. Then, as shown in FIG. 20B, the swing member 300 rotates in a direction of an arrow E2 (hereinafter, simply referred to as 'E2 direction') with the support portion 301 as a fulcrum. At this time, the upper opening side of the swing member 300 is displaced to come into contact with the cover member 120. Here, the state where the inertial force is applied in the X2 direction in the above-described manner is referred to as the second state. After the movement direction of the carriage M4001 is reversed from the X2 direction to the X1 direction, when the carriage M4001 uniformly moves in the X1 direction, the inertial force is not applied, and the swing member 300 is kept in the second state.

The carriage M4001 repeats reciprocation during the printing operation or the ink stirring operation, and thus the swing member 300 repeatedly becomes the first and second states of FIGS. 20A and 20B to thereby stir ink in the ink containing chamber 180.

FIG. 20C shows the displacement directions and displacements of the openings 302 and 303 and the ink flow when the swing member 300 swings.

As described above, the displacement X (303) of the upper opening 303 according to swing of the swing member 300 is larger than the displacement X (302) of the lower opening 302. When at least a part of the upper opening 303, the lower opening 302, and the hollow portion 304 are submerged in ink, ink flows F1, F2, and F3 from the lower opening 302 toward the upper opening 303 through the hollow portion 304 occur. With the ink flows, ink in the ink containing chamber 180 can be stirred.

Figures 21A, 21B, 21C:
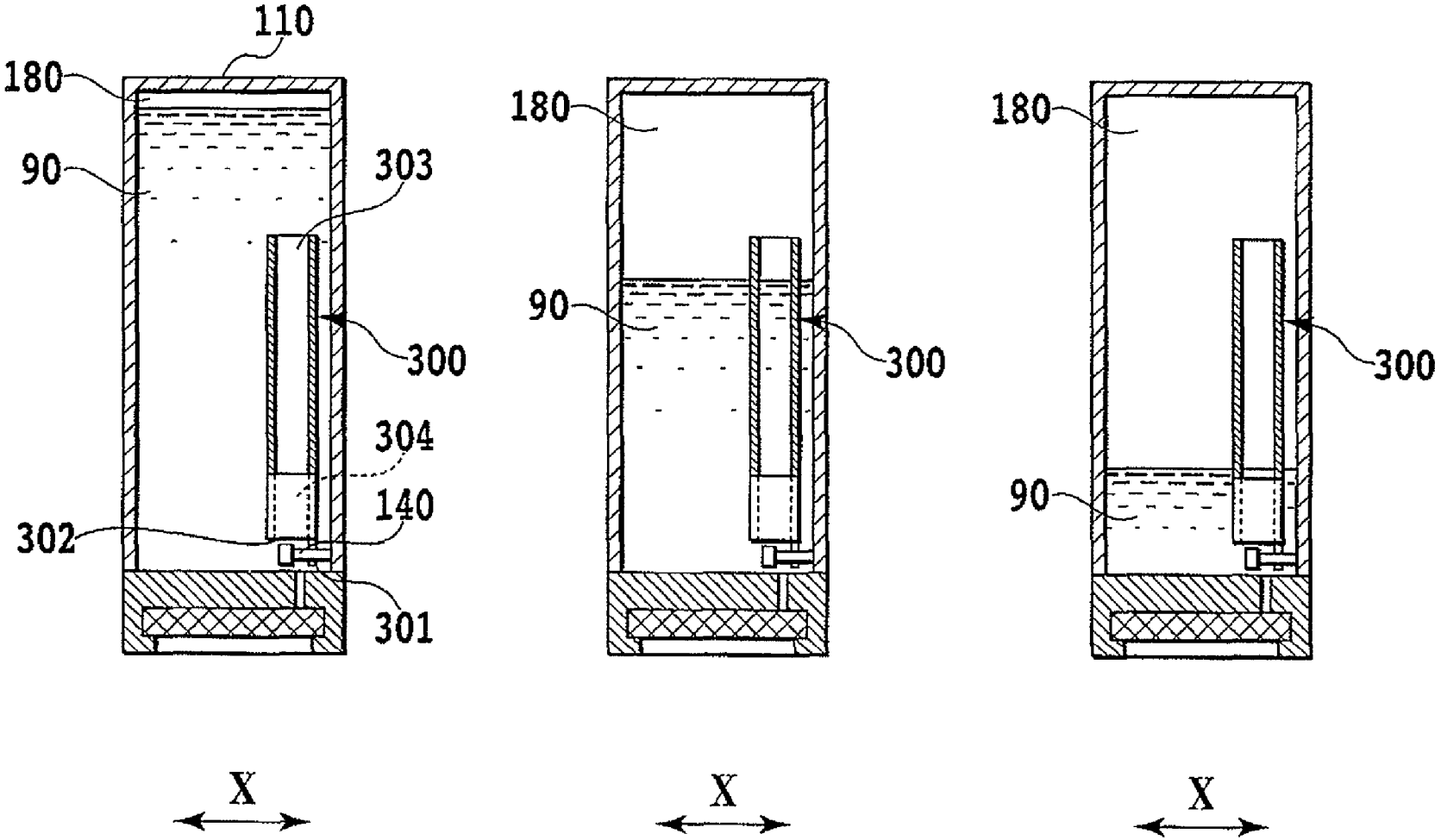
FIG. 21A is a cross-sectional view of an ink tank when the swing member is submerged in ink.
FIG. 21B is a cross-sectional view of an ink tank when a part of an opening of the swing member is submerged in ink.
FIG. 21C is a cross-sectional view of an ink tank when the amount of ink decreases and a part of an opening of the swing member is submerged in ink.

In this embodiment, the upper opening 303 is formed obliquely in the vertical direction with respect to the hollow portion 304 extending in the up and down direction. In FIG. 21A, the entire upper opening 303 is submerged in ink 90 in the ink containing chamber 180. However, the entire upper opening 303 is not necessarily submerged in ink 90. As shown in FIGS. 21B and 21C, if at least a part of the upper opening 303 is submerged in ink 90, the above-described stirring effect can be exhibited. This is useful for the ink container case body 110 having the configuration in which the liquid level of ink 90 in the ink containing chamber 180 is lowered as ink 90 is consumed.

Figure 22:
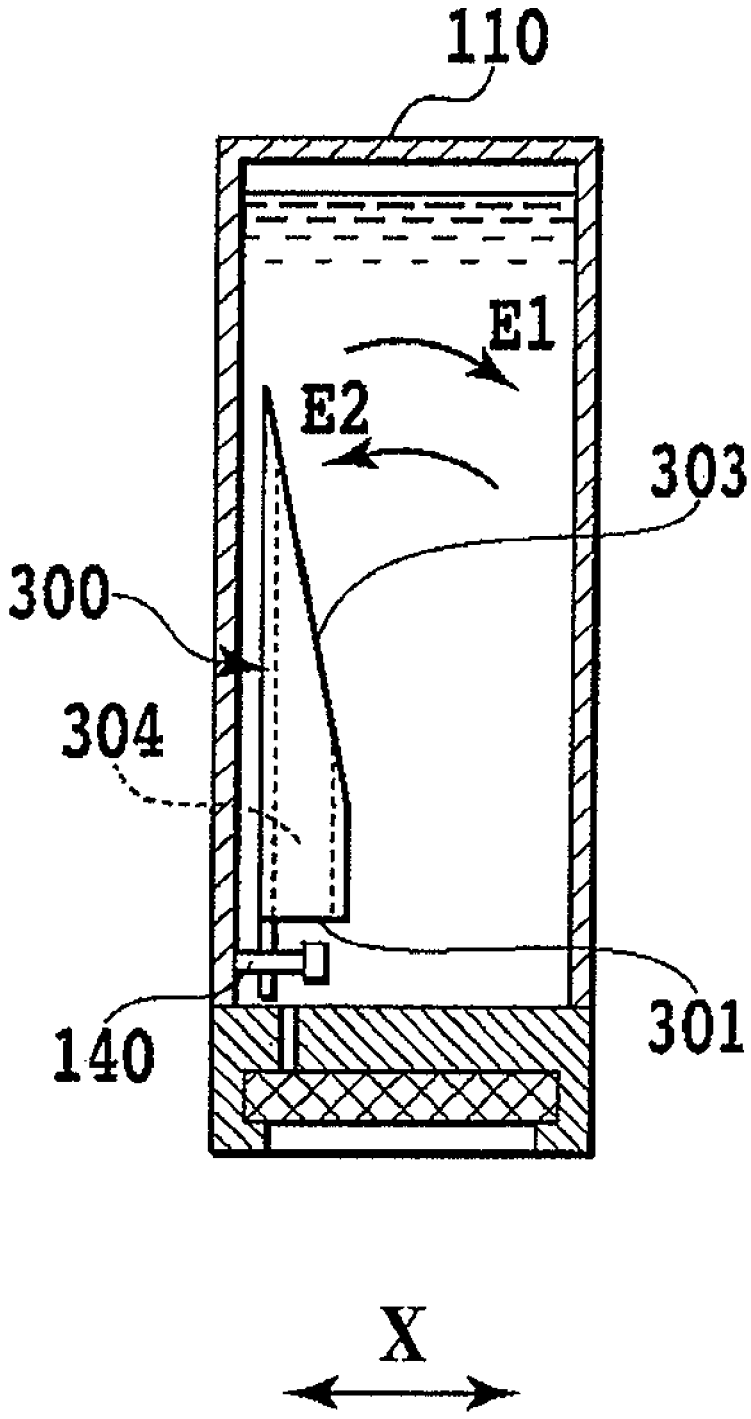
FIG. 22 is a cross-sectional view of an ink tank for illustrating a swing member having an oblique opening according to a modification of the swing member in the second embodiment of the present invention.

Further, as shown in FIG. 22, the upper opening 303 of the swing member 300 may be formed obliquely with respect to a surface facing the swing direction of the swing member 300.

Third Embodiment

Next, a third embodiment of the present invention will be described.

Figure 23:
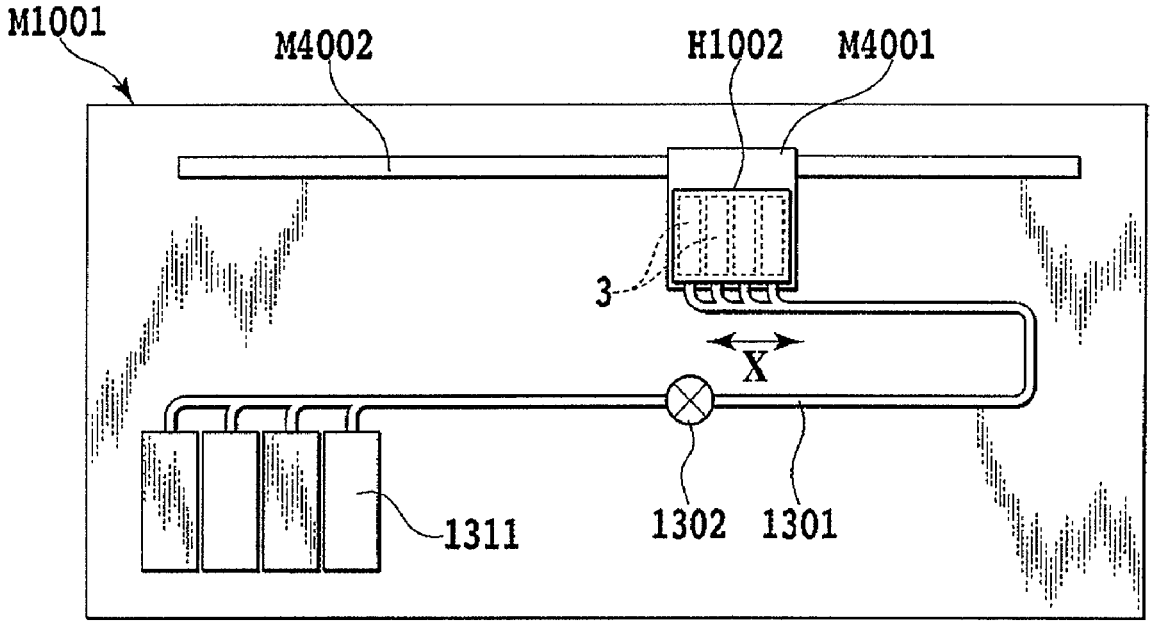
FIG. 23 is a schematic view showing the configuration of a printing apparatus according to a third embodiment of the present invention.
Figure 24:
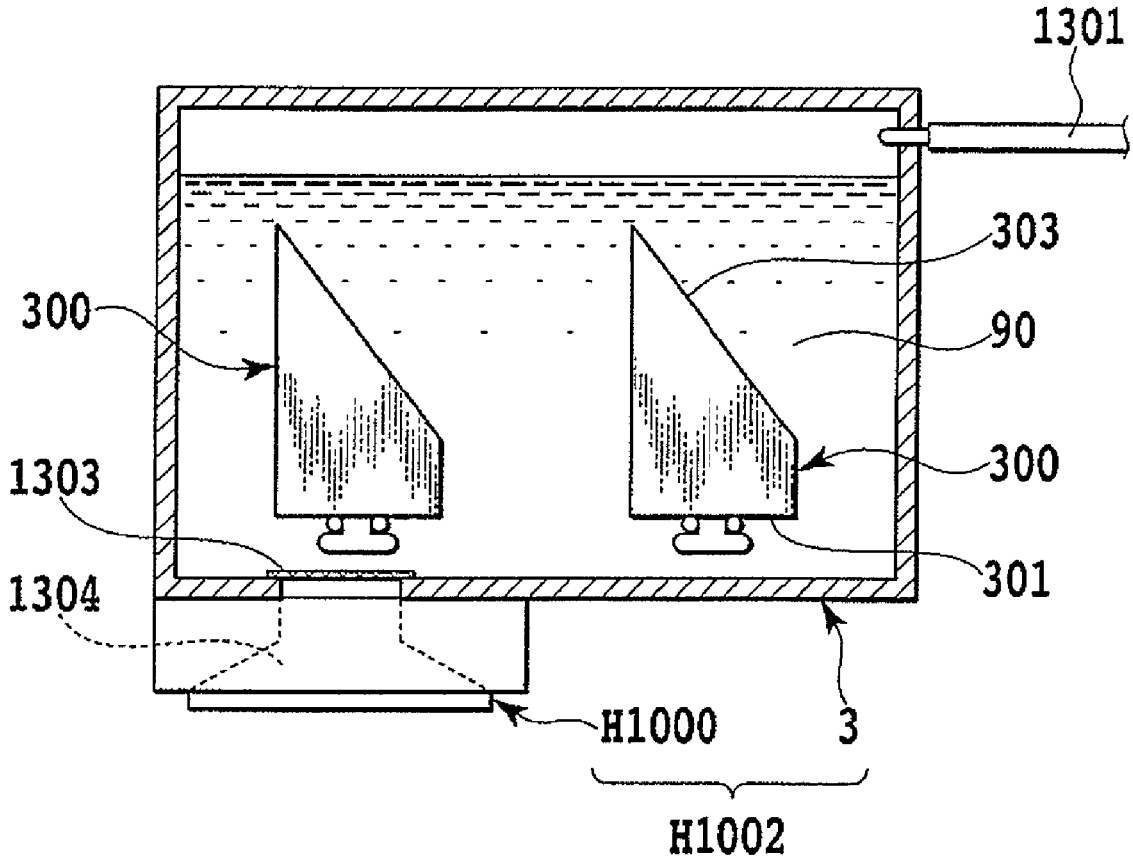
FIG. 24 is a cross-sectional view of a head cartridge shown in FIG. 23.

In this embodiment, as shown in FIG. 23, in an ink jet printing apparatus M1001, a printing head cartridge H1002 is detachably mounted on a carriage M4001 that can reciprocate in the main scanning direction (the direction of the arrow X) along a shaft M4002. The printing head cartridge H1002 has the configuration in which a sub tank (liquid container) 3 and a printing head H1000 are formed as a single body. As shown in FIG. 24, similarly to the ink tank 1 of the second embodiment described above, a swing member 300 is provided in the sub tank 3. Ink 90 in the sub tank 3 is supplied to a printing chip forming the printing head H1000 through a filter 1303 and an ink flow passage 1304 and ejected from an ejection port of the printing head H1000.

A tube 1301 is connected between the sub tank 3 and a main tank 1311 that is provided outside the carriage M4001. Ink 90 is contained in the main tank 1311, and is then supplied to the sub tank 3 by a pump 1302. Accordingly, ink 90 in the main tank 1311 enters the sub tank 3 and then is supplied to the printing head H1000.

During the image printing operation, similarly to the serial scan type printing apparatus of the above-described embodiment, the printing head H1000 repeatedly performs an operation to eject ink while moving in the main scanning direction together with the carriage M4001 and an operation to transport the printing medium in the sub scanning direction.

Similarly to the above-described embodiment, when the printing apparatus is left unused for a long time, the pigment particles of ink 90 in the sub tank 3 are likely to settle at the lower layer of the sub tank 3. Similarly to the second embodiment described above, since the swing member 300 is supported at the inner wall of the sub tank 3, the swing member 300 can be swung by an inertial force according to reciprocation of the carriage M4001 (a front and back direction in FIG. 24). As a result, similarly to the second embodiment described above, an ink flow is generated in the hollow portion of the swing member, such that ink 90 in the sub tank 3 can be uniformly stirred.

In this embodiment, if at least a part of the upper opening 303 is submerged in ink 90, the stirring effect can be exhibited. This is useful for the sub tank 3 having the configuration in which the liquid level of ink 90 in the ink tank is lowered as ink 90 is consumed, like this embodiment.

Fourth Embodiment

Next, a fourth embodiment of the present invention will be described. In this embodiment, a liquid container is an ink tank that is mountable on the above-described printing apparatus of FIGS. 1 to 3.

(Overall Configuration of Ink Tank)

Figure 25:
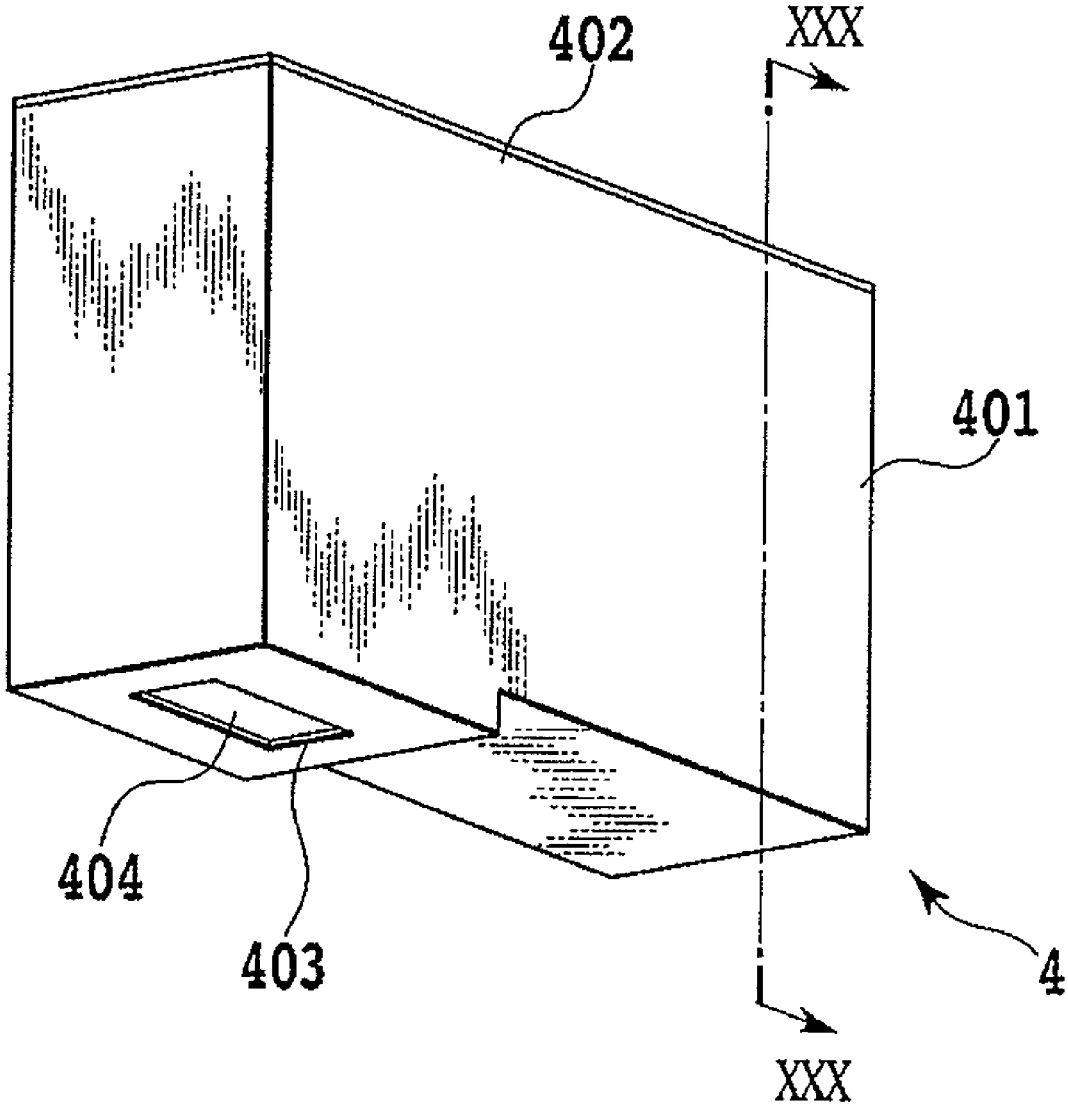
FIG. 25 is a perspective view of an ink tank according to a fourth embodiment of the present invention.

FIG. 25 is an exterior perspective view of an ink tank 4. The ink tank 4 is a container that includes an ink containing chamber therein. The ink tank 4 primarily has an ink container case body 401 and a cover member 402. An ink supply port 403 is provided at the bottom of the ink tank 4 to supply ink to the printing head H1000.

Figure 26:
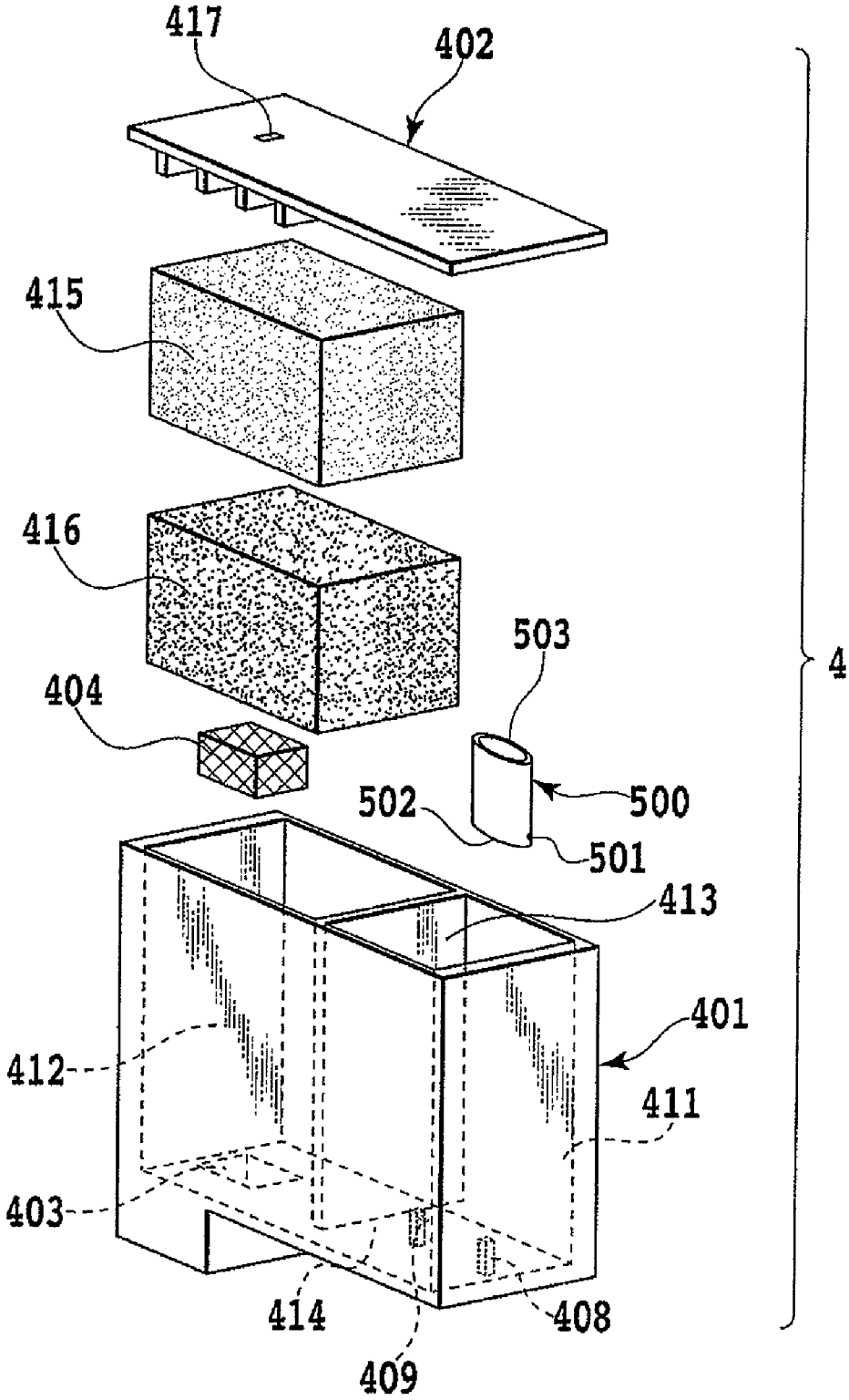
FIG. 26 is an exploded perspective view of the ink tank.

FIG. 26 is an exploded perspective view of the ink tank 4. An ink container case body 401 of the ink tank 4 is formed of, for example, polypropylene. Inside the ink container case body 401 is accommodated a swing member 500 for stirring ink. An opening of the ink container case body 401 is sealed by the cover member 402. The inside of the ink container case body 401 is divided into two spaces by a partition wall 413. A communicating portion 414 that communicates the two spaces with each other is formed below the partition wall 413. One of the two spaces forms an ink containing chamber 411 and is kept airtight excluding the communicating portion 414. Further, the other space forms a negative pressure generating chamber 412. In a portion of the cover member 402 facing the negative pressure generating chamber 412, an atmosphere communicating port 417 is formed to introduce atmosphere as ink is consumed. In a portion of the ink container case body 401 facing the negative pressure generating chamber 412, a supply port 403 is formed to supply ink to the printing head H1000. A meniscus forming member 404 is provided in the supply port 403 to hold ink. A meniscus is formed in the meniscus forming member 404 so as to prevent air bubbles from entering the ink container case body 401 from the outside.

Inside the negative pressure generating chamber 412 are accommodated first and second negative pressure generating members 415 and 416 formed of a textile material, such as polypropylene, to have a capillary force. In the negative pressure generating chamber 412, the negative pressure generating members 415 and 416 are accommodated to be pressed into contact with each other. The negative pressure generating members 415 and 416 may be an absorbent that includes various porous materials or fibrous materials to absorb ink. When a capillary force of the first negative pressure generating member 415 is P1, a capillary force of the second negative pressure generating member 416 is P2, and a capillary force of the meniscus forming member 404 is P3, the relationship P1<P2<P3 is established.

According to this configuration, if ink in the negative pressure generating chamber 412 is consumed by the printing head, air is introduced into the negative pressure generating chamber 412 from the atmosphere communicating port 417 and then enters the ink containing chamber 411 through the communicating portion 414. While air is introduced into the ink containing chamber 411, ink is filled in the negative pressure generating members 415 and 416 of the negative pressure generating chamber 412 from the ink containing chamber 411 through the communicating portion 414. In such a manner, air and ink are replaced with each other through the communicating portion 414.

(Configuration of Stirring Mechanism)

Figure 27:
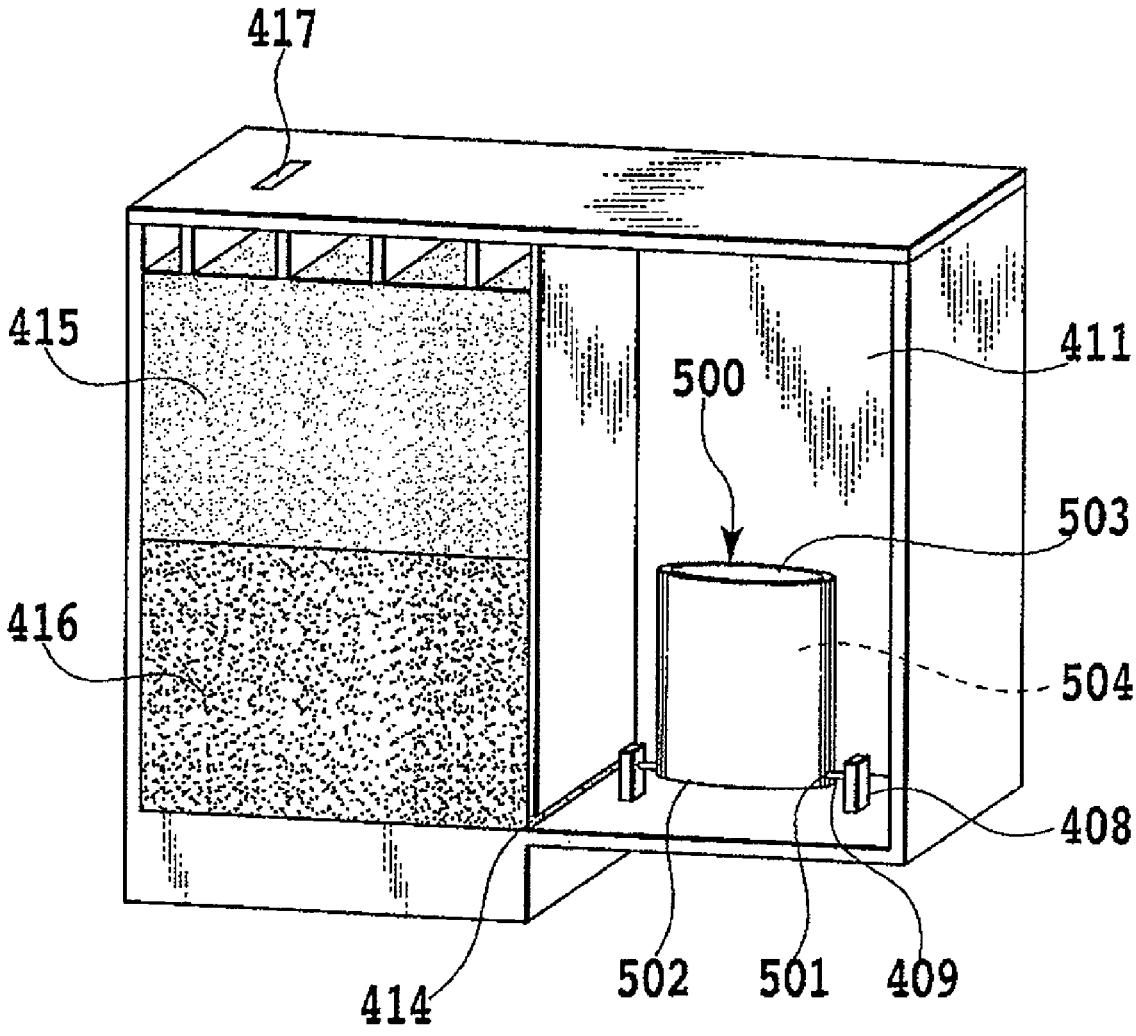
FIG. 27 is a perspective view of the inside of the ink tank.
Figure 28:
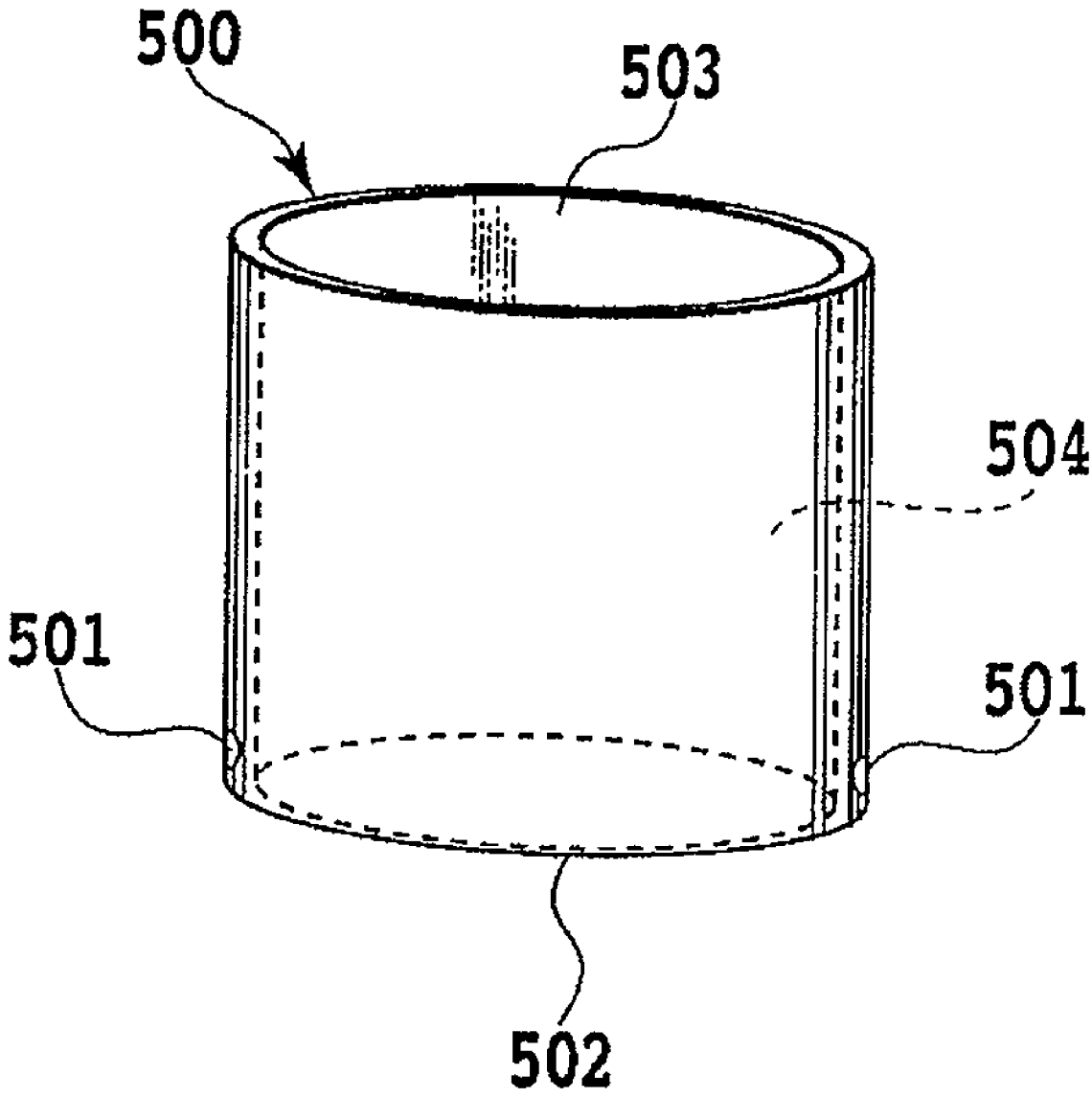
FIG. 28 is an enlarged perspective view of a swing member shown in FIG. 27.

FIG. 27 is a perspective view illustrating an installment state of the swing member 500. FIG. 28 is an enlarged perspective view of the swing member 500.

The swing member 500 is provided with a lower opening 502 that is located on a lower side of the ink container case body 401 in a gravity direction and an upper opening 503 that is located above the lower opening 502. A cylindrical hollow portion 504 having an elliptical shape in section is formed between the openings 502 and 503. Further, concave support portions 501 are provided at two places positioned on a major axis of the elliptical shape in the vicinity of the lower opening 502.

In this embodiment, the swing member 500 is formed of a stainless material, and the hollow portion 504 is hydrophilized, for example, by sandblasting, such that air bubbles in ink do not remain in the hollow portion 504. The material for the swing member 500 is not limited thereto. For example, a material having a specific gravity larger than ink contained in the ink containing chamber 411 is preferably used. The shape of the hollow portion 504 is not limited to the ellipse. For example, a circular shape or an angular shape may be used. Further, the shape of each of the support portions 501 may be a concave shape or a shape formed to pass through the swing member 500. In addition, the support portions 501 may not be provided at places positioned on the major axis of the elliptical shape in the vicinity of the opening 502.

As shown in FIG. 27, fixed members 408 having engaging protrusions are provided at the inner wall of the ink containing chamber 411. The engaging protrusions 409 engage with the support portions 501 of the swing member 500, thereby the support portions 501 serve as a fulcrum when the swing member 500 swings. The swing member 500 can be swung with the support portions 501 serving as a fulcrum. In the swing member 500 of this embodiment, the support portions 501 are supported in the vicinity of the lower opening 502. Accordingly, when the swing member 500 swings, the displacement of the upper opening 503 becomes larger than that of the lower opening 502, and the movement speed thereof becomes higher.

(Ink Filling Method)

A method of filling ink in the ink tank will now be described.

First, ink is injected into the ink containing chamber 411 to a position where ink comes into contact with the swing member 500. After ink comes into contact with the swing member 500, ink is slowly injected, such that ink is injected into the hollow portion 504 ahead along the hydrophilized inner wall of the swing member 500. Thereafter, ink is filled into the ink containing chamber 411 along the wall surface of the ink containing chamber 411. An ink filling method is not limited to the above-described method. For example, the lower opening 502 of the swing member 500 is first covered with a film, then ink is filled in the hollow portion 504, and subsequently the upper opening 503 is covered with a film. Next, after ink is injected into the ink containing chamber 401 in which the swing member 500 filled with ink is positioned, ink may be filled in the entire ink containing chamber 411 by tearing the film of the lower opening 502 and the film of the upper opening 503. If ink is filled in the ink containing chamber 411, the openings 502 and 503 and the hollow portion 504 of the swing member 500 are submerged in ink.

As such, filling of ink in the hollow portion 504 of the swing member 500 and filling of ink in the ink containing chamber 411 are dividedly performed, and thus ink can be filled such that air bubbles do not remain in the hollow portion 504.

(Operation and Action of Stirring Mechanism)

FIGS. 29A to 29D are schematic views showing essential parts of the printing apparatus for illustrating the operation of the carriage shown in FIG. 2. FIGS. 30A to 30H are explanatory views of the operations of the swing member 500 and ink flows to be generated in the hollow portion 504 of the swing member 500 in this embodiment. FIGS. 30A to 30H show examples where high concentration ink settled at the bottom of the ink tank is stirred. Further, FIGS. 30A to 30H correspond to a cross-sectional view taken along the line XXX-XXX of FIG. 25.

First, the operation of the carriage M4001, on which the ink tank 4 serving as a liquid container is mounted, will be described with reference to FIGS. 29A to 29D.

Figure 29A:
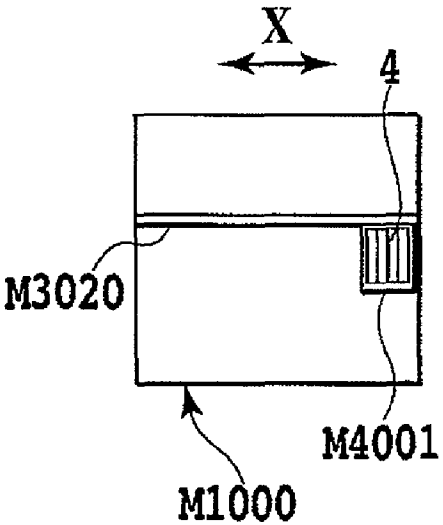
FIG. 29A is an explanatory view showing a state where a carriage shown in FIG. 23 is located at a home position.
Figure 29B:
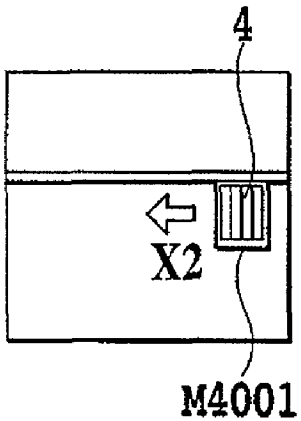
FIG. 29B is an explanatory view showing a state where the carriage moves in an X2 direction.
Figure 29C:
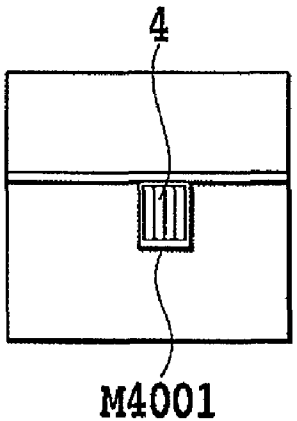
FIG. 29C is an explanatory view showing a state where the carriage moves at a necessary distance.
Figure 29D:
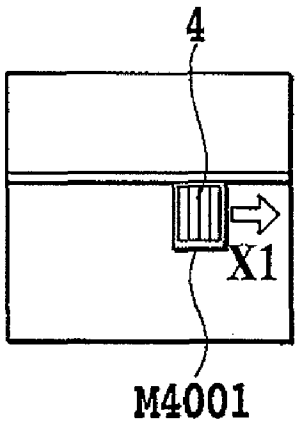
FIG. 29D is an explanatory view showing a state where the carriage moves in an X1 direction.

The carriage M4001 moves from a home position shown in FIG. 29A in the X2 direction along a carriage shaft M3020, which is provided in the chassis of the printing apparatus M1000 (see FIG. 29B). Then, the carriage M4001 is moved by a distance corresponding to the printing width of the printing medium or a distance required for operating the swing member 500 and positioned as shown in FIG. 29C. Next, the movement direction of the carriage M4001 is reversed from that position and is then moved in the X1 direction (see FIG. 29D). Next, the movement direction of the carriage M4001 is reversed from the position shown in FIG. 29A again. Thereafter, reciprocation in the direction of the arrow X is repeated by the number of times required for printing. When the movement direction of the carriage M4001 is reversed, deceleration, stop, and acceleration in an opposite direction are repeatedly performed. As described above, in this embodiment, before reciprocation of the carriage M4001 for printing operation, the carriage M4001 reciprocates at least one time, as shown in FIGS. 29B to 29D. Accordingly, as described below, ink can be stirred before the printing operation.

Next, the operation of the swing member 500 in the ink tank 4 according to reciprocation of the carriage M4001 will be described with reference to FIGS. 30A to 30H. The ink containing chamber 411 shown in these drawings is filled with ink.

Figure 30A:
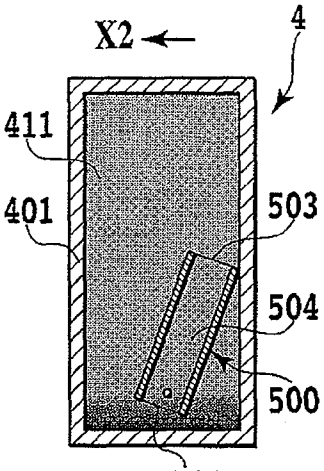
FIG. 30A is an explanatory view of a swing member when the carriage is located at a home position.

FIG. 30A shows a state where the carriage M4001 stands still at the home position as shown in FIG. 29A, and the swing member 500 stands still such that the upper opening side comes into contact with the inner wall of the ink containing chamber 411. This state is kept until the carriage M4001 starts to move from the position of FIG. 29A and uniformly moves in the X2 direction as shown in FIG. 29B.

Figure 30B:
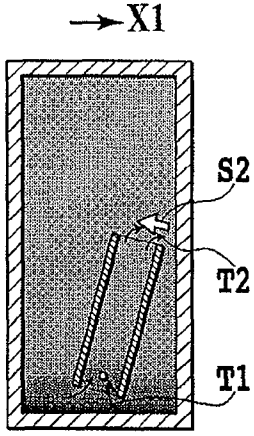
FIG. 30B is an explanatory view showing a state where ink flows out from an upper opening of the swing member.
Figure 30C:
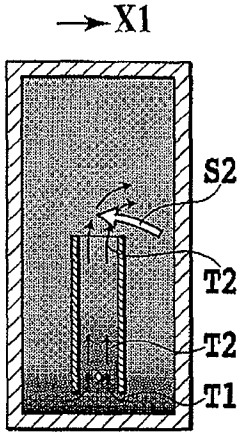
FIG. 30C is an explanatory view showing a state where the swing member moves in one direction and an ink flow is accelerated.
Figure 30D:
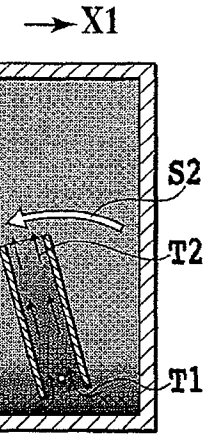
FIG. 30D is an explanatory view showing a state where the swing member moves in one direction.
Figure 30E:
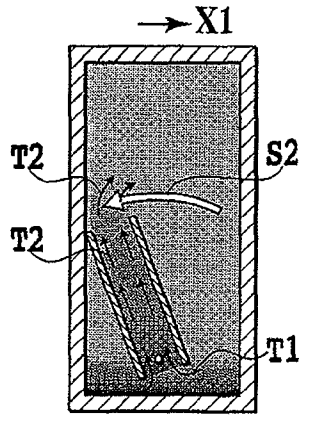
FIG. 30E is an explanatory view showing a state where the movement of the swing member in one direction is stopped.

FIGS. 30B to 30E show a state where the movement direction of the carriage M4001 is reversed from the X2 direction to the X1 direction after the carriage M4001 reaches the position of FIG. 29C or the carriage M4001 moves in the X1 direction after the movement direction is reversed as shown in FIG. 29D. When the movement direction of the carriage M4001 is reversed, the inertial force is applied to the ink tank 4. When the inertial force is applied in the X2 direction, that is, when the movement direction of the carriage M4001 is reversed from the X2 direction to the X1 direction, the swing member 500 swings in a direction of an arrow S2 (hereinafter, simply referred to as 'S2 direction') with the support portions 501 as a fulcrum in an order of FIGS. 30B to 30E. Then, as shown in FIG. 30E, the upper opening side of the swing member 500 comes into contact with an opposing inner wall of the ink containing chamber 411 (an inner wall opposite to the inner wall, with which the upper opening 503 comes into contact, in FIG. 30A), and thus swing of the swing member 500 in the S2 direction stops. The swing member 500 is kept in the state shown in FIG. 30E until the carriage M4001 starts to move from the position of FIG. 29C and then uniformly moves in the X2 direction as shown in FIG. 29D.

Figure 30F:
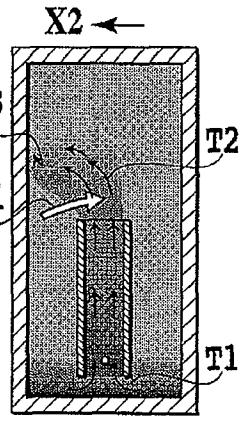
FIG. 30F is an explanatory view showing a state where a carriage moves and a pigment component is dispersed.
Figure 30G:
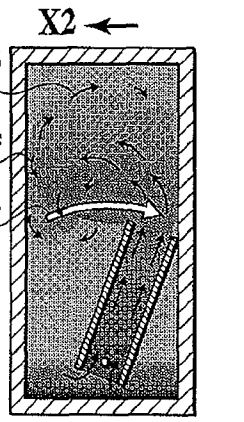
FIG. 30G is an explanatory view showing a state where ink is stirred by the swing member.
Figure 30H:
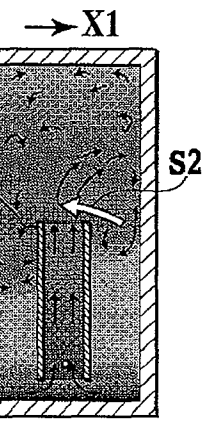
FIG. 30H is an explanatory view showing a state where ink is stirred by the swing member.

FIGS. 30F and 30G show a state where the carriage M4001 moves in the X1 direction, then reaches the position of FIG. 29A, and subsequently is reversed in the X2 direction, or the movement direction of the carriage M4001 is reversed and then moves in the X2 direction, as shown in FIG. 29B. If the inertial force to be generated when the movement direction of the carriage M4001 is reversed is applied in the X1 direction, the swing member 500 swings in a direction of an arrow S1 (hereinafter, simply referred to as 'S1 direction') with the support portions 501 as a fulcrum in an order of FIGS. 30F and 30G. Thereafter, if the carriage M4001 moves in the X1 direction again, as shown in FIG. 30H, the swing member 500 swings in the S2 direction.

While the carriage M4001 repeats reciprocation, the swing member 500 repeats reciprocation as described above.

Next, the ink flows to be generated in the hollow portion 504 of the swing member 500 according to reciprocation of the swing member 500 and an example where ink is stirred will be described with reference to FIGS. 30A to 30H.

If the swing member 500 starts to swing in the S2 direction, a flow T2 of ink in the hollow portion 504 that flows out from the upper opening 503 is generated by a centrifugal force generated when the swing member 500 swings, as shown in FIG. 30B. Simultaneously, a flow T1 of ink at the bottom of the ink tank around the lower opening 502 that flows into the hollow portion 504 is generated. If the swing member 500 continues to swing, ink flows in the hollow portion 504 and then flows out from the upper opening 503 by a centrifugal force applied to ink in the hollow portion 504, as shown in FIGS. 30B to 30D.

As shown in FIG. 30E, if swing of the swing member 500 in the S2 direction is stopped, an inertial force generated when swing of the swing member 500 is stopped is applied to ink in the hollow portion 504, and thus the flow of ink in the hollow portion 504 is accelerated. Ink that passes through the hollow portion 504 flows out from the upper opening 503, forms a flow T3 shown in FIGS. 30F and 30G, and is dispersed in low concentration ink. Further, ink in the ink containing chamber 411 is stirred by a flow T4 of ink rebounding from the inner wall of the ink containing chamber 411.

High concentration ink that flows out from the upper opening 503 settles down to the position of the swing member 500 by the flows T2, T3, and T4 and gravity. Then, as shown in FIG. 30H, a mechanical flow T5 is generated between the outer wall of the swing member 500 and the inner wall of the ink containing chamber 411 by relative proximity and separation displacement therebetween according to swing of the swing member 500. With the flow T5, ink in the ink containing chamber 411 is further stirred.

The above-described operation is performed once or several times, and thus ink in the ink containing chamber 411 is raised from the lower layer to the upper layer by the flows T1 to T5 and then stirred. As a result, ink in the entire ink containing chamber 411 including ink at the upper layer of the ink containing chamber 411 can be uniformly stirred.

Preferably, swing of the swing member 500 is continuously performed. With continuous swing, a propulsive force to raise ink toward the upper portion of the ink containing chamber 411 can be increased. That is, a pumping effect that generates the flow T2 of ink in the hollow portion 504 can be increased.

In this embodiment, stirring is performed while the swing direction of the swing member 500 is reversed. However, the swing direction of the swing member is not necessarily reversed. What is necessary is that a propulsive force enough to raise the pigment particles at the bottom of the ink containing chamber to the upper portion of the container through the hollow portion of the swing member by the inertial force is applied. Further, after the swing member swings in one direction, the swing member may be stopped. In addition, even though ink in the ink containing chamber 411 is decreased and the liquid level is lowered, the above-described ink stirring effect can be obtained insofar as the hollow portion 504 of the swing member 500 is submerged in ink.

Further, an swing angle between a state where the swing member 500 stands upright as shown in FIGS. 30A, 30F, and 30H and a state where the swing member 500 is inclined as shown in FIGS. 30A, 30E, and 30G needs to be set in consideration of the movement condition of the carriage or the shape of the swing member 500. When the swing angle is large, for example, near 90°, the swing member 500 may not swing and may be kept in an inclined state. Therefore, the swing angle of the swing member 500 needs to be taken into account such that the swing member 500 can reciprocate by reciprocation of the carriage and the ink tank 4. In order to make the swing member 50 reciprocate, movement of the carriage according to the printing operation may be used, or movement of the carriage according to the stirring operation to stir ink in the ink tank may be used separately from the printing operation. The printing apparatus may include a stirring mode for performing the stirring operation. In this case, the printing apparatus counts an elapsed time from when ink ejection from the printing head is stopped. When the counted time exceeds a predetermined time, the printing apparatus may enter the stirring mode. In the stirring mode, the carriage on which the ink tank is mounted is moved in the X direction. The moving width or moving speed of the carriage can be arbitrarily selected according to the counted time. Further, a specific timing, for example, before printing by the printing apparatus, may be set and the stirring mode may start at that timing.

Fifth Embodiment

Next, a fifth embodiment of the present invention will be described. In this embodiment, a liquid container is an ink tank that is mountable on the above-described printing apparatus shown in FIGS. 1 to 3.

(Overall Configuration of Ink Tank)

Figure 31:
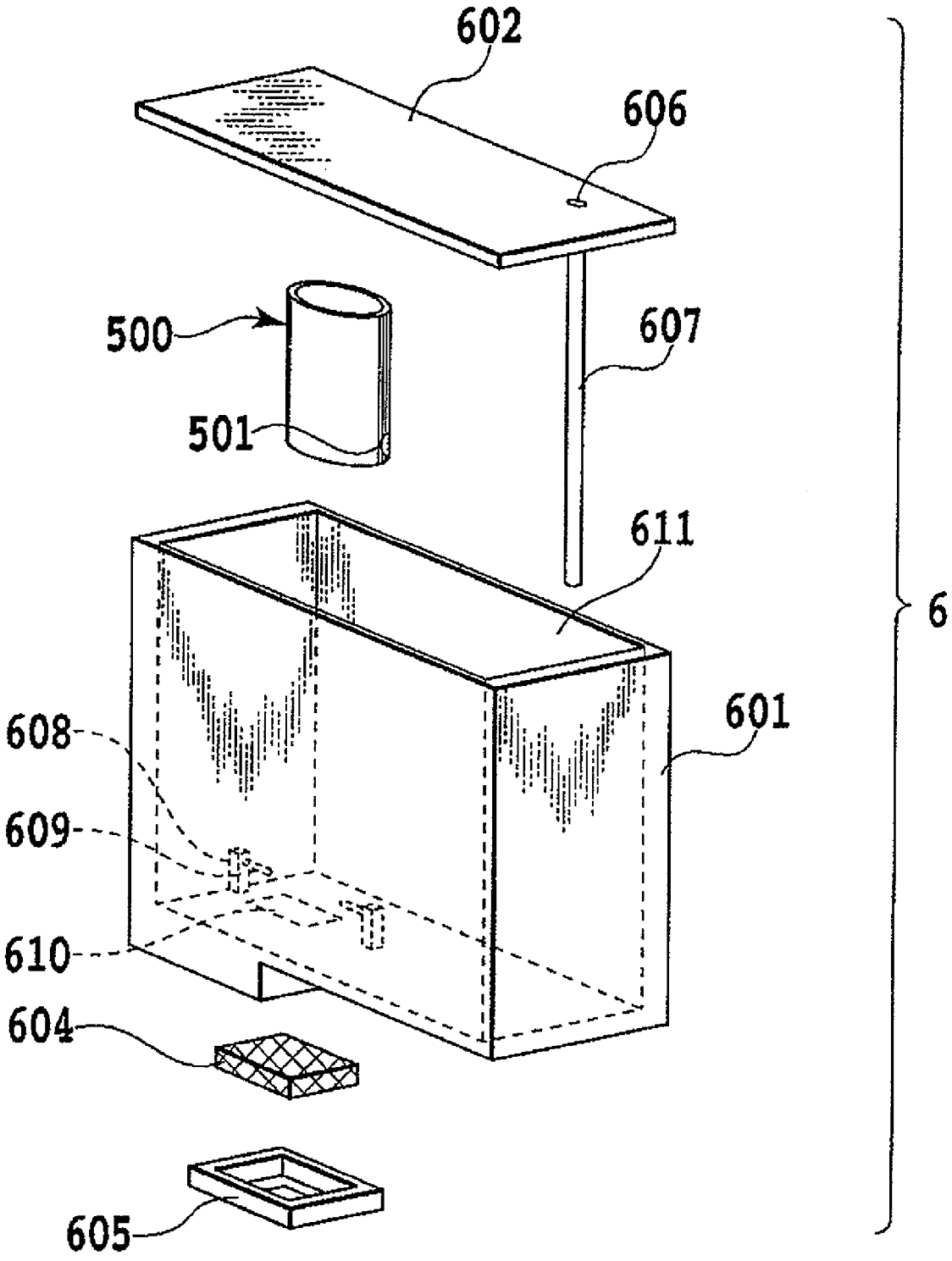
FIG. 31 is an exploded perspective view of an ink tank according to a fifth embodiment of the present invention.
Figure 32:
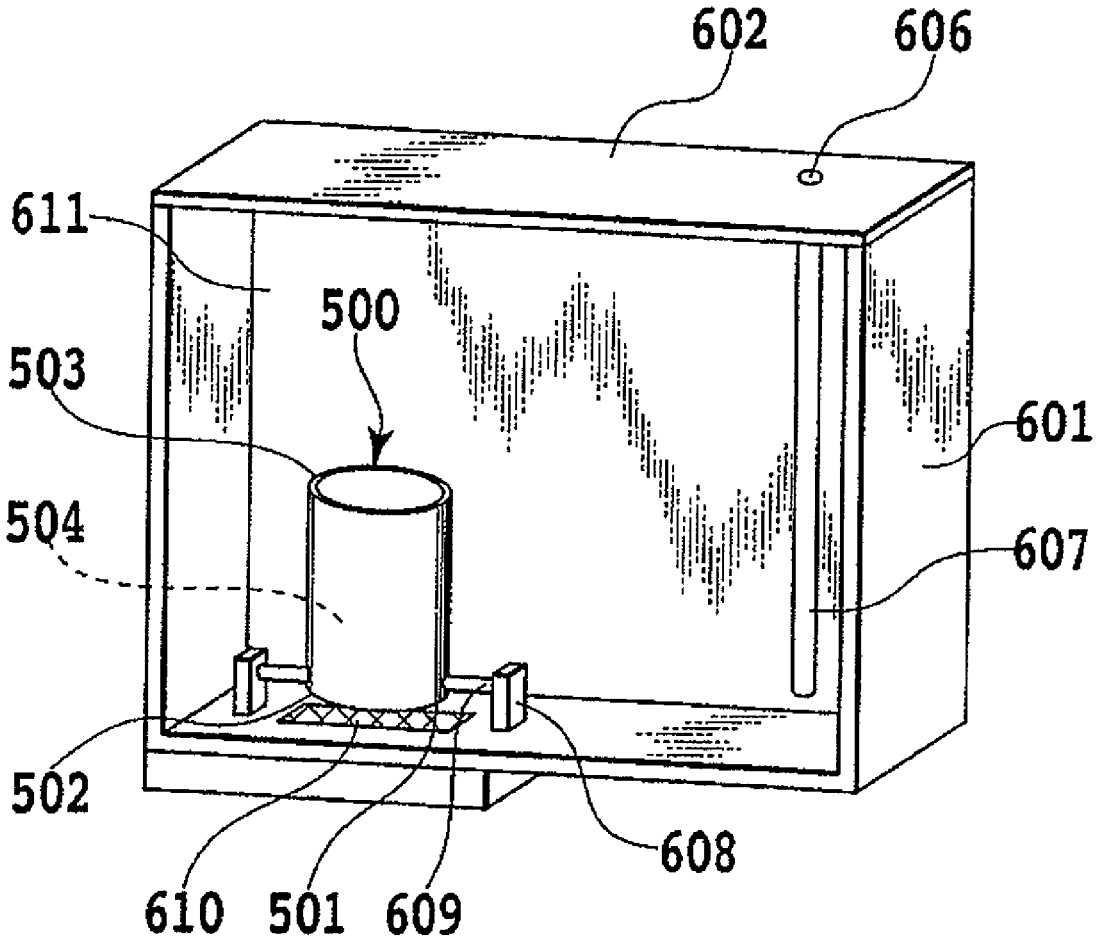
FIG. 32 is a perspective view of the inside of an ink tank shown in FIG. 2.

FIG. 31 is an exploded perspective view of an ink tank 6 in this embodiment. FIG. 32 is a perspective view showing essential parts for illustrating an installment state of a swing member shown in FIG. 31. An ink container case body 601 is formed of, for example, polypropylene, and an opening thereof is sealed by a cover member 602. A meniscus forming member 604 is pressed from the outside and held by a pressing member 605 in a portion of the ink container case body 601 where an ink supply port 610 is formed.

The meniscus forming member 604 communicates with the inside of the ink container case body 601 and the inside of the pressing member 605 by an ink flow passage. Accordingly, ink can be supplied from an ink containing chamber 611 in the ink container case body 601 to the printing head H1000 (see FIG. 3). A meniscus is formed in the meniscus forming member 604 by ink to prevent air bubbles from entering the ink containing chamber 611 from the outside.

An atmosphere communicating port 606, through which air flows into the ink containing chamber 611, is formed in the cover member 602. The ink containing chamber 611 is blocked from fresh air in portions excluding the atmosphere communicating port 606. A fine pipe 607 is hollow. One end of the fine pipe 607 communicates with the atmosphere communicating port 606 and the other end thereof is formed in the ink containing chamber 611 around the bottom of the ink containing chamber 611 in the gravity direction. With this configuration, as ink in the ink containing chamber 611 is consumed, air flows into the ink containing chamber 611 from the other end of the fine pipe 607. At this time, a negative pressure is generated in the ink containing chamber 611 by decompression of the ink containing chamber 611 as ink is consumed and the meniscus of ink in the fine pipe 607.

In this embodiment, the swing member 500 is provided with a lower opening 502, an upper opening 503, and a cylindrical hollow portion 504. Concave support portions 501 are provided at two places around the lower opening 502. Similarly to the fourth embodiment described above, the support portions 501 are engaged with protrusions 609 of fixed members 608 provided at the inner wall of the ink containing chamber 611, such that the swing member 500 is swingably supported, as shown in FIG. 32. The support portions 501 serve as a fulcrum when the swing member 500 swings.

(Experiment Result)

Next, the result of an experiment performed by the inventors will be described in order to verify the effects of this embodiment.

In the ink tank that is used in this experiment, the size of the ink containing chamber in the swing direction of the swing member is 30 mm, the size thereof in a direction perpendicular to the swing direction is 90 mm, and the size thereof in a height direction is 60 mm. The swing member is formed in a cylindrical shape using a stainless material having a thickness 0.5 mm (specific gravity is approximately 8.0). The inner diameter of the swing member is 10 mm and the height thereof is 20 mm. The ink containing chamber is filled with ink (specific gravity is approximately 1.0). The colorant settled at the lower layer of ink.

The ink tank was installed in the carriage of the ink jet printing apparatus, the carriage reciprocated by a movement distance of 2 inches at a movement speed of 36 inches/second. As a result, similarly to the above-described individual embodiments, the swing member swings, and the colorant that had settled at the bottom of the ink containing chamber was guided to the hollow portion of the swing member and flowed from the lower layer of ink toward the upper layer. Then, the carriage reciprocates 15 times, and the swing member reciprocated 15 times by the inertial force. If so, it could be seen that the colorant of entire ink in the ink containing chamber was stirred.

As such, in this embodiment, the ink flow from the lower layer of the ink containing chamber toward the upper layer is generated by swinging of the swing member, and high concentration ink and low concentration ink can be circulated and stirred according to the ink flow. That is, as the swing member 500 operates, high concentration ink is raised from the lower layer to the upper layer, and thus ink of the entire ink containing chamber 611 can be uniformly and efficiently stirred. As a result, a difference in density of the printed images at the initial use stage and the subsequent use stage of the cartridge type ink tank (ink cartridge) can be prevented from occurring. Further, when a plurality of color inks are used, deterioration of a color balance can be prevented.

Meanwhile, the meniscus forming member 604 is provided below the ink supply port 610 of the ink container case body 601, and thus the vicinity of the ink supply port 601 is likely to have a relatively complex shape. For this reason, ink that exists in the vicinity of the ink supply port 610 in the ink containing chamber 611 is rarely stirred farther than ink that exists in other portions of the ink containing chamber 611. Therefore, as shown in FIG. 32, the swing member 500 is preferably installed at a position facing the ink supply port 610.

(Modifications of Configuration of Stirring Mechanism)

Figure 33:
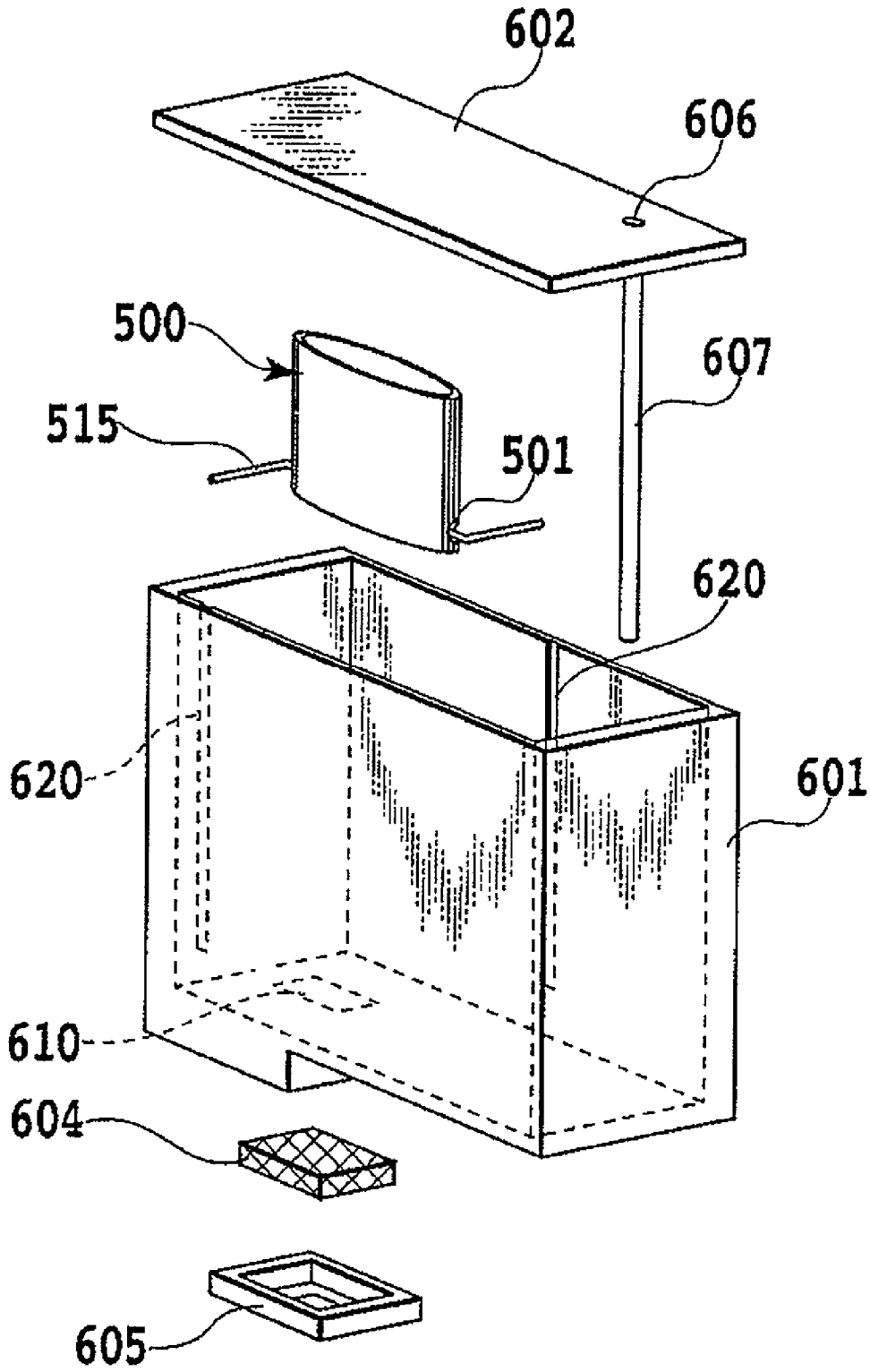
FIG. 33 is an exploded perspective view illustrating a modification of the ink tank.
Figure 34:
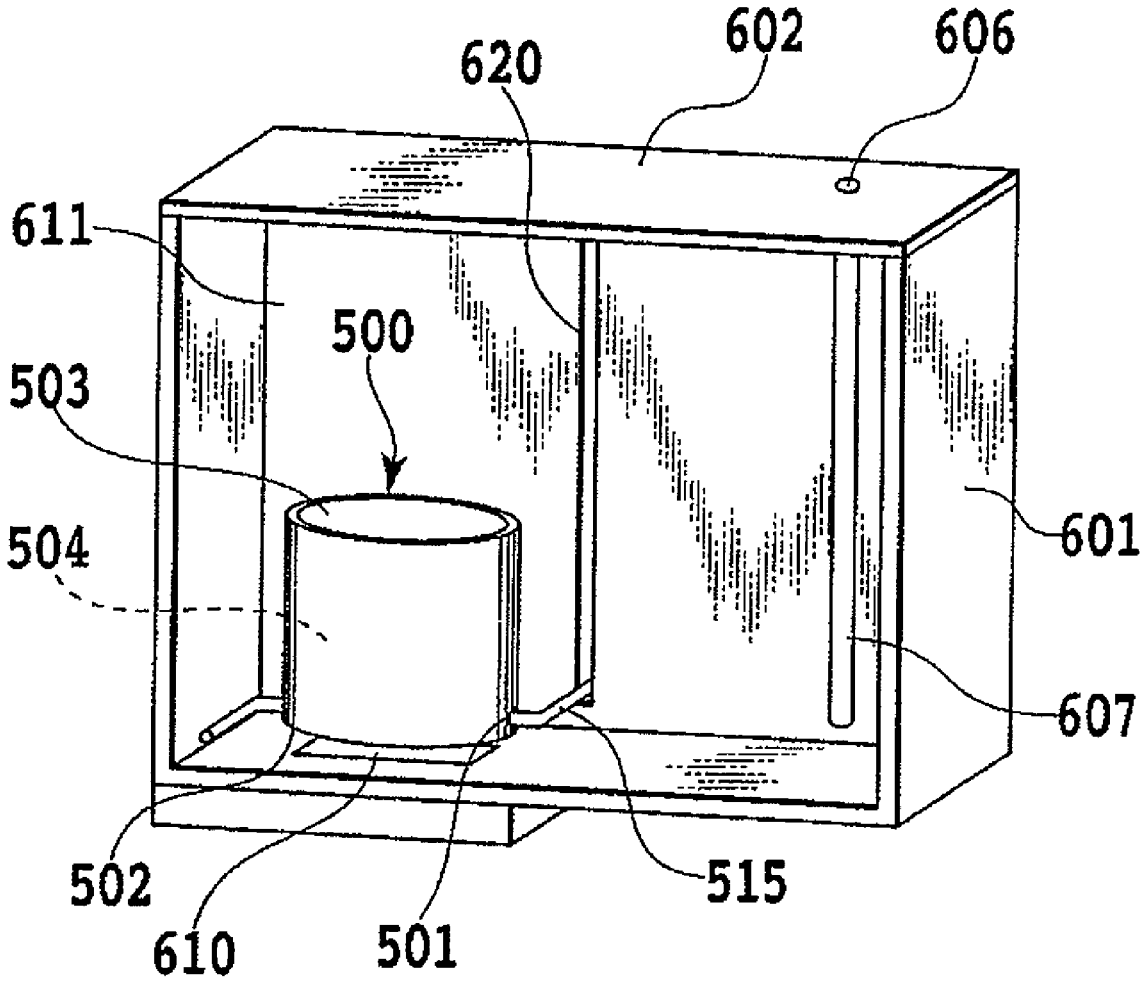
FIG. 34 is a perspective view of the inside of the ink tank.
Figure 35:
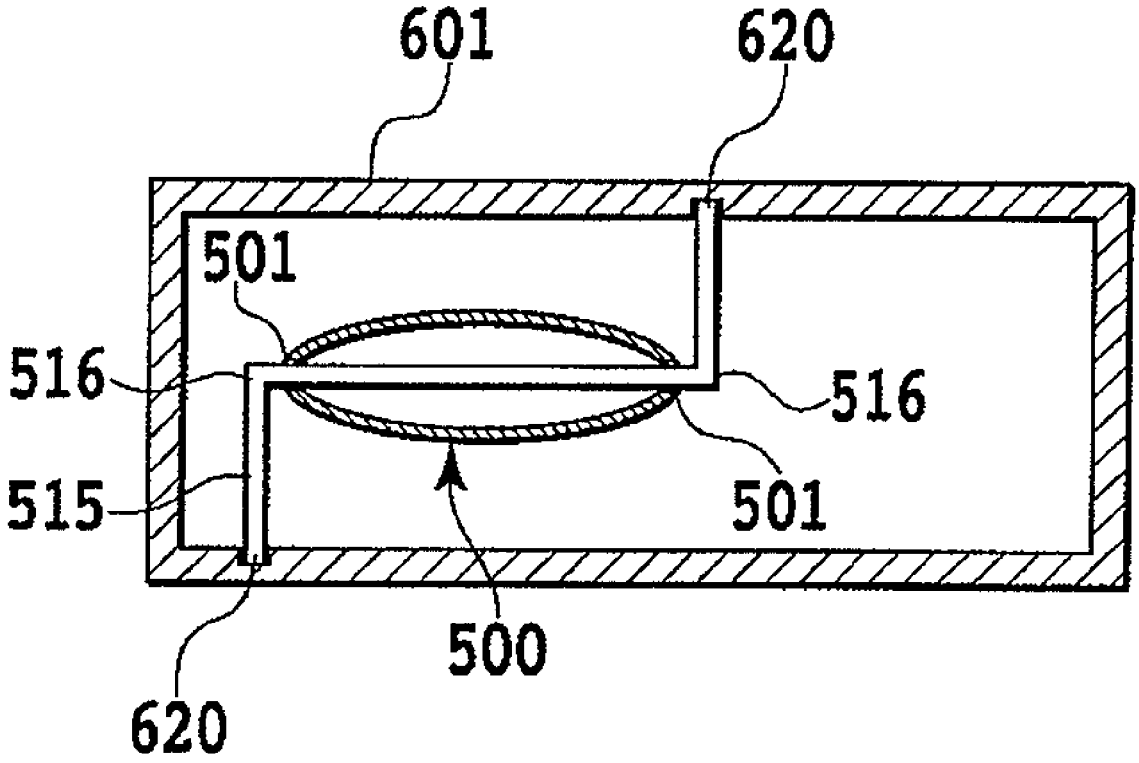
FIG. 35 is a cross-sectional view of the ink tank.

FIG. 33 is an exploded perspective view illustrating a modification of the ink stirring mechanism. FIG. 34 is a perspective view showing essential parts for illustrating an installment state of a swing member shown in FIG. 33. FIG. 35 is a transverse cross-sectional view of an ink container case body shown in FIG. 33.

As shown in FIG. 35, in a swing member 500 of this embodiment, holes are formed at two places of a hollow portion 504 having an elliptical shape in section. The holes constitute support portions 501. A support shaft 515 having an outer diameter smaller than the inner diameter of each of the support portions 501 passes through the support portions 501. Then, the support shaft 515 is bent at two places in different directions from each other to form bent portions 516. Both ends of the support shaft 515, which is passing through the swing member 500, are guided around the bottom of the ink container case body 601 through guides 620 provided in the ink container case body 601. Then, as shown in FIG. 34, both ends of the support shaft 515 are supported at the bottoms (lower ends) of the guides 620. Both ends of the support shaft 515 may be fixed to the bottoms (lower ends) of the guides 620 by engagement units or the like.

The swing member 500 swings with the support portions 501 and the support shaft 515 as a fulcrum. Accordingly, similarly to the above-described swing member 500, ink in the ink containing chamber 611 can be raised from the lower layer to the upper layer and efficiently stirred.

Sixth Embodiment

Figure 36:
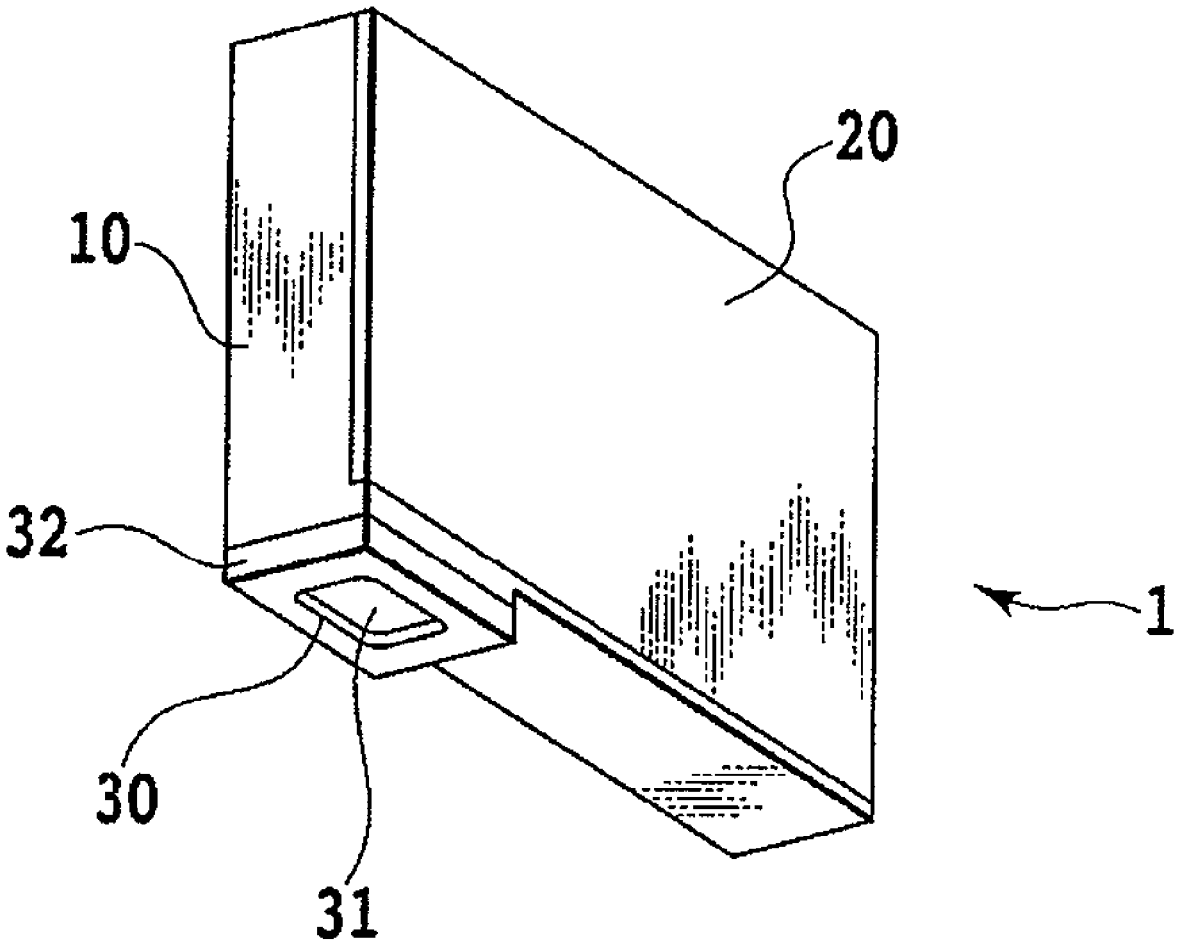
FIG. 36 is a perspective view of an ink tank according to a sixth embodiment of the present invention.
Figure 37:
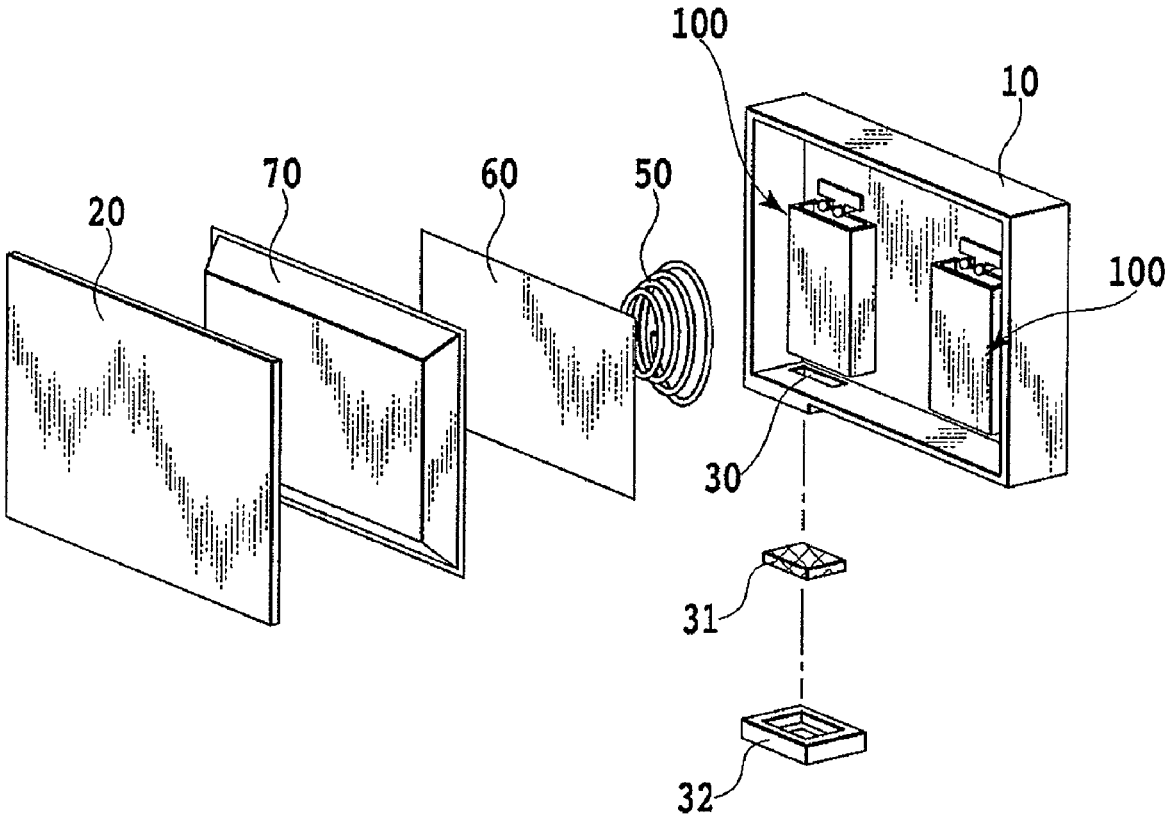
FIG. 37 is an exploded perspective view of the ink tank.

FIG. 36 is an exterior perspective view of an ink tank 1 according to a sixth embodiment of the present invention. The same parts as those in the above-described embodiments are represented by the same reference numerals, and the descriptions thereof will be omitted. FIG. 37 is an exploded perspective view of the ink tank 1.

(Configuration of Stirring Mechanism)

Figure 38:
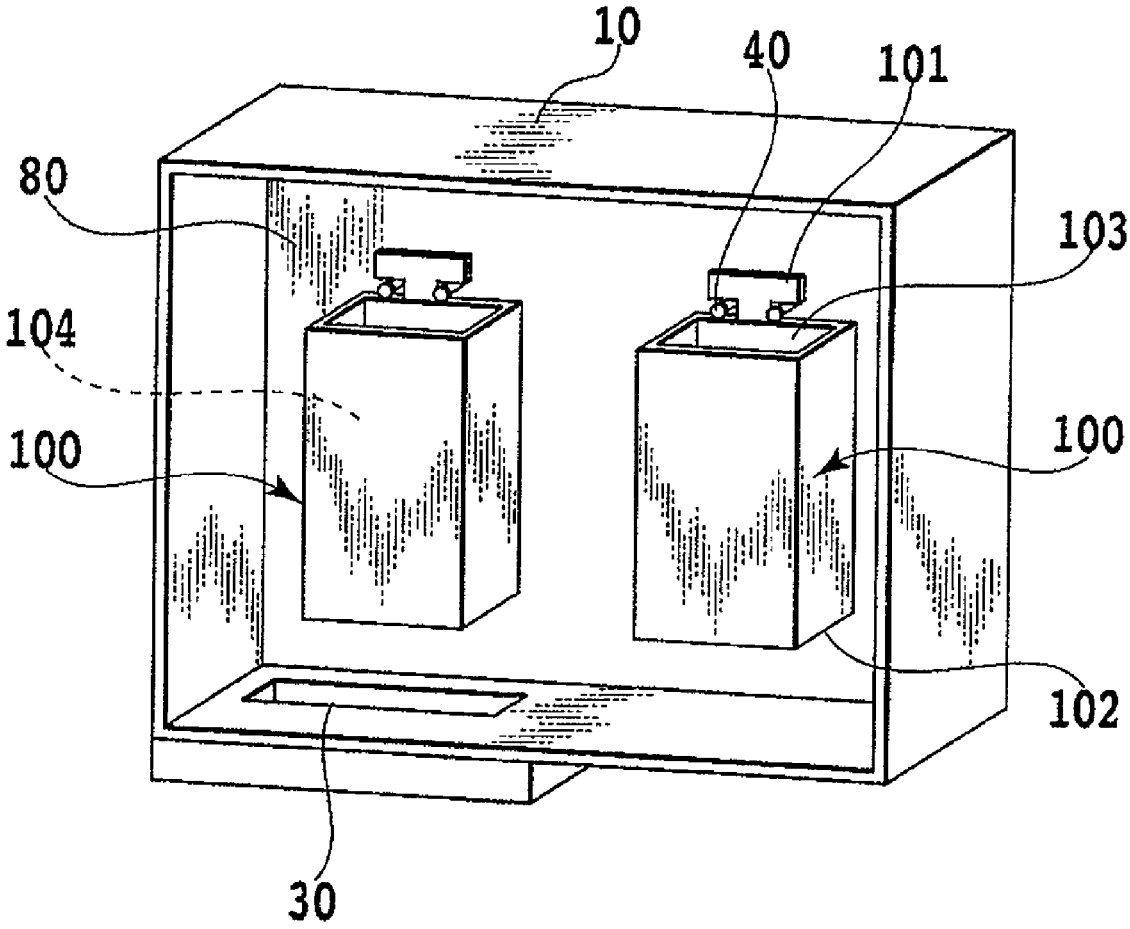
FIG. 38 is a perspective view of the inside of the ink tank.

FIG. 38 is a perspective view illustrating an installment state of swing members 100. Both sides of a support portion 101 of each of the swing members 100 are caught by protrusions 40 that are formed at the inner wall of an ink container case body 10. Accordingly, the swing members 100 are supported so as not to come into contact with a spring member 50. The protrusions 40 serve as a fulcrum when the swing members 100 rotate. The swing members 100 are formed of a stainless material. A head portion of each of the protrusions 40 is formed to have a large diameter such that the support portion 101 of the corresponding swing member 100 is not separated. The protrusions 40 serve as a swing fulcrum of the swing members 100 and allow sliding of the swing members 100 in an axial direction of the protrusions 40. Each of the swing members 100 is provided with a lower opening 102 that is located on a lower side of the ink container case body 10 in a gravity direction, and an upper opening 103 that is located above the lower opening 102. Then, a hollow portion 104 is formed between the openings 102 and 103. As such, each of the swing members 100 is three-dimensionally molded such that the inside thereof forms the hollow portion 104.

In the individual swing members 100 of this embodiment, the support portion 101 provided in the vicinity of the upper opening 103 is supported by the protrusions 40. For this reason, when the swing member 100 swings, the displacement of the lower opening 102 becomes larger than that of the upper opening 103.

In the ink tank 4 of this embodiment, if the swing members 100 operate, similarly to a seventh embodiment described below, low concentration ink flows from the upper layer toward the lower layer through the hollow portion 104. In addition, ink flows are generated by relative proximity and separation displacement of an outer wall of the swing member 100 and an inner wall of the ink containing chamber 80. With a combination of the ink flows, entire ink in the ink containing chamber 80 can be stirred.

Seventh Embodiment

Figure 39:
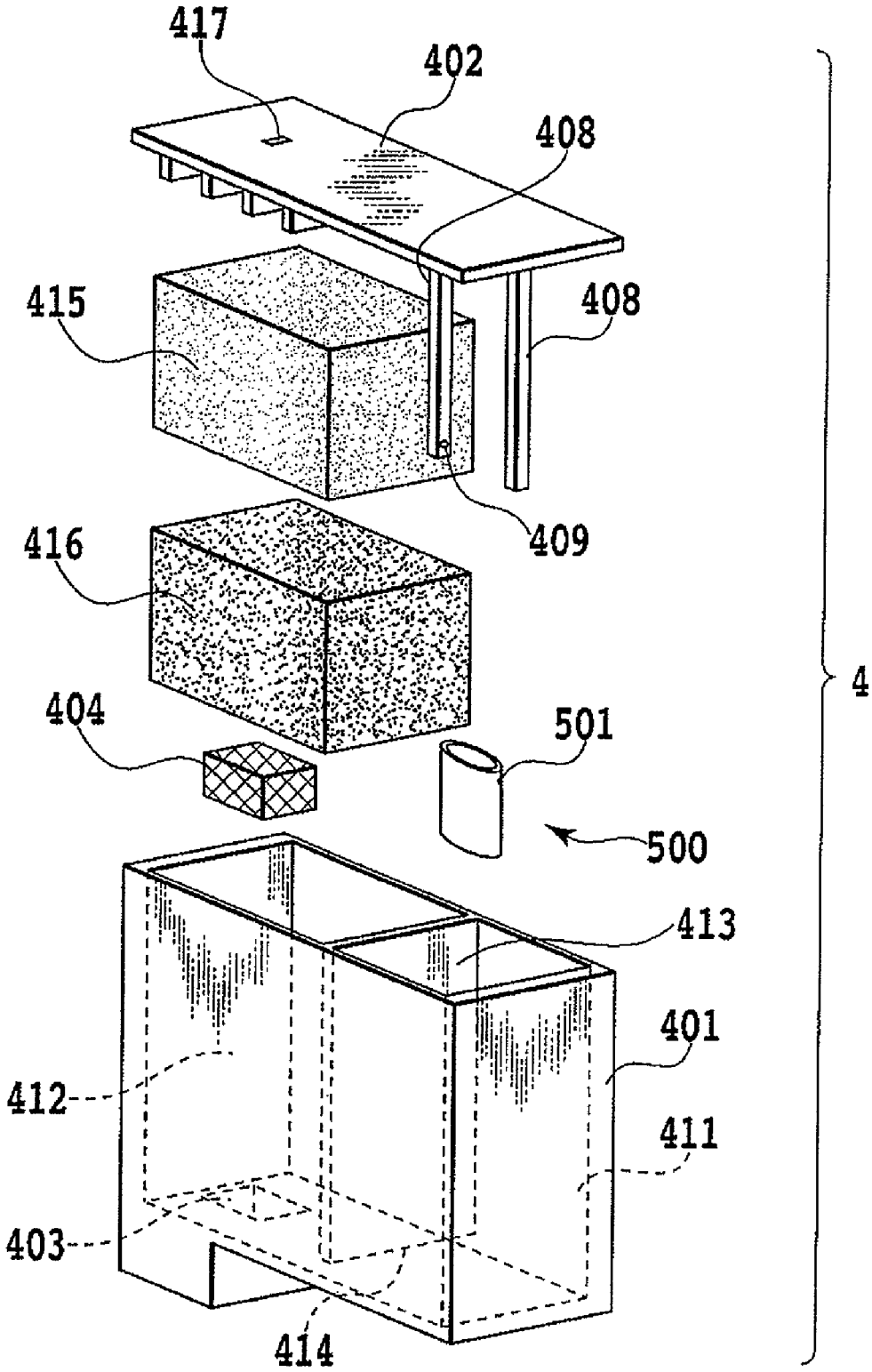
FIG. 39 is an exploded perspective view of an ink tank according to a seventh embodiment of the present invention.
Figure 40:
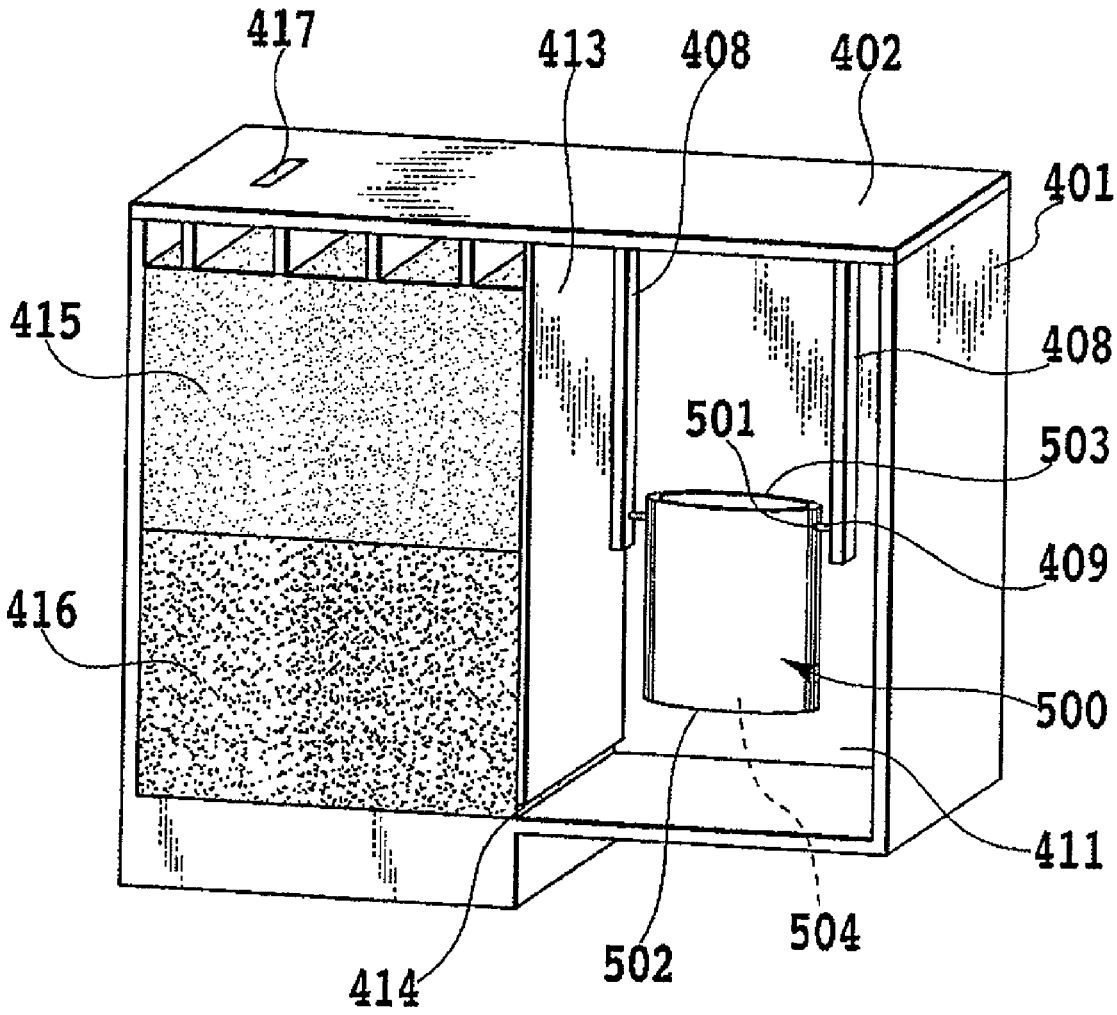
FIG. 40 is a perspective view of the inside of the ink tank.
Figure 41:
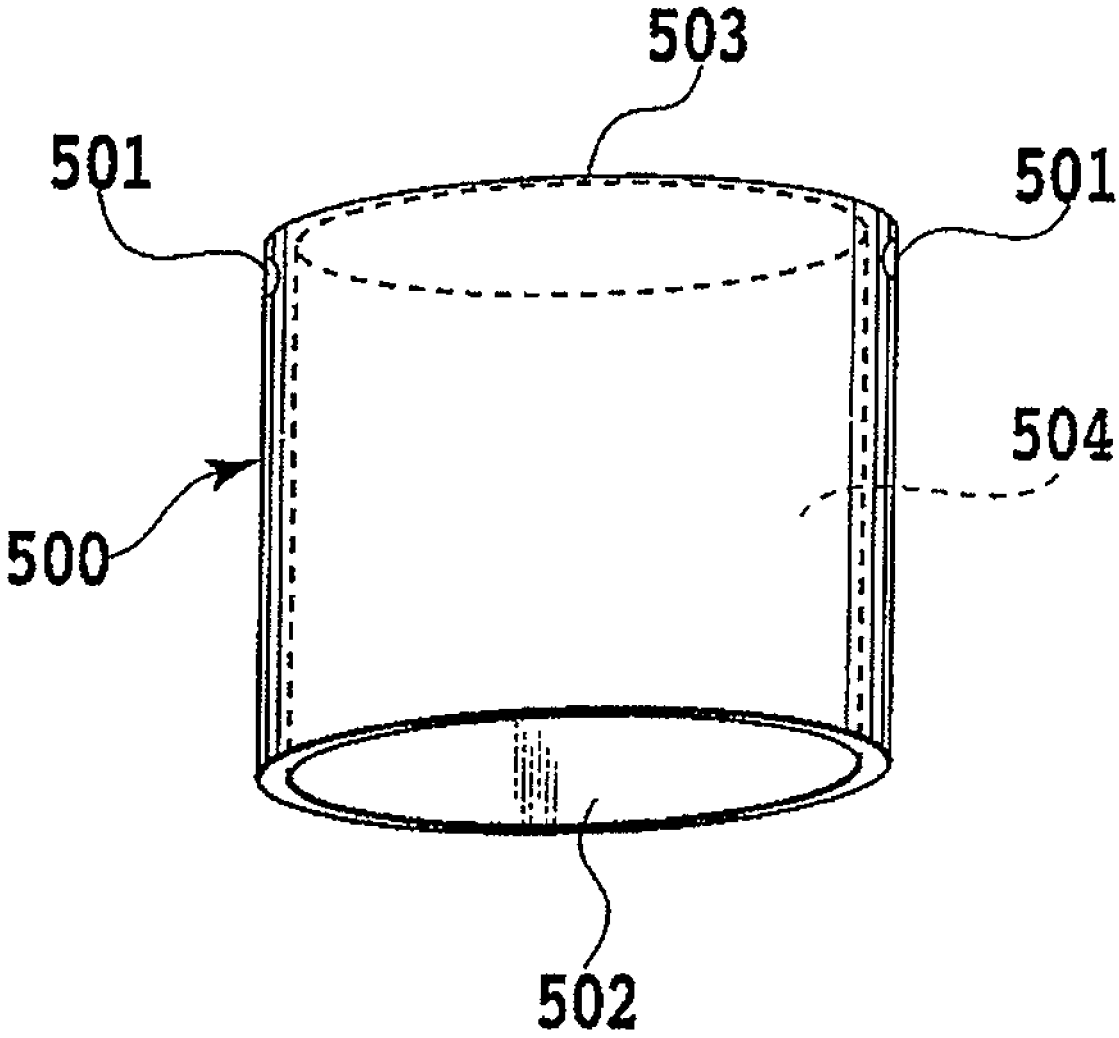
FIG. 41 is an enlarged perspective view of a swing member in the ink tank.

FIG. 39 is an exploded perspective view of an ink tank 4 according to a seventh embodiment of the present invention. In this embodiment, similarly to the ink tank 4 in the fourth embodiment described above, the ink tank 4 is provided with an ink containing chamber 411 that directly contains ink and a negative pressure generating chamber 412 that contains negative pressure generating members. Inside the ink containing chamber 411 is accommodated a swing member 500 that stirs ink. FIG. 40 is a perspective view illustrating an installment state of the swing member 500. FIG. 41 is an enlarged perspective view of the swing member 500.

The swing member 500 of this embodiment is provided with a lower opening 502 that is located on a lower side of the ink tank 4 in the gravity direction and an upper opening 503 that is located above the lower opening 502. A hollow portion 504 having an elliptical shape in section is formed between the openings. The swing member 500 is configured such that, when ink is filled in the ink containing chamber 411, the openings 502 and 503 and the hollow portion 504 are submerged in ink.

In the vicinity of the upper opening 503 of the swing member 500, concave support portions 501 are provided at two places positioned on a major axis of the elliptical shape of the swing member 500. The shape of each of the support portions 501 may be a hole that passes through the swing member 500. Further, the support portions may not be provided at the places positioned on the major axis of the elliptical shape, unlike this embodiment.

Fixed members 408 are provided in the cover member 402 to extend toward the ink containing chamber 411. As shown in FIG. 40, if protrusions 409 provided at the lower ends of the fixed members 408 are engaged with the support portions 501 of the swing member 500, the swing member 500 is swingably supported. The protrusions 409 serve as a fulcrum when the swing member 500 rotates. In this embodiment, the vicinity of the upper opening 503 is supported by the support portions 501. Therefore, similarly to the sixth embodiment, when the swing member 500 rotates, the displacement of the lower opening 502 becomes larger than that of the upper opening 503.

Next, the operation of the swing member 400, when the ink tank 4 of this embodiment is mounted on the carriage M4001 of the printing apparatus shown in FIGS. 29A to 29D and the carriage reciprocates, will be described with reference to FIGS. 42A to 42E.

Figure 42A:
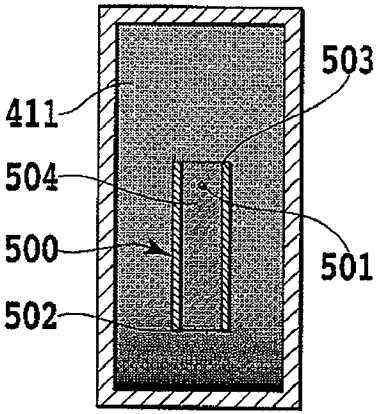
FIG. 42A is a cross-sectional view of the ink tank.

FIG. 42A shows a state where the carriage M4001 stands still at the home position shown in FIG. 29A and the swing member 500 in the ink containing chamber 411 is hanging downward in the gravity with the support portions 501 as a fulcrum.

Figure 42B:
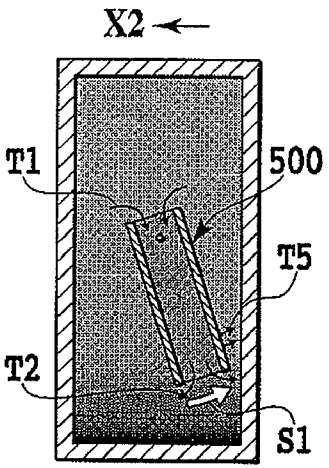
FIG. 42B is an explanatory view showing a state where the swing member in the ink tank moves in one direction.
Figure 42C:
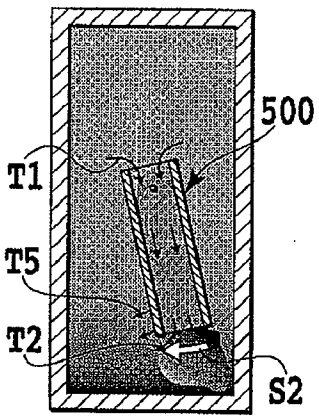
FIG. 42C is an explanatory view showing a state where the swing member in the ink tank moves in another direction.

If the carriage M4001 starts to move from the position of FIG. 29A in the X2 direction as shown in FIG. 29B, the swing member 500 moves in the direction of the arrow S1 by the action of the inertial force, as shown in FIG. 42B. Then, if the inertial force is not applied to the swing member 500 due to resistance of ink or the gravity, the swing member 500 swings in the S2 direction by the gravity, as shown in FIG. 42C.

Figure 42D:
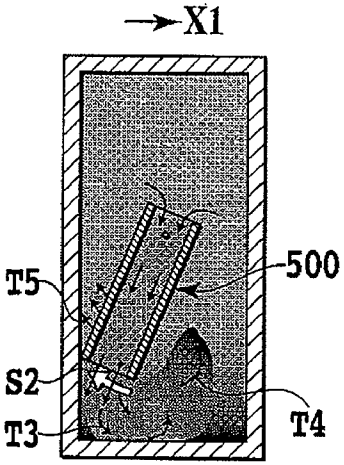
FIG. 42D is an explanatory view showing a state where the swing member in the ink tank moves in another direction.

Then, when the movement direction of the carriage is reversed from the X2 direction to the X1 direction at the position of FIG. 29C, as shown in FIG. 42D, the inertial force is applied to the swing member 500 in the X2 direction, such that the swing member 500 swings in the direction of the arrow S2. Then, as shown in FIG. 42D, after coming into contact with the inner wall of the ink containing chamber 411 as shown in FIG. 42D, the swing member 500 returns in the S1 direction by a reaction force upon the contact and the gravity. As such, if the movement direction of the carriage M4001 is reversed from the X2 direction to the X1 direction at the position of FIG. 29A while the swing member 500 returns in the S1 direction, the inertial force is further applied to the swing member 500 in the X1 direction. With the inertial force, the swing member 500 swings in the S1 direction, as shown in FIG. 42E.

Figure 42E:
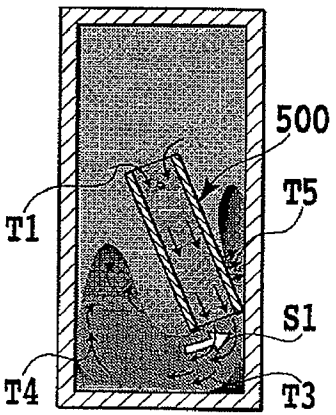
FIG. 42E is an explanatory view showing a state where the swing member in the ink tank moves in one direction.

As such, if the carriage M4001 continuously repeats movement of FIGS. 29A to 29D, the swing member 500 repeats swing of FIGS. 42D and 42E. In this embodiment, since the carriage is repeatedly reversed while the swing member returns in the S1 direction by the gravity and the reaction force, the swing member can swing with a relatively small inertial force.

Next, an example where high concentration ink settled at the bottom of the ink containing chamber 411 is stirred will be described with reference to FIGS. 42A to 42E.

If the swing member 500 starts to swing in the S1 direction, ink that exists in the hollow portion 504 of the swing member 500 is discharged from the lower opening 502, as indicated by an arrow T2 in FIG. 42B, by a centrifugal force generated due to the rotation of the swing member 500. Simultaneously, low concentration ink around the upper opening 503 flows into the hollow portion 504, as indicated by an arrow T1.

Then, if swing of the swing member 500 is repeated, low concentration ink flows into the hollow portion 504 from the upper opening 503, as shown in FIG. 42D, by a centrifugal force applied to ink in the hollow portion 504. Then, the ink is discharged from the lower opening 502 in the direction of the arrow T2. Further, as shown in FIGS. 42D and 42E, when swing of the S1 and S2 directions of the swing member 500 is stopped, the inertial force is applied to ink in the hollow portion 504, and the flow of ink is further accelerated.

Low concentration ink is discharged from the lower opening 502 and then dispersed in high concentration ink, as indicated by an arrow T3 in FIGS. 42D and 42E. Further, with a flow T4 generated by rebounding from the inner wall of the ink containing chamber 411, high concentration ink is further stirred. Further, as shown in FIGS. 42B to 42E, while the swing member 500 swings, a downward ink flow occurs in the hollow portion 504. Simultaneously, an ink flow T5 is generated by relative proximity and separation displacement between the outer wall of the swing member 500 and the inner wall of the ink containing chamber 411. With the flows, ink in the ink containing chamber 411 is further stirred.

As such, if the operation to swing the swing member 500 is performed one time or several times, ink in the ink containing chamber 411 can be uniformly stirred by the ink flows T1 to T5. That is, if the swing fulcrum is located above the central portion of the swing member in the vertical direction, ink that is introduced from the opening on the upper side in the gravity direction can be derived from the opening on the lower side in the gravity direction. Accordingly, ink can be guided from the upper side to the lower side in the gravity direction through the hollow portion and then stirred. Such a stirring effect varies according to parameters, such as the inner diameter, the peripheral length, the surface area, the length, the specific gravity, the movement speed, and the movement distance of the swing member 500, the viscosity of ink, and a contact angle. However, such parameters can be arbitrarily set insofar as a propulsive force enough for low concentration ink to flow down through the hollow portion of the swing member is obtained. What is necessary is that the swing member 500 is swung such that such a propulsive force is generated by the centrifugal force and the inertial force applied to the ink in the tank.

Eighth Embodiment

Figure 43:
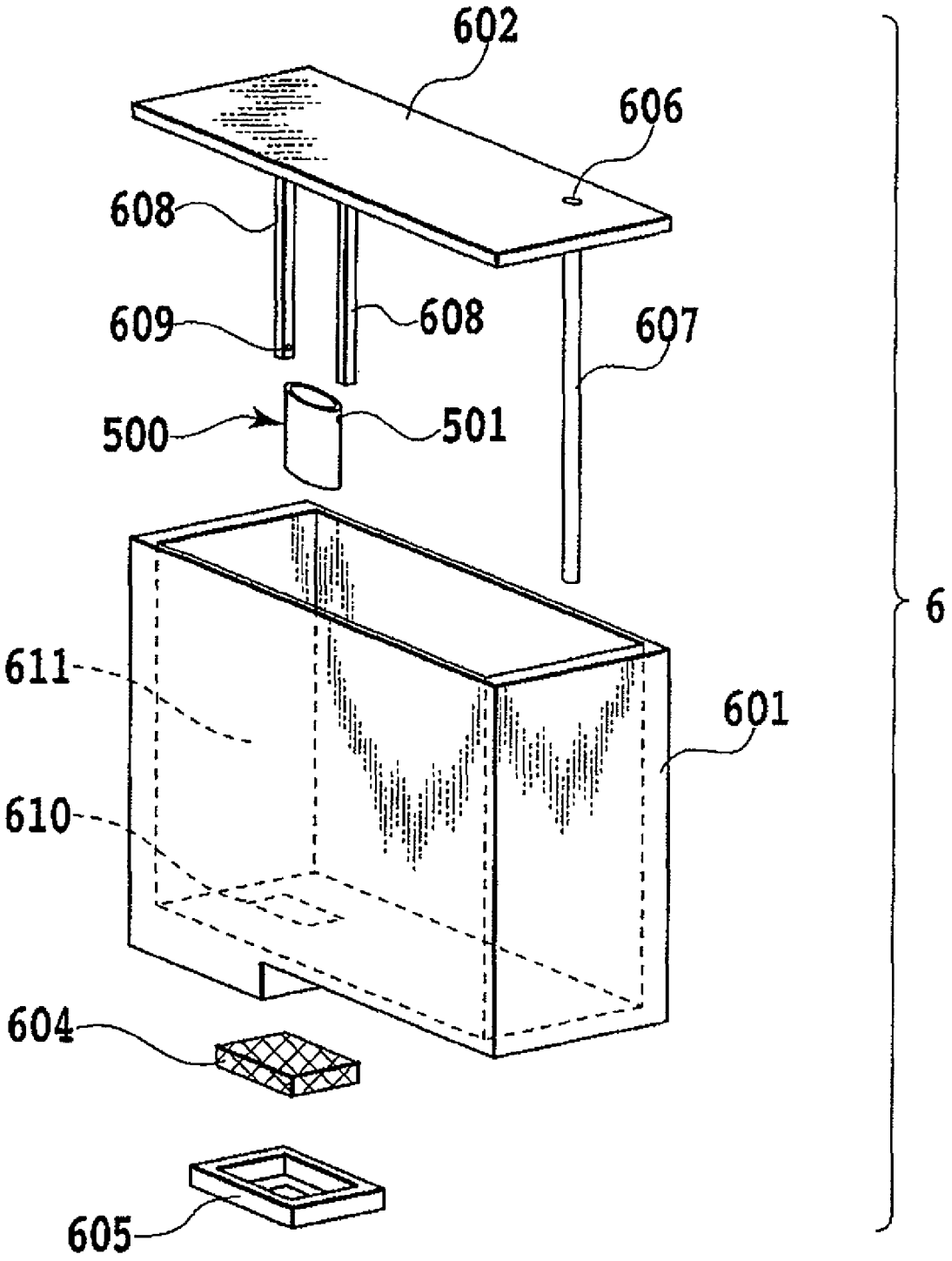
FIG. 43 is an exploded perspective view of an ink tank according to an eighth embodiment of the present invention.
Figure 44:
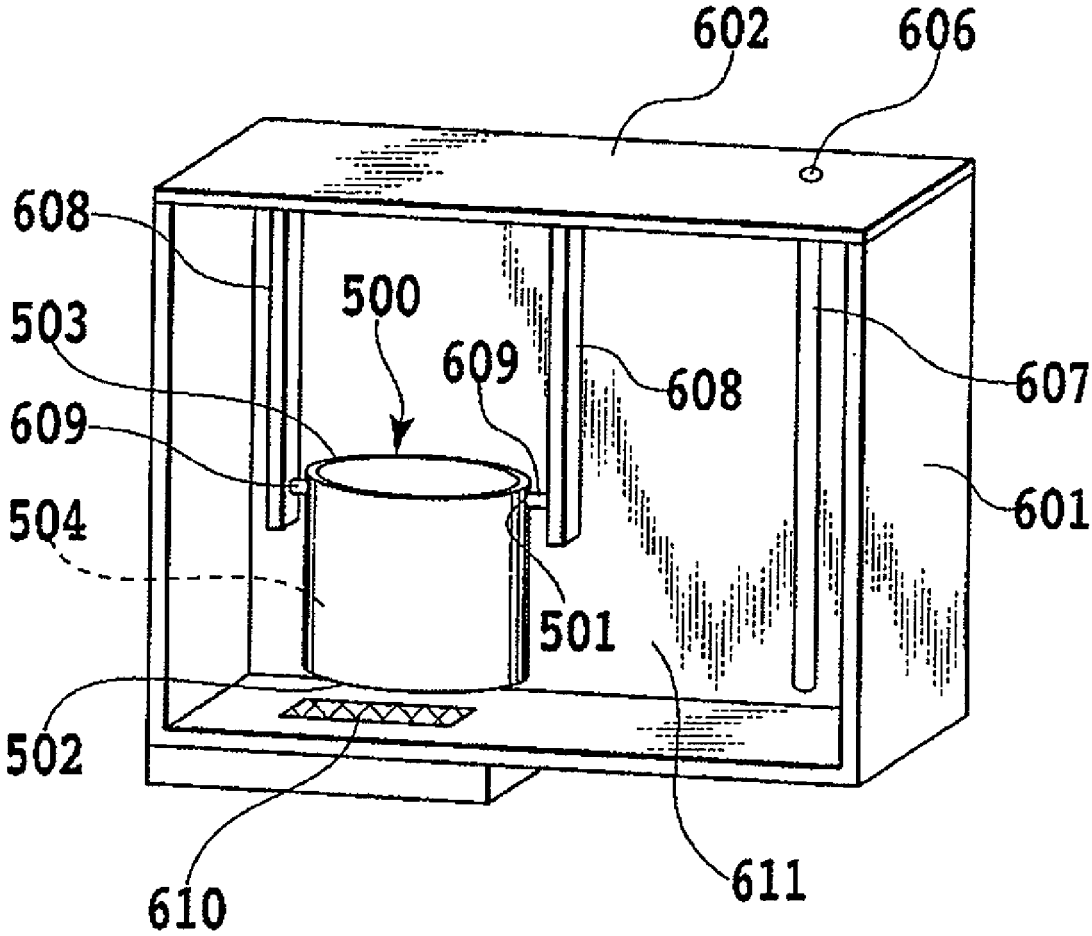
FIG. 44 is a perspective view of the inside of the ink tank.

FIG. 43 is an exploded perspective view of an ink tank 6 according to an eighth embodiment of the present invention. FIG. 44 is a perspective view showing essential parts for illustrating an installment state of a swing member 500 shown in FIG. 43.

In the ink tank 6 of this embodiment, similarly to the ink tank 6 in the fifth embodiment described above, an ink containing chamber 611 that contains ink is formed. Further, similarly to the swing member 500 in the seventh embodiment described above, the swing member 500 is provided with a lower opening 502, an upper opening 503, a hollow portion 504, and support portions 501.

A cover member 602 is provided with fixed members 608 extending toward the ink containing chamber 611. As shown in FIG. 44, protrusions 609 provided at the lower ends of the fixed members 608 are engaged with the support portions 501 of the swing member 500, such that the swing member 500 is swingably supported. The protrusions 609 serve as a fulcrum when the swing member 500 rotates. In this embodiment, the vicinity of the upper opening 503 is supported by the support portions 501. Accordingly, similarly to the sixth and seventh embodiments described above, when the swing member 500 rotates, the displacement of the lower opening 502 becomes larger than that of the upper opening 503.

A meniscus forming member 604 is provided below the ink supply port 610 of the ink container case body 601, and thus the vicinity of the ink supply port 601 is likely to have a relatively complex shape. For this reason, ink that exists in the vicinity of the ink supply port 610 in the ink containing chamber 611 is rarely stirred farther than ink that exists in other portions of the ink containing chamber 611. Therefore, as shown in FIG. 44, the swing member 500 is preferably installed at a position facing the ink supply port 610.

In the ink tank 6 of this embodiment, similarly to the sixth and seventh embodiments, if the swing member 500 operates, low concentration ink can flow down to the lower layer of ink in the ink tank through the hollow portion 504. In addition, an ink flow can be generated by proximity and separation of the outer wall of the swing member 500 and the inner wall of the ink containing chamber. As such, with the combination of two flows generated inside and outside of the swing member, entire ink in the ink containing chamber can be stirred.

Figure 45:
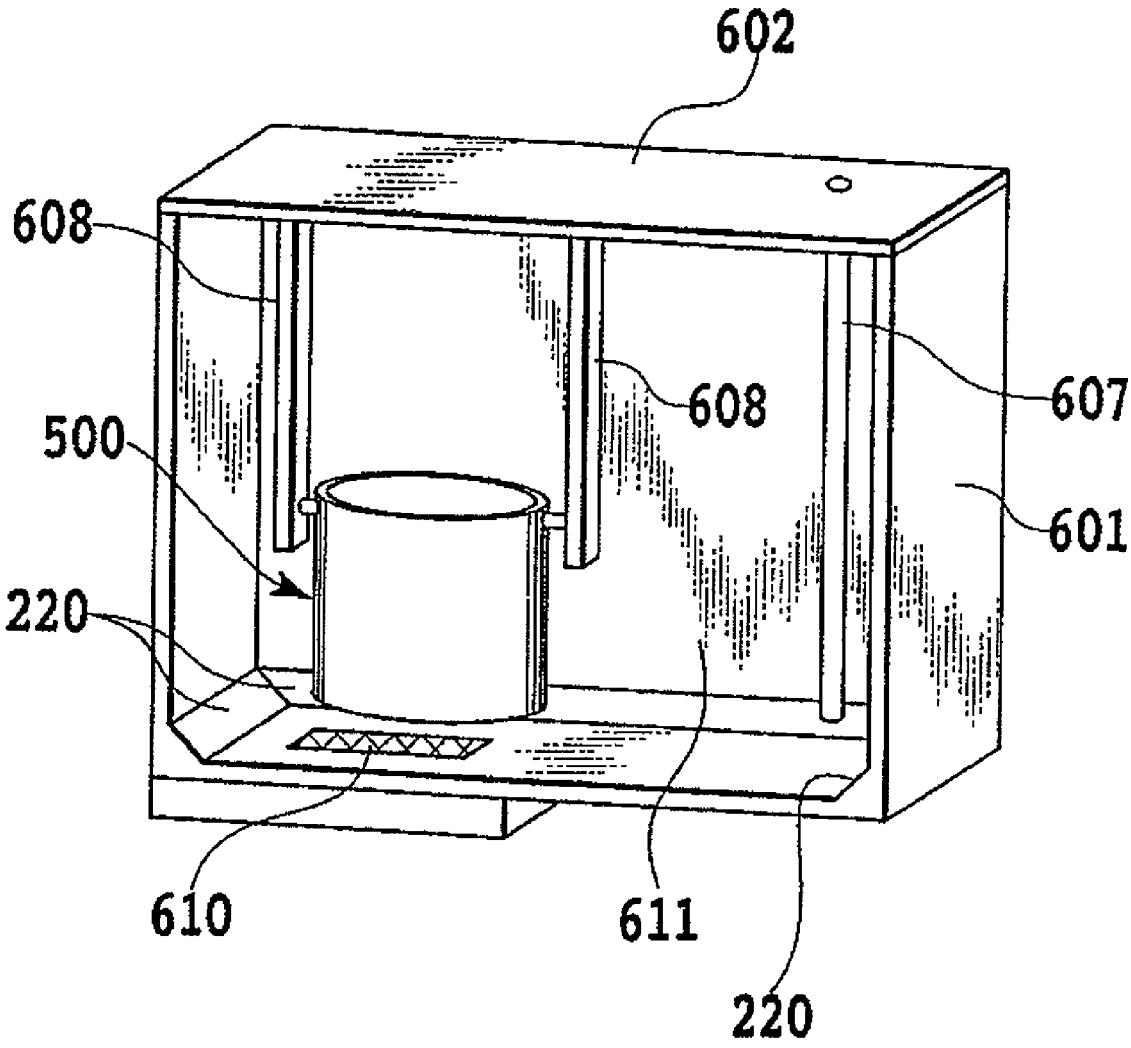
FIG. 45 is a perspective view of the inside of an ink tank according to a modification of the ink tank.

Meanwhile, according to the kind of a pigment in the pigment ink to be used, the pigment may remain at the corner at the bottom of the ink containing chamber and aggregated by the ink flow upon stirring. When the pigment is aggregated, even if the ink stirring operation is performed, the pigment is rarely stirred. In order to prevent the pigment from being aggregated at the corner of the bottom of the ink containing chamber, as shown in FIG. 45, planar or arc surface portions 220 are preferably formed at the ink containing chamber, at least the corner of the bottom, to be inclined toward the inside of the ink containing chamber 611.

Ninth Embodiment

Figure 46:
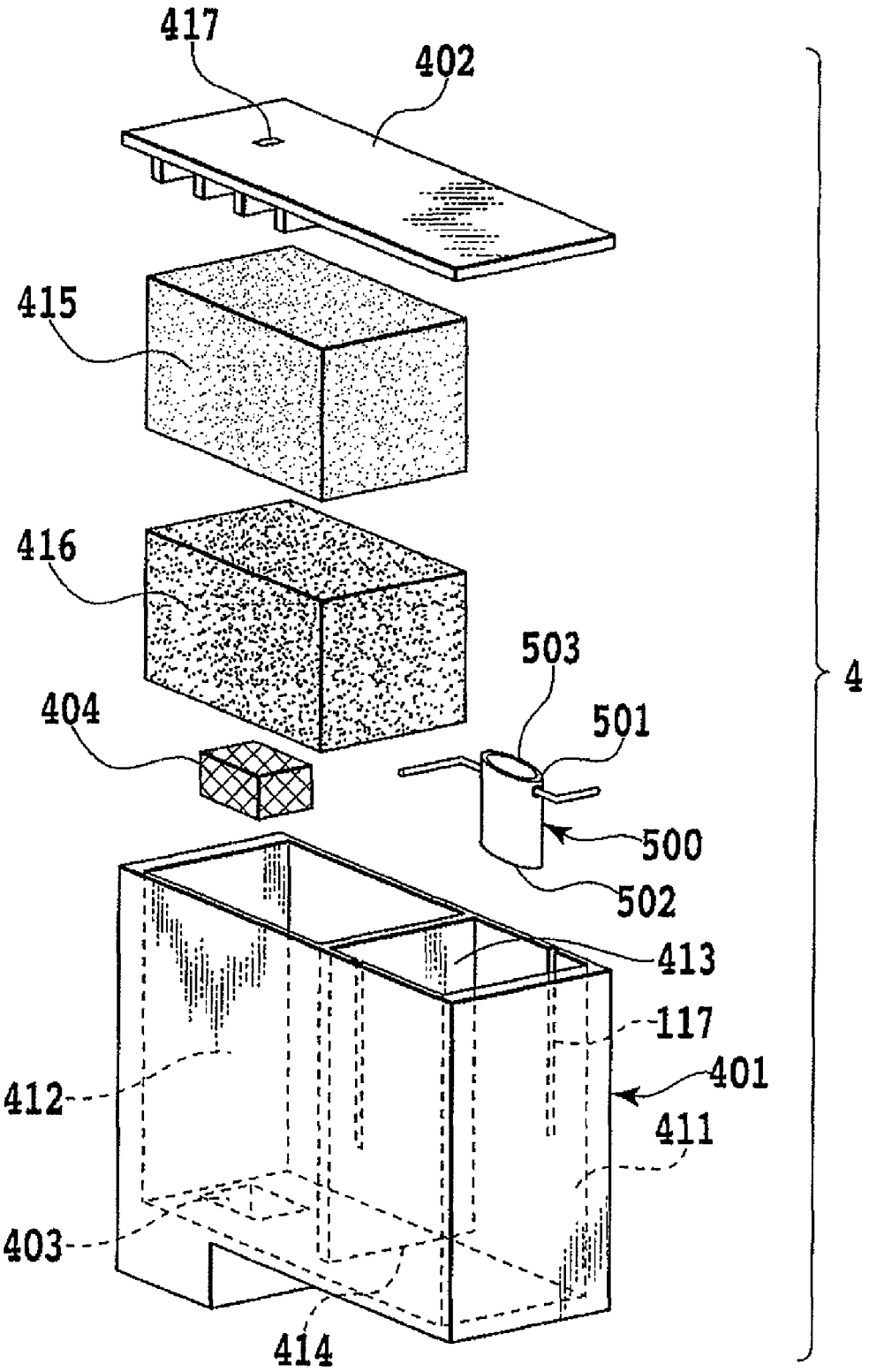
FIG. 46 is an exploded perspective view of an ink tank according to a ninth embodiment of the present invention.
Figure 47:
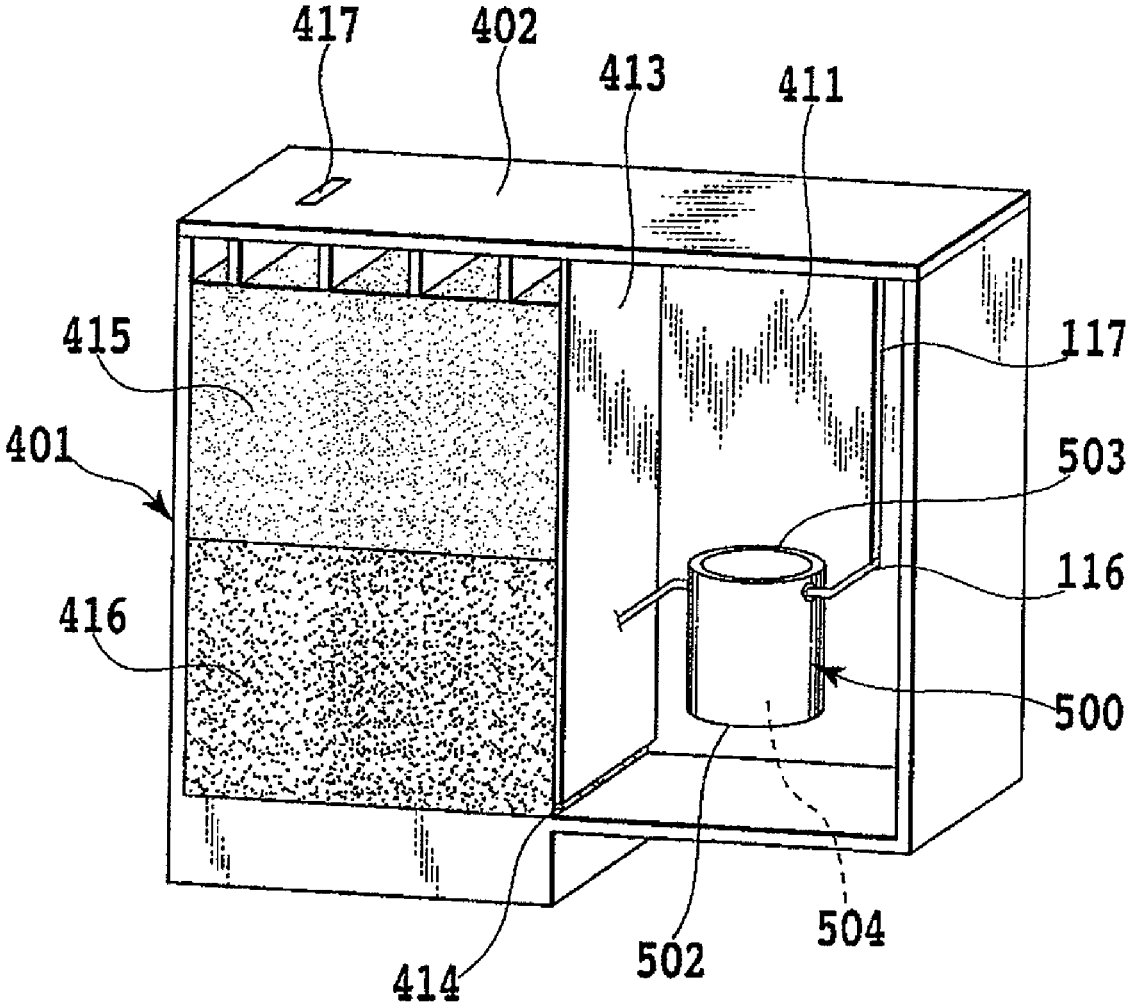
FIG. 47 is a perspective view of the inside of the ink tank.
Figure 48:
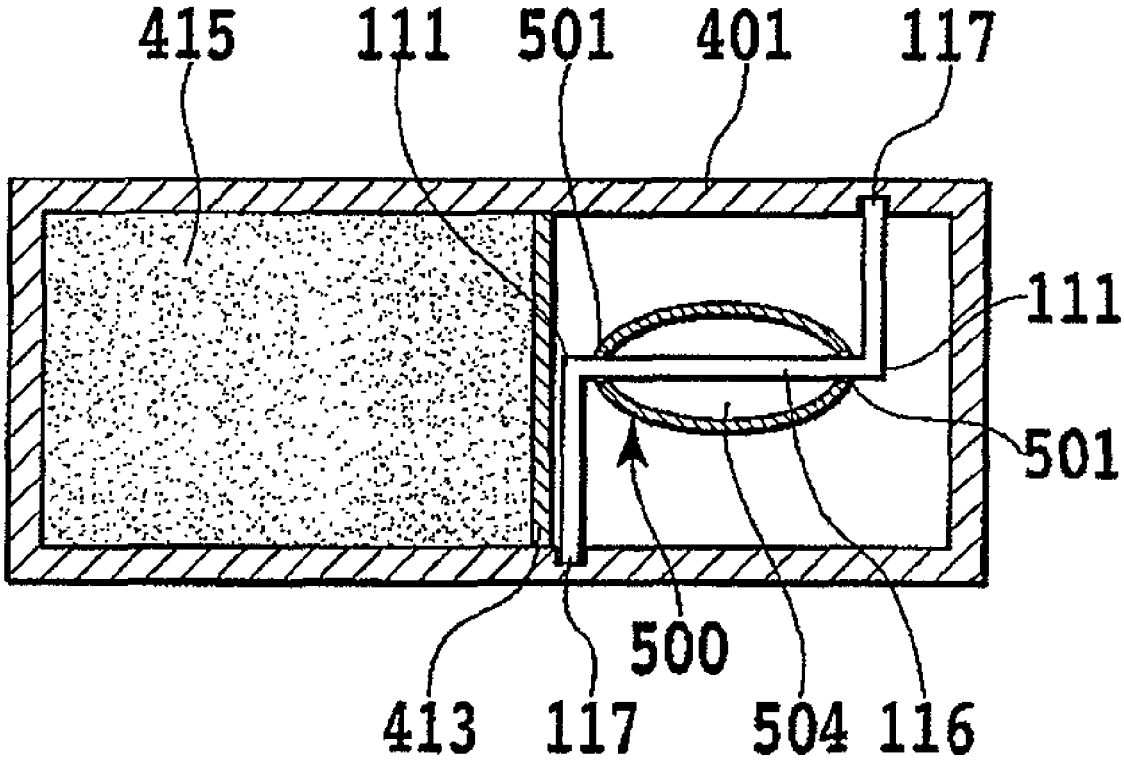
FIG. 48 is a cross-sectional view of the ink tank.

FIG. 46 is an exploded perspective view of an ink tank 4 according to a ninth embodiment of the present invention. In this embodiment, similarly to the ink tank 4 in the fourth and seventh embodiments described above, the ink tank 4 is provided with an ink containing chamber 411 that directly contains ink, and a negative pressure generating chamber 412 that contains negative pressure generating members. Inside the ink containing chamber 411 is accommodated a swing member 500 that stirs ink. FIG. 47 is a perspective view illustrating an installment state of the swing member 500. FIG. 48 is a transverse cross-sectional view of an ink container case body 401.

In the swing member 500 of this embodiment, as shown in FIG. 48, holes are formed at two places of a hollow portion 504 having an elliptical shape in section. The holes constitute support portions 501. A support shaft 116 having an outer diameter smaller than the inner diameter of each of the support portions 501 passes through the support portions 501. Then, the support shaft 116 is bent at two places in different directions from each other to form bent portions 111. Both ends of the support shaft 116, which is passing through the swing member 500, are guided around the bottom of the ink container case body 401 through guides 117 provided in the ink container case body 401. Further, as shown in FIG. 47, both ends of the support shaft 116 are supported at the bottoms (lower ends) of the guides 117. Both ends of the support shaft 116 may be fixed to the bottoms (lower ends) of the guides 117 by engagement units or the like.

In the ink tank 4 of this embodiment, similarly to the sixth to eighth embodiments, if the swing member 500 operates, low concentration ink can flow down to the lower layer of ink in the ink tank through the hollow portion 504. In addition, an ink flow can be generated by proximity and separation of the outer wall of the swing member 500 and the inner wall of the ink containing chamber. As such, with the combination of two flows generated inside and outside of the swing member, entire ink in the ink containing chamber can be stirred.

Tenth Embodiment

Figure 49:
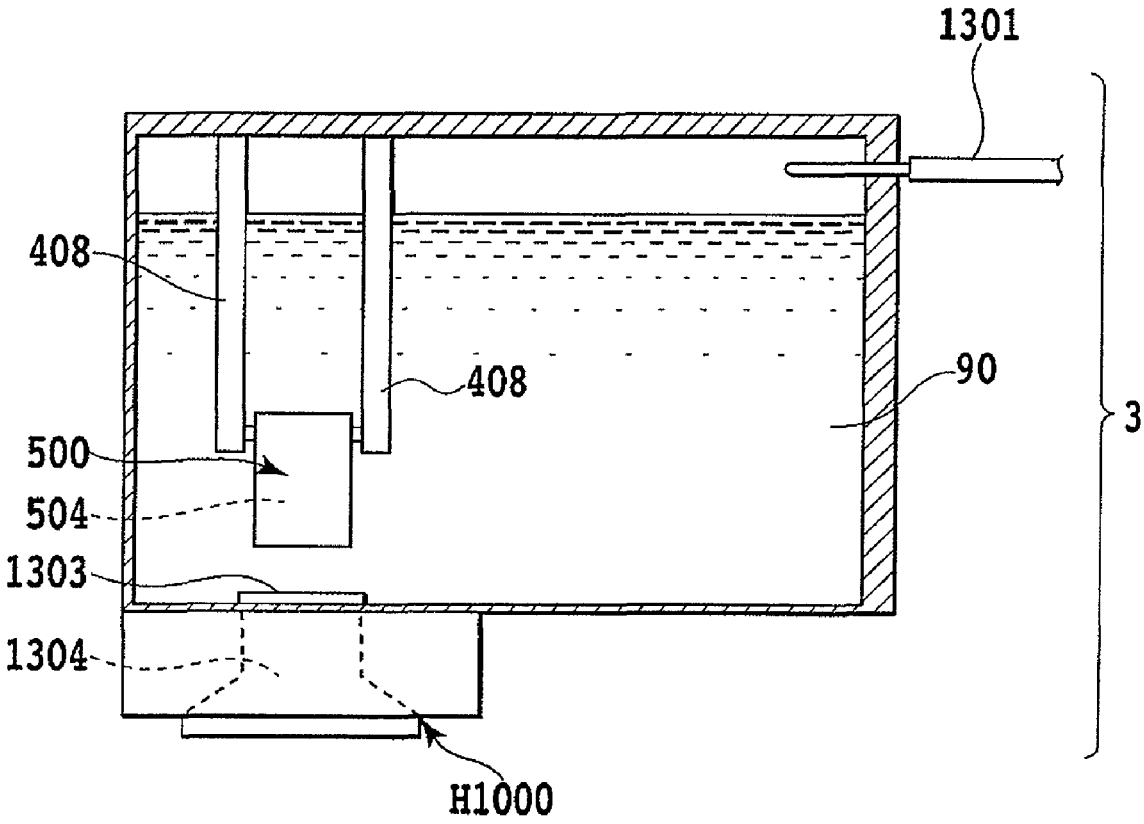
FIG. 49 is a cross-sectional view of essential parts of a head cartridge according to a tenth embodiment of the present invention.

FIG. 49 is a diagram illustrating a tenth embodiment of the present invention. In this embodiment, the same swing member 500 as that in FIG. 40 is provided in the sub tank 3 shown in FIG. 23.

Ink 90 in a sub tank 3 is supplied to a printing chip forming the printing head H1000 through a filter 1303 and an ink flow passage 1304 and ejected from an ejection port of the printing head H1000. A tube 1301 is connected between the sub tank 3 and a main tank 1311 that is provided outside the carriage M4001. Ink 90 is contained in the main tank 1311, and is then supplied to the sub tank 3 by a pump 1302. Accordingly, ink 90 in the main tank 1311 enters the sub tank 3 and then is supplied to the printing head H1000.

During the image printing operation, similarly to the serial scan type printing apparatus, the printing head H1000 repeatedly performs an operation to eject ink while moving in the main scanning direction together with the carriage M4001 and an operation to transport the printing medium in the sub scanning direction.

Protrusions 408 are provided in an upper portion of the sub tank 3 to extend downward. Like FIG. 40, an upper portion of the swing member 500 is swingably supported by the protrusions 408. Accordingly, the swing member 500 can be swung (rotated) by an inertial force according to reciprocation (X) of the carriage M4001.

As a result, similarly to the sixth to ninth embodiments, if the swing member 500 operates, low concentration ink can flow down to the lower layer of ink in the ink tank through the hollow portion 504. In addition, an ink flow can be generated by proximity and separation of the outer wall of the swing member 500 and the inner wall of the sub tank 3. As such, with the combination of two flows generated inside and outside of the swing member, entire ink in the sub tank 3 can be stirred.

Other Embodiments

What is necessary is that the liquid container of the present invention can generate a liquid flow for stirring the liquid from the bottom of the container toward the upper portion or from the upper portion of the container toward the bottom in the hollow portion of the swing member provided therein. The direction of the liquid flow can be optimally set according to the shape of a liquid containing space, the kind of liquid, or the like. In addition, the liquid flow may be generated through at least two openings and the hollow portion therebetween.

Therefore, in the swing member, the positions and shapes of the hollow portion and the opening, and the numbers of hollow portions and openings may be arbitrarily set.

Further, the configuration that generates the flow of the liquid passing through the hollow portion of the swing member may be arbitrarily selected, but not limited to the configuration that uses movement of the swing member, as described above. For example, the swing member may be fixed. In this case, instead of moving the swing member, similarly to the embodiment of FIG. 16A, an ink flow Z may be introduced from the outside of the ink tank and a difference in pressure between the liquids around two openings in the swing member may be generated by the flow Z. Further, when the swing member is movable, a movement example is not particularly limited. For example, the swing member may be configured to swing (rotate) with a specified fulcrum as a center, to reciprocate along a predetermined trace, or to freely move along a specified surface of the liquid container. In summary, what is necessary is that a liquid flow from the bottom of the container toward the upper portion or from the upper portion of the container to the bottom can be generated in the hollow portion of the swing member according to movement of the swing member.

As a flowing configuration for generating the liquid flow, when the opening and the liquid are relatively moved, a negative pressure of the liquid generated around the opening according to Bernoulli's theorem, or the centrifugal force or the inertial force of the liquid may be used. That is, the centrifugal force of the liquid in the hollow portion of the swing portion according to swing of the swing member may be used, or the inertial force of the liquid inside or outside of the hollow portion when the swing member is stopped may be used. Further, instead of the introduction of the ink flow Z in the embodiment of FIG. 16A, mechanical kinetic energy or magnetic energy may be introduced from the outside, and the swing member may be moved using this energy as a driving force.

With a combination of the liquid flow in the hollow portion of the swing member and the action of the liquid when it is mechanically stirred by the action of the swing member, the liquid can be efficiently stirred.

In the above-described embodiments, as an example of the liquid container in the present invention, an ink tank that is mountable on the so-called serial scan type ink jet printing apparatus is exemplified. However, the present invention is not applied to only the ink tank. For example, the present invention can be applied to the configuration in which a liquid container having a swing member, which includes a hollow portion for guiding a liquid, is placed on a placing stand, and the placing stand reciprocates to swing the swing member and to stir the liquid. Further, movement of the liquid container is not limited to reciprocation. For example, the liquid container may move in a direction, then temporarily stop, and subsequently move in the same direction again. In this case, the swing member can be swung and thus the liquid can be stirred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-130792, filed May 9, 2006, 2007-119912, filed Apr. 27, 2007, which are hereby incorporated by reference herein in their entirety.

The invention claimed is:

1. A liquid container comprising:

a liquid containing portion;

a supply port through which liquid contained in the liquid containing portion is supplied; and a stirring member that stirs the liquid contained in the liquid containing portion;

wherein the liquid containing portion includes a support portion for swingable support of the stirring member, wherein the stirring member includes a hollow portion communicating a first opening and a second opening, and a supported portion situated nearer to the first opening than to the second opening and supported by the support portion, and wherein a flow of the liquid is formed in the hollow portion in a direction from the first opening to the second opening by swinging the stirring member supported by the support portion, whereby the liquid in the liquid containing portion is stirred.

2. The liquid container according to claim 1, wherein the stirring member is supported so that when the stirring member is swung, a moving distance of the second opening is larger than a moving distance of the first opening, and wherein in a posture of the liquid container when the liquid container is used, the first opening is located downward in the gravity direction and the second opening is located upward in the gravity direction.

3. The liquid container according to claim 1, wherein the stirring member is supported so that when the stirring member is swung, a moving distance of the second opening is larger than a moving distance of the first opening, and wherein in a posture of the liquid container when the liquid container is used, the first opening is located upward in the gravity direction and the second opening is located downward in the gravity direction.

4. The liquid container according to claim 1, wherein a specific gravity of the stirring member is larger than a specific gravity of the liquid in the liquid containing portion.

5. The liquid container according to claim 1, wherein at least one of the first opening and the second opening of the stirring member is formed obliquely with a direction crossing a swing direction of the first opening and/or the second opening.

6. The liquid container according to claim 1, wherein an inner wall forming the hollow portion of the stirring member is hydrophilized.

7. The liquid container according to claim 1, wherein the hollow portion of the stirring member is bent.

8. The liquid container according to claim 1, wherein the stirring member includes an opening communicated with an intermediate portion of the hollow portion, the intermediate portion being positioned between the first opening and the second opening.

9. The liquid container according to claim 1, wherein the supported portion of the stirring member is located below a central portion of the stirring member in a vertical direction, and the stirring member swings with the supported member as a fulcrum.

10. The liquid container according to claim 9, wherein the support portion extends in a direction crossing the vertical direction to swingably support the supported portion of the stirring member.

11. The liquid container according to claim 1, wherein the supported portion of the stirring member is located above a central portion of the stirring member in a vertical direction, and the stirring member swings with the supported member as a fulcrum.

12. The liquid container according to claim 11, wherein the support portion extends in a direction crossing the vertical direction to swingably support the supported portion of the stirring member.

13. A head cartridge comprising:

a liquid container including a liquid containing portion, a supply port through which liquid contained in the liquid containing portion is supplied, and a stirring member that stirs the liquid contained in the liquid containing portion; and a printing head that performs printing using the liquid supplied through the supply port, wherein the liquid containing portion includes a support portion for swingable support of the stirring member, wherein the stirring member includes a hollow portion communicating a first opening and a second opening, and a supported portion situated nearer to the first opening than to the second opening and supported by the support portion, and wherein a flow of the liquid is formed in the hollow portion in a direction from the first opening to the second opening by swinging the stirring member supported by the support portion, whereby the liquid in the liquid containing portion is stirred.

14. An ink jet printing apparatus comprising:

a carriage on which an ink tank capable of containing ink therein and an ink jet printing head ejecting ink in the ink tank are mounted, wherein the ink tank includes a support portion for swingable support of a stirring member within the ink tank, wherein the stirring member includes a hollow portion communicating a first opening and a second opening, and a supported portion situated nearer to the first opening than to the second opening and supported by the support portion, and wherein the stirring member supported by the support portion is swung according to reciprocation of the carriage, whereby a flow of the liquid is formed in the hollow portion in a direction from the first opening to the second opening and the liquid in the ink tank is stirred.

* * * * *